US006796645B2

(12) United States Patent
Hayashi et al.

(10) Patent No.: US 6,796,645 B2
(45) Date of Patent: Sep. 28, 2004

(54) SURFACE REFORMED FIBER BODY, LIQUID CONTAINER USING FIBER ABSORBER, AND METHOD OF PRODUCING FIBER ABSORBER FOR USE IN LIQUID EJECTION

(75) Inventors: Hiroki Hayashi, Kawasaki (JP); Sadayuki Sugama, Tsukuba (JP); Shozo Hattori, Tokyo (JP); Hajime Yamamoto, Yokohama (JP); Eiichiro Shimizu, Yokohama (JP); Mikio Sanada, Yokohama (JP); Hiroshi Koshikawa, Kawasaki (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 09/726,021

(22) Filed: Nov. 30, 2000

(65) Prior Publication Data

US 2001/0007463 A1 Jul. 12, 2001

(30) Foreign Application Priority Data

Dec. 6, 1999 (JP) ..... 11-346913
Dec. 6, 1999 (JP) ..... 11-346914

(51) Int. Cl.[7] ..... B41J 2/175
(52) U.S. Cl. ..... 347/86
(58) Field of Search ..... 347/85, 86, 87; 428/21, 318.6; 442/118

(56) References Cited

U.S. PATENT DOCUMENTS 3,853,601 A 12/1974 Taskier ..... 117/98
4,940,542 A * 7/1990 Simizu et al. ..... 210/321.8
5,300,238 A 4/1994 Lin et al. ..... 252/8.6

(List continued on next page.)

FOREIGN PATENT DOCUMENTS

EP 281912 9/1988
EP 325543 7/1989
EP 410485 1/1991
EP 488829 6/1992
EP 491293 6/1992
EP 519420 12/1992
EP 542 485 * 5/1993
EP 635373 1/1995

(List continued on next page.)

OTHER PUBLICATIONS

Application No. 09/726,025, filed Nov. 30, 2000.
Application No. 09/546,910, filed Apr. 10, 2000.
Application No. 09/536,127, filed Mar. 28, 2000.
S. Garoff, "Molecular Structure and Interfacial Properties of Surfactant–Coated Surfaces", Thin Solid Films, No. 152 (1987), pp. 49–66.
H. Ringsdorf, "Oriented Ultrathin Membranes From Monomeric and Polymeric Amphiphiles: Monolayers, Liposomes and Multilayers", Thin Solid Films, No. 152 (1987) pp. 207–222.

*Primary Examiner*—Michael Nghiem
(74) *Attorney, Agent, or Firm*—Fitzpatrick, Cella, Harper & Scinto

(57) ABSTRACT

A fiber body which exhibits sufficient ink supplying characteristics for keeping up with the trend toward diversification of ink and high printing speed while ensuring an easy and simple ink injection operation and a liquid container having the same. The ink tank has a PP fiber body (crosshatched area of the figures), as a negative pressure generating member for an ink jet head which ejects liquid to perform recording, arranged almost all over the interior thereof, so as to allow the fiber body to hold a liquid to be supplied to an ink jet head. On the top of the tank casing, provided is an atmosphere communication port. And as a PP fiber body, used is an assembly of intertwined PP fibers of which surface has been subjected to surface treatment of giving hydrophilic nature thereto.

21 Claims, 44 Drawing Sheets

U.S. PATENT DOCUMENTS

| | | | | | |
|---|---|---|---|---|---|
| 5,509,140 | A | | 4/1996 | Koitabashi et al. | 347/86 |
| 5,688,855 | A | | 11/1997 | Stoy et al. | 524/505 |
| 5,742,311 | A | | 4/1998 | Koitabashi et al. | 347/86 |
| 5,784,088 | A | | 7/1998 | Ujita et al. | 347/86 |
| 5,952,077 | A | | 9/1999 | Booth et al. | 428/97 |
| 5,998,650 | A | * | 12/1999 | Schrock et al. | 556/423 |
| 6,177,523 | B1 | * | 1/2001 | Reich et al. | 525/459 |
| 6,179,416 | B1 | | 1/2001 | Ikeda et al. | 347/86 |
| 6,334,674 | B1 | | 1/2002 | Ono et al. | 347/86 |
| 6,382,786 | B2 | * | 5/2002 | Iwanaga et al. | 347/86 |
| 6,652,949 | B2 | * | 11/2003 | Iwanaga et al. | 428/65.9 |
| 2001/0007274 | A1 | * | 7/2001 | Sanada et al. | 156/329 |
| 2001/0035897 | A1 | * | 11/2001 | Hayashi et al. | 347/65 |

FOREIGN PATENT DOCUMENTS

| | | | |
|---|---|---|---|
| EP | 771662 | | 5/1997 |
| EP | 869006 | | 10/1998 |
| GB | 2 058 802 | * | 4/1981 |
| JP | 62-267359 | * | 11/1987 |
| JP | 63-211369 | * | 9/1988 |
| JP | 64-030637 | * | 2/1989 |
| JP | 7-126555 | | 5/1995 |
| KR | 1997-10117 | | 3/1997 |
| WO | 92/04409 | | 3/1992 |
| WO | 00/05073 | | 2/2000 |

* cited by examiner

60 °C

UNTREATED 150×

UNTREATED 500×

UNTREATED 2000×

ACIDIZED 150×

HYDROPHILICALLY TREATED 150×

HYDROPHILICALLY TREATED 500×

HYDROPHILICALLY TREATED 2000×

SURFACE REFORMED FIBER BODY, LIQUID CONTAINER USING FIBER ABSORBER, AND METHOD OF PRODUCING FIBER ABSORBER FOR USE IN LIQUID EJECTION

BACKGROUND OF THE INVENTION

1. Field of the Invention

The present invention relates to a fiber body for use in a container for containing liquid to be supplied to liquid ejecting heads for ejecting liquid for recording, and to a liquid container containing the above fiber body.

The present invention also relates to a material surface reforming method to modify wetting characteristics of the surface of fiber itself or fiber having been subjected to some treatment thereon, which is used as a negative pressure producing (generating) member in a liquid containing container, through modifying its properties and characteristics, and to a negative pressure producing member having been subjected to the above surface reforming.

In particular, the present invention relates to a surface reforming method by which surface reforming of fiber consisting of an olefin resin, which is environment friendly but hard to subject to surface treatment, can be achieved without failure, to fiber having a reformed surface, and to a method of producing the same.

2. Related Background Art

In the ink jet recording field, an ink tank (ink container) through which a negative pressure is applied to recording heads have been used so as to prevent the leakage of ink. This type of ink tank contains a porous body or fiber body and, due to the capillary attraction of the porous body or fiber body, it holds ink and produces a negative pressure. Of the type, the ink tank containing a fiber body is particularly preferable in that, if the fiber body is arranged in such a manner as to keep its direction almost horizontal, the interface between ink and gas is kept horizontal even with fluctuations caused by the environmental changes, and hence, subjected to less variations in the direction of gravity.

As a fiber body contained in an ink tank, those obtained by spinning olefin resins are used in view of its easiness to recycle, because the casing of the ink tank consists of olefin resins such as PE (polyethylene) and PP (polypropylene). Since the wettability of olefin resins by ink, in particular, ink having a high surface tension such as black ink is poor, when injecting ink into an ink tank containing a fiber body consisting of an olefin resin, the vacuum injecting method is employed to forcibly inject ink into a tank in which a vacuum has been drawn.

On the other hand, in the field of ink jet recording today, in order to obtain images of higher quality and ensure high fastness properties of the ink deposited on a recording medium, the improvement of ink itself is making steady progress. To be concrete, pigment ink has come into use so as to improve to water (water-resistance) and a solvent is added to ink so as to heighten the fixing properties to a recording medium.

In the ink tanks currently in use which contain a fiber body consisting of an olefin resin, however, since ink is injected into an ink tank by the vacuum injecting method, as described above, it is necessary to draw a vacuum in the tank, accordingly, the processes and equipment are becoming more complicated. On the other hand, with respect to improvement of ink itself, the use of pigment ink and addition of a solvent to ink causes the viscosity of ink to be increased. As a result, the ability to supply ink to a recording head diminishes, and the higher recording speed becomes, the more supplying ink becomes unlikely to catch up with the recording speed.

The properties and characteristics of an element itself are dependent on the properties of its constituents, and the element has been given desired properties by modifying the properties of the constituents on its surface. The elements given desired properties include, for example, those having on their surface reactive groups having reactivity such as water repellency and hydrophilic nature or reactive groups reactive with an adduct.

In the surface reforming technology currently in use, generally, the surface of an element is made to have a radical with ozone or UV or ozone in combination with UV and the element having a desired property is formed simply by chemically linking the radical with the primary ingredient of a surface treatment agent.

There is another technology in which the surface of an element is not made to have a radical, but a surface treatment agent having a desired property itself is attached to the element, so as to obtain the desired property momentarily; however, the desired property thus obtained does not last.

In particular, in the surface reforming of giving an environment-friendly olefin resin hydrophilic nature, only the technology has been known to obtain a temporary and partial hydrophilic state by intermingle a surfactant with the olefin resin in the presence of water.

In order to form an additional layer on an element, an adhesive and a primer have been used. When using a primer, such as a silane coupling agent, which only reacts and links with the surface of the element, the element itself needs to be treated so that it can react with the agent.

The technologies using a primer include, for example, the one using a primer consisting of the same material system as that of the element so as to utilize its affinity for the element. As a primer of this type, acid-modified chlorinated polypropylene has been known which is used when providing a facing material of polyurethane resin on the element of polypropylene. When using the same material system as that of the surface of the element, however, the volume of the element is inevitably increased, in addition, the technology is needed for applying a uniform and thin coating on the element. Moreover, when the element is fine or porous, it is impossible to apply a uniform coating on such an element to its interior. In particular, acid-modified chlorinated polypropylene is not soluble in water, accordingly, it cannot be used in the form of a water solution, and its applications are limited.

Accordingly, it can be said that there has been no surface treatment agents, including those using the different material system from the surface of the element, which can exist in the form of a water solution and be used in uniform and thin surface reforming irrespective of shape of the element.

On the other hand, with respect to PE and PP, each constituting a fiber body, their wettability by ink is poor (the contact angle to water is 80° or more), though it varies depending on the type of ink. Accordingly, in cases where PE or PP is used in a fiber body of an ink tank, a process of drawing a vacuum in the tank has been inevitably employed in injection of ink into the fiber body. This has required preparation of an injecting apparatus, causing the manufacturing process of the ink tank to be more complicated.

In addition, in the use of ink jet printers in recent years, with steady progress toward higher image quality and a wider variety of ink, there have been growing tendencies to add a solvent to ink, so as to increase the ink's ability to fix on paper, and to use pigment in ink. This, however, causes the viscosity of ink to be increased, and hence, the resistance to ink flow in a fiber body to be increased. As a result, there arises a problem that supplying ink is unlikely to catch up with the printing speed, while the printing speed tends to increase more and more in the latest printers.

There have been used ink tanks having a pressure contact body, which consists of a bundle of fiber arranged in the direction of liquid supplying, placed in its liquid supply opening for supplying liquid to a recording head. In these tanks, too, there arises a problem that, when the resistance to ink flow in the pressure contact body is increased, even if ink supplying in a high flow rate is demanded, supplying ink is unlikely to catch up with the demand, from the viewpoint same as above.

The present invention is an epoch-making invention, which has been made based on the new knowledge and findings obtained during the investigation of the current technology standard.

With the surface reforming technology currently in use, in which the surface reforming is carried out simply by chemically linking the primary ingredient of a surface treatment agent with a radical produced on the surface of an element to be subjected to reforming, a uniform surface reforming cannot be achieved for the surface having a complicated topology, to say nothing of the interior portions of the negative pressure producing members having a complicated porous portion therein, such as sponge and composite fiber body used in the ink jet field.

Further, the use of the technology in which a surfactant is intermingled with the surface of an element in the presence of liquid can never achieve surface reforming for a porous body itself. When the surfactant is exhausted, the properties obtained are lost, and the properties of the surface immediately return to those of the surface itself.

Thus, it goes without saying that, for an olefin resin, which has such an excellent water repellency that its contact angle to water is 80° or more, there has been no surface reforming method by which it is allowed to have a desired lyophilic nature for a long time of period.

Accordingly, the present inventors continued to investigate a method of conducting surface reforming on the surface of an olefin resin rationally and maintaining the reformed properties for a long time of period, while aiming at providing a method applicable to the surface reforming of any elements by clarifying the above method. After such an investigation, the present inventors directed their attention to using a liquid-type surface treatment agent on the assumption that the use of the liquid-type surface treatment agent would enable the surface reforming even for such negative pressure producing members as have a complicated shape.

At the same time, the present inventors newly found that the use of the surface energy in the relationship between the surface of a negative pressure producing member, which is to be reformed, and polymer having a reactive group makes it possible to control the balance of the surface and the reactive group and keep it in a desired state and that the analysis of the polymer itself enables the achievement of further improvement in durability and further stability in quality of the ink.

Further, the present inventors directed their attention to negative pressure properties of a negative pressure producing (generating) member such as porous body, from the different viewpoint, and newly recognized a problem as described below.

In most cases negative pressure producing members currently in use are exposed to liquid at all times, and in some cases, even where a negative pressure chamber and a liquid containing chamber constitute an integrally formed unit, once liquid has been exhausted in part of the member which is to be exposed to liquid, the part is replenished with liquid; however, generally it is not assumed that the negative pressure producing members in state where liquid has been exhausted is replenished with liquid as is done in the ordinary apparatus. Thus, it has not yet been recognized even by those skilled in the art whether the negative pressure of a negative pressure producing member and the amount of liquid held by the same will return to their initial states even after replenishing the member with liquid.

The present inventors examined how far the negative pressure of a negative pressure producing member and the amount of liquid the same holds will return to their initial states when a replenisher containing chamber (container or tank) is mounted after the liquid contained in a chamber for containing a negative pressure producing member is exhausted at an arbitrary level. As a result, there was observed a tendency such that, for the liquid filled into the negative pressure producing member initially, the amount of the liquid held by the member was considerably close to that of the initial state because the liquid was forcibly injected in some way, however, after simply repeating the replenishment, the amount became about a half as much as that of the initial state. This is probably because the air in the negative pressure producing member is hard to remove. And as the liquid was repeatedly replenished, the amount of the liquid held by the negative pressure producing member became smaller and the negative pressure was increased.

SUMMARY OF THE INVENTION

The present inventors concentrated their energies on examining the problems as described above and have finally found that subjecting the surface of the fibers consisting of PE and PP to the surface treatment of giving hydrophilic nature thereto improves the wettability by ink and decreases the resistance to flow during the ink's movement, and moreover, what type of the surface treatment gives them a long-term hydrophilic nature. Furthermore, the present inventors have come to understand that the surface treatment of giving hydrophilic nature can be developed more rationally using such a treatment in a desired area of the fiber body, as a negative pressure producing (generating) member, in accordance with the shape of the liquid container.

Specifically, one of the points the present invention aims at, in light of the problems of the prior arts as described above, is to provide a fiber body which can exhibit an ink supplying ability keeping up with the trends toward diversification of ink and high-speed printing and can make easier the ink injection, a liquid container having the same, and a method of subjecting the above fiber body to surface treatment of giving hydrophilic nature thereto.

Further, the present invention aims mainly at providing an epoch-making lyophilic surface reforming method which enables a desired lyophilic surface reforming neither by the technique of modifying the properties of a negative pressure producing member by allowing the same to have a radical using ozone and ultraviolet rays nor by the technique of applying primers such as silane coupling agent on the surface of an element, causing a non-uniform coating thereon, as described above, but by a novel mechanism; a treatment liquid for use in the above method; a negative pressure producing member obtained by the above method; and a surface structure itself obtained by the lyophilic surface reforming, in particular, a fiber negative pressure producing member having an excellent ability to return to the initial negative pressure even after repeating replenishment and an excellent ability to supply liquid. In particular, the present invention aims at providing a fiber absorber for use in liquid ejection and a liquid container with which desired properties, such as the property of decreasing resistance to flow of liquid during the liquid's movement, can be obtained by modifying the properties of the fiber in the liquid container through changing the level of surface treatment of giving lyophilic nature to the surface of an element.

The present invention aims mainly at providing an epoch-making lyophilic surface reforming method which enables a desired lyophilic surface reforming neither by the technique of modifying the properties of a negative pressure producing member by allowing the same to have a radical with ozone and ultraviolet rays nor by the technique of applying primers such as silane coupling agent on the surface of an element, causing a non-uniform coating thereon, as described above, but by a novel mechanism; a treatment liquid for use in the method; a negative pressure producing member obtained by the method; and a surface structure itself obtained by the lyophilic surface reforming, in particular, a fiber negative pressure producing member having an excellent ability to return to the initial negative pressure even after repeating replenishment and an excellent ability to supply liquid.

The first object of the present invention is to provide a liquid treatment agent with which the entire internal surface of a negative pressure producing member having a complicated topology, such as porous body and finely processed element, can be subjected to surface treatment of giving a desired lyophilic nature thereto and a lyophilic surface reforming method using the liquid treatment agent.

The second object of the present invention is to provide a novel lyophilic surface reforming method which allows an olefin resin, which has been considered to be hard to subject to surface reforming, to retain lyophilic nature for a long period of time and a surface structure itself.

The third object of the present invention is to provide a novel lyophilic surface reforming method which enables the formation of a molecular level thin film, preferably a monomolecular level thin film, as a reformed surface itself, while causing no weight increase of a negative pressure producing member structure and a surface structure itself.

The fourth object of the present invention is to provide a surface treatment method which makes it possible to freely conduct a desired surface reforming by introducing a novel mechanism to lyophilic surface reforming method itself.

The fifth object of the present invention is to provide a method of producing a lyophilic surface treatment agent for use in the surface of a negative pressure producing member which is simple and excellent in mass productivity.

The sixth object of the present invention is to provide an epoch-making method of subjecting the surface of a negative pressure producing member to lyophilic surface treatment which utilizes, from the viewpoint of the interfacial energy of a functional group (or a group of functional groups) a polymer has, an interfacial physical adsorption at an energy level almost the same as that caused by the polymer cleavage.

The seventh object of the present invention is to provide a novel lyophilic surface reforming method which enables the uniform reforming of the periphery of a negative pressure producing member and a surface structure itself on a level which cannot be achieved by the prior arts in terms of its entire periphery.

The other objects of the present invention will be understood from the following description and the present invention can also achieve complex objects of the arbitrary combinations of each of the above object.

In order to achieve the above objects, the present invention is a negative pressure producing fiber body for use in a container for containing a liquid, which is to be supplied to a liquid ejecting head for ejecting the liquid for recording, in a manner that allows the liquid to be supplied, characterized in that it has an olefin resin at least on its fiber surface and the olefin resin has a lyophilic group in an oriented state on its surface.

The present invention is a fiber body for use in a container for containing a water-based liquid, which is to be supplied to a liquid ejecting head for ejecting the water-based liquid for recording, in a manner that allows the water-based liquid to be supplied, consisting of a fiber provided with a polymer at least part of its surface, characterized in that the above polymer includes a first portion having a hydrophilic group and a second portion having a group of which interfacial energy is lower than that of the above hydrophilic group and almost the same as the surface energy of the above part of the surface, the above second portion being oriented toward the above part of the surface, the above first portion being oriented in the direction different from the above part of the surface.

When the surface of the above fiber consists of an olefin resin, it s preferable that the above polymer is, for example, polyalkylsiloxane including a hydrophilic group and the above hydrophilic group have, for example, a polyalkylene oxide chain.

Preferably, the above olefin resin is polypropylene or polyethylene and the above polyalkylsiloxane is polyoxyalkylene-dimethylpolysiloxane.

The present invention is a liquid container containing the above fiber body as a negative pressure producing member.

The present invention is a liquid container including a negative pressure producing member containing portion for containing the above fiber body as a negative pressure producing member and a liquid containing portion for supplying liquid to the above negative pressure producing member containing portion, the above liquid containing portion and the above negative pressure producing member containing portion constituting an integrally or removably formed unit.

The above liquid containing portion may be constructed in such a manner as to include an inner bag for containing liquid, which becomes deformed as the liquid contained therein becomes led out and thereby can produce a negative pressure, a casing for covering the above inner bag, and an atmosphere communication port which can introduce atmosphere between the above casing and the above inner bag.

The above fiber body, as a negative pressure producing member, contained in the negative pressure producing member containing portion has a polyolefin resin on its entire surface and the above polyolefin resin has a hydrophilic group in a oriented state on its surface; accordingly, the surface of the fiber has a high wettability, which makes easier a liquid injection process even when the liquid has high surface tension. In addition, since the resistance to flow during the movement of recording liquid is decreased, it can keep up with the trend toward higher-speed printing, in particular, high flow rate liquid supplying to a liquid ejecting head.

The present invention is a liquid container which has a supply opening for supplying liquid to a liquid ejecting head and an atmosphere communication port for allowing the interior of the liquid container to communicate with the atmosphere, contains a negative pressure producing member, and is characterized in that a fiber body, as described above, is arranged in the interior portion of the above supply opening. Arranging a fiber body, which has been subjected to surface treatment of giving hydrophilic nature thereto, in the supply opening portion enables the decrease in resistance to ink flow and the increase in the ink's flow characteristics, while obtaining a desired capillary attraction, and hence, the ink supplying of a high flow rate. Furthermore, it enables the prevention of bubble retention which is caused when using the fiber body as a pressure contact body, in this point, the increase in resistance to flow can be suppressed.

The present invention is a liquid container which has a supply opening for supplying liquid to a liquid ejecting head and an atmosphere communication port for allowing the interior of the liquid container to communicate with the atmosphere, contains a fiber body as a negative pressure producing member, and is characterized in that the above fiber body is partially subjected to surface treatment of giving lyophilic nature thereto only on the portion corresponding to the above supply opening and on the periphery portion thereof. Subjecting the fiber body to surface treatment of giving hydrophilic nature thereto only on the portions described above is also applicable to a liquid container which includes a negative pressure producing member containing portion for containing a fiber body as a negative pressure producing member, an atmosphere communication port for allowing the interior of the liquid container to communicate with the atmosphere, and a supply opening for supplying liquid held by the above fiber to a liquid ejecting head, and a liquid containing portion for leading out the liquid to the above negative pressure producing member containing portion, the above liquid containing portion and the above negative pressure producing member containing portion constituting an integrally or removably formed unit.

Subjecting the fiber body, as a negative pressure producing member, contained in the above liquid container to surface treatment of giving lyophilic nature thereto only on the portion corresponding to the supply opening and on the periphery portion thereof allows recording liquid to tend to exist on the supply opening and on the periphery thereof at all times; accordingly, the liquid supplying to a head is unlikely to be interrupted, in addition, bubbles are unlikely to flow in the recording head.

The present invention is a liquid container which includes a negative pressure producing member containing portion for containing a fiber body as a negative pressure producing member, an atmosphere communication port for allowing the interior of the above negative pressure producing member containing portion to communicate with the atmosphere, a supply opening for supplying liquid to a liquid ejecting head and a liquid containing portion for leading out the liquid to the above negative pressure producing member containing portion, the above liquid containing portion and the above negative pressure producing member containing portion constituting an integrally or removably formed unit, is characterized in that the above fiber body is partially subjected to surface treatment of giving lyophilic nature thereto only on the periphery of the planar layer existing over the portion where the above negative pressure producing member containing portion communicates with the above liquid containing portion and intersecting the gravity direction.

Subjecting the fiber body, as a negative pressure producing member, contained in the above liquid container to surface treatment of giving hydrophilic nature thereto on the planar layer which exists over the portion where the above negative pressure producing member containing portion communicates with the above liquid containing portion and intersects the gravity direction enables the diffusion of the liquid flowing though the fiber on the portion having been subjected to surface treatment of giving hydrophilic nature thereto, even when the liquid or gas in the liquid containing portion expands due to some change in environment. Thus, an abrupt increase in pressure can be relaxed in the direction of horizontal section without increasing the volume of the negative pressure producing member containing chamber.

The present invention is a liquid container which includes a negative pressure producing member containing portion for containing a fiber body as a negative pressure producing member, an atmosphere communication port for allowing the interior of the above negative pressure producing member containing portion to communicate with the atmosphere, a supply opening for supplying liquid to a liquid ejecting head and a liquid containing portion for leading out the liquid to the above negative pressure producing member containing portion, the above liquid containing portion and the above negative pressure producing member containing portion constituting an integrally or removably formed unit, is characterized in that the above fiber body is partially subjected to surface treatment of giving lyophilic nature thereto at least on the liquid supplying area from the portion where the above negative pressure producing member containing portion communicates with the above liquid containing portion to the above supply opening.

Partially subjecting the fiber body, as a negative pressure producing member, contained in the above liquid container to surface treatment of giving lyophilic nature thereto at least on the liquid supplying area from the portion where the above negative pressure producing member containing portion communicates with the above liquid containing portion to the above supply opening enables the prevention of a liquid level from prominently dropping on the area having been subjected to surface treatment of giving lyophilic nature thereto, even when the liquid level is disturbed during the gas-liquid exchange because of the micro difference in density the fiber body has. Thus, the movement of the liquid from the liquid containing portion to the negative pressure producing member containing portion is not interrupted by the air, and gas-liquid exchange operation is carried out stably. In addition, since the portion in the vicinity of the supply opening has been subjected to surface treatment of giving lyophilic nature thereto, the liquid tends to exist around the portion; accordingly, a recording liquid is hard to interrupt on the supply opening. Furthermore, when replacing the liquid containing portion with a new one, since the portion of the fiber body having been subjected to surface treatment of giving lyophilic nature thereto positively draws in the liquid, the recovery of a head is promptly achieved. And the amount of the liquid required for the head recovery can be controlled by varying the size of the area subjected to surface treatment of giving lyophilic nature thereto.

The present invention is a liquid container which includes a negative pressure producing member containing portion for containing a fiber body as a negative pressure producing member, an atmosphere communication port for allowing the interior of the above negative pressure producing member containing portion to communicate with the atmosphere, a supply opening for supplying liquid to a liquid ejecting head and a liquid containing portion for leading out the liquid to the above negative pressure producing member containing portion, the above liquid containing portion and the above negative pressure producing member containing portion constituting an integrally or removably formed unit, is characterized in that the above fiber body is partially subjected to surface treatment of giving lyophilic nature thereto on the portion where the above negative pressure producing member containing portion communicates with the above liquid containing portion.

The present invention is a liquid container which includes a negative pressure producing member containing portion for containing a fiber body as a negative pressure producing member, an atmosphere communication port for allowing the interior of the above negative pressure producing member containing portion to communicate with the atmosphere, a supply opening for supplying liquid to a liquid ejecting head, a liquid containing portion for leading out the liquid to the above negative pressure producing member containing portion and an atmosphere introducing channel, which is provided in the vicinity of the portion where the above negative pressure producing member containing portion communicates with the above liquid containing portion, for causing a gas-liquid exchange in which the liquid is led out to the above negative pressure producing member containing portion subsequently after gas is introduced into the above liquid containing portion, the above liquid containing portion and the above negative pressure producing member containing portion constituting an integrally or removably formed unit, is characterized in that the above fiber body is partially subjected to surface treatment of giving lyophilic nature thereto on the area corresponding to the above atmosphere introducing channel.

Partially subjecting the fiber body, as a negative pressure producing member, contained in the above liquid container to surface treatment of giving lyophilic nature thereto on the portion where the above negative pressure producing member containing portion communicates with the above liquid containing portion or the area corresponding to the above atmosphere introducing channel allows the liquid to be stably held by the portion having been made lyophilic, which can prevent gas-liquid exchange operation from starting, due to inadvertent air pass, when the gas-liquid exchange is still premature. Further, when the consumption of a recording liquid stops in the gas-liquid exchange state, the atmosphere communication channel or the atmosphere communication portion can be closed promptly by filling the portion of the fiber body corresponding to the atmosphere introducing channel with the liquid. Due to the functions described above, a stable gas-liquid exchange operation becomes made possible. In addition, when removing the above liquid container so as to replace it with a new one, the liquid is unlikely to drop from the communication portion on the side of the above negative pressure producing member containing portion.

The liquid container of which fiber body has been partially subjected to surface treatment of giving lyophilic nature thereto may be constructed in such a manner as to include an inner bag for containing liquid, which becomes deformed as the liquid contained therein becomes led out and thereby can produce a negative pressure, a casing for covering the above inner bag, and an atmosphere communication port which can introduce atmosphere between the above casing and the above inner bag.

The present invention is a method of subjecting a fiber body, as a negative pressure producing member, contained in a liquid container having a supply opening for supplying liquid to a liquid ejecting head and an atmosphere communication port for allowing the interior of the liquid container to communicate with the atmosphere, besides the fiber body, to surface treatment of giving lyophilic nature thereto on the portion corresponding to a supply opening and the periphery thereof, comprising the steps of: injecting the above lyophilic treatment agent into the vicinity of the central portion of the above fiber body by using a syringe containing the above lyophilic treatment agent and inserting the needle of the syringe into the above fiber body through the above atmosphere communication port; and sucking up the above lyophilic treatment agent through the above supply opening and discharging the same before the above lyophilic treatment agent reaches the inner surface of the above liquid container.

In order to achieve the above objects, the fiber absorber of the present invention for use in liquid ejection is a fiber absorber for use in an ink jet apparatus which consists of an olefin resin fiber and is contained in a liquid container of the apparatus so as to hold a liquid supplied to a liquid ejecting head under a negative pressure, characterized in that it has at least one portion having been subjected to surface treatment of giving lyophilic nature thereto on the surface of the fiber and the above portion having been subjected to surface treatment of giving lyophilic nature has a first lyophilic area relatively superior in lyophilic nature and a second lyophilic area relatively inferior to the above first lyophilic area in lyophilic nature.

Another aspect of the fiber absorber of the present invention for use in liquid ejection is a fiber absorber, as an assembly of numbers of fibers, for use in liquid ejection which has a polymer compound provided on at least part of its surface which should be subjected to surface treatment of giving lyophilic nature thereto and is used for holding a liquid supplied to a liquid ejecting head under a negative pressure, characterized in that the above polymer compound has a first portion having a lyophilic group and a second portion having a group of which interfacial energy is lower than that of the above lyophilic group but is almost the same as the surface energy of the above surface part to be subjected to the above surface treatment and the portion having been subjected to surface treatment of giving lyophilic nature thereto and having lyophilic nature is obtained in such a manner as to orient the above second portion toward the above surface part and the above first portion in the direction different from the above surface part, the above surface part having a first lyophilic area relatively superior in lyophilic nature and a second lyophilic area of which density decreases with the increase in distance away from the above first lyophilic area.

Another aspect of the fiber absorber of the present invention for use in liquid ejection is a fiber absorber, as an assembly of numbers of fibers, for use in liquid ejection which has a lyophobic surface at least part of which has been subjected to surface reforming to have a lyophilic nature and is contained in a liquid container for holding a liquid supplied to a liquid ejecting head under a negative pressure, characterized in that it has a lyophilic portion obtained by attaching the fragmented portions (fragment) having a lyophilic or a lyophobic group, which has been produced by the cleavage of polymer (compound) having both lyophilic and lyophobic groups, on the above lyophobic surface in such a manner as to orient the above lyophobic group toward the above lyophobic surface and in the direction different from the above lyophilic group, the above lyophilic portion having a first lyophilic area relatively superior in lyophilic nature and a second lyophilic area relatively inferior to the above first lyophilic area in lyophilic nature.

Another aspect of the fiber absorber of the present invention for use in liquid ejection is a fiber absorber, as an assembly of numbers of fibers, for use in liquid ejection which has an olefin resin at least on its surface at least part of which is a reformed to have lyophilic nature and is contained in a liquid container for holding a liquid supplied to a liquid ejecting head under a negative pressure, characterized in that the fiber of the fiber absorber has a wettable surface structure having a relatively long chain lyophilic group and a relatively short chain lyophobic group alternately which is obtained in the following steps of: attaching on the surface of said fiber a treatment agent containing a polymer, which has a hydrophilic group and a group, as a constituent of the above olefin resin, having an interfacial energy almost the same as the surface energy of said olefin-based fiber surface thereon, a dilute acid as a catalyst for said polymer cleavage and alcohol; subjecting said polymer to cleavage by evaporating the treatment agent attached on the surface of said fiber and allowing said dilute acid to be a concentrated acid; and condensing the product of the polymer cleavage, the above wettable surface structure having a first lyophilic area relatively superior in lyophilic nature and a second lyophilic area relatively inferior to the above first lyophilic area in lyophilic nature.

As described above, according to the fiber absorber of the present invention for use in liquid ejection, since the fiber absorber can be subjected to surface treatment of giving lyophilic nature thereto while allowing the lyophilic nature to have a distribution, the resistance to liquid flow in the fiber absorber can be freely set according to the need while utilizing the behavior of the lyophilic group (this is based on the fact that the more lyophilic groups, the lower resistance to flow). Thus, the fiber absorber allows a liquid to be held in the liquid container and supplied to a liquid ejecting head in an optimal state according to the liquid behavior required in the liquid container.

A liquid container of the present invention has a container casing which includes a supply opening for supplying a liquid to a liquid ejecting head and an atmosphere communication port for communicating with the atmosphere and a fiber absorber for use in liquid ejection which is selected from those of the present invention described above and contained in the above container casing to hold the liquid therein using a negative pressure.

According to the liquid container described above, a liquid can be held therein and supplied to a liquid ejecting head in an optimal state by arranging a first lyophilic area of the fiber absorber for use in liquid ejection in a predetermined position of the liquid container according to the liquid behavior.

More specifically, the liquid container of the present invention has a container casing which includes a supply opening for supplying a liquid to a liquid ejecting head and an atmosphere communication port for communicating with the atmosphere and a fiber absorber which consists of an olefin resin, has been subjected to surface treatment of giving lyophilic nature thereto at least on part thereof in such a manner as to be allowed to have stronger lyophilic nature as it becomes away from the above supply opening, and is contained in the above container casing to hold the liquid therein using a negative pressure.

According to the liquid container described above, since the fiber absorber contained in the container casing has been subjected to surface treatment of giving lyophilic nature thereto in such a manner as to be allowed to have more lyophilic groups (stronger lyophilic nature) as it becomes away from the above supply opening, the resistance of liquid flow becomes smaller at a location away from the supply opening. As a result, even at a location away from the supply opening, the liquid flows easily toward the supply opening, which improves the efficiency of using the liquid in the liquid container. With respect to liquid injection into the liquid container, as long as it is done from the area having stronger lyophilic nature, the liquid can be injected into the liquid container without drawing a vacuum therein.

Another aspect of the liquid container of the present invention has a container casing which includes a supply opening for supplying a liquid to a liquid ejecting head and an atmosphere communication port for communicating with the atmosphere and a fiber absorber which consists of an olefin resin, has been subjected to surface treatment of giving lyophilic nature thereto at least in the vicinity of the above supply opening in such a manner as to be allowed to have weaker lyophilic nature as it becomes away from the above supply opening, and is contained in the above container casing to hold the liquid therein using a negative pressure.

According to the liquid container described above, since the fiber absorber contained in the container casing has been subjected to surface treatment of giving lyophilic nature thereto in the vicinity of the supply opening in such a manner as to be allowed to have weaker lyophilic nature as it becomes away from the above supply opening, the liquid can be held without increasing the resistance to liquid flow in the vicinity of the supply opening, which prevents the liquid supplying to the liquid ejecting head from being interrupted. With respect to liquid injection into the liquid container, it can be done from the supply opening without drawing a vacuum therein.

Another aspect of the liquid container of the present invention has a negative pressure producing member containing chamber which includes a supply opening for supplying a liquid to a liquid ejecting head and an atmosphere communication port for communicating with the atmosphere and contains therein a fiber absorber consisting of an olefin resin for holding a liquid under negative pressure; and a liquid containing chamber which communicates with the above negative pressure producing member containing chamber and has a liquid containing portion substantially in a sealed state except the portion communicating with the above negative pressure producing member containing chamber, the above fiber absorber existing over the above communication portion as a layer intersecting the gravity direction and having a portion having been subjected to surface treatment of giving lyophilic nature thereto in such a manner as to be allowed to have weaker lyophilic nature on its upper portion.

In the above liquid container, once the liquid in the negative pressure producing member containing chamber is consumed to such a extent that the liquid level thereof reaches the portion communicating with the liquid containing portion, then the communication portion starts to communicate with the atmosphere via the atmosphere communication portion of the negative pressure producing member containing chamber and the fiber absorber, and the air is introduced into the liquid containing chamber. At the same time, the liquid in the liquid containing chamber moves to the negative pressure producing member containing chamber via the communication portion, which allows the negative pressure in the negative pressure producing member containing chamber to be kept constant.

If the liquid and gas in the liquid containing chamber abruptly expand due to environmental changes etc., the liquid in the liquid containing chamber flows in the negative pressure producing member containing chamber; however, the liquid is absorbed into the fiber absorber by the buffer function of the negative pressure producing member containing chamber. Since the fiber absorber exists over the above communication portion as a layer intersecting the gravity direction and has a portion having been subjected to surface treatment of giving lyophilic nature thereto in such a manner as to be allowed to have weaker lyophilic nature on its upper portion, the liquid having flowed into the negative pressure producing member containing chamber is trapped into the portion having been subjected to surface treatment of giving lyophilic nature thereto from the lower to the upper portion in sequence. Thus, even if the upper volume of the negative pressure producing member containing chamber is not needlessly large, the buffer function described above is fully performed.

Further, the present invention provides a method of producing the above-described fiber absorber of the present invention for use in liquid ejection. One aspect of the method is a method of producing a fiber absorber, as an assembly of numbers of fibers, for use in liquid ejection which has a lyophilic group provided at least on the part of its surface which should be subjected to surface treatment of giving lyophilic nature thereto and is used for holding a liquid supplied to a liquid ejecting head under a negative pressure, the method including a first step of providing a liquid, which contains a polymer including a first portion having the above lyophilic group and a second portion having a group of which interfacial energy is different from that of the above lyophilic group but is almost the same as the surface energy of the above surface part to be subjected the above surface treatment, to the part which should be subjected to surface treatment of giving lyophilic nature thereto in such a manner as to form a first area where the density of the liquid provided is relatively high and a second area where the density of the same is relatively low; and a second step of obtaining a first lyophilic area relatively superior in lyophilic nature and a second lyophilic area relatively inferior to the above first lyophilic area in lyophilic nature in such a manner as to orient the above second portion of the above polymer toward the above surface part and the above first portion of the same in the direction different from the above surface part.

Another aspect of the method of producing a fiber absorber of the present invention for use in liquid ejection is a method of producing a fiber absorber, as an assembly of numbers of fibers, for use in liquid ejection which has a lyophilic group provided at least on the part of its surface which should be subjected to surface treatment of giving lyophilic nature thereto and is used for holding a liquid supplied to a liquid ejecting head under a negative pressure, the method including a first step of providing the above part of the surface with a liquid containing a fragmented product which has a first portion with a lyophilic group and a second portion with a group having an interfacial energy different from that of the above lyophilic group but almost the same as the surface energy of the above part of the surface, the above fragmented product being obtained by subjecting a polymer to cleavage which has the above first and second portions in such a manner as to form a first area where the density of the liquid provided is relatively high and a second area where the density of the same is relatively low; and a second step of obtaining a first lyophilic area relatively superior in lyophilic nature and a second lyophilic area relatively inferior to the above first lyophilic area in lyophilic nature in such a manner as to orient the second portion of the above fragmented product toward the above part of the surface and the above first portion of the same in the direction different from the above part of the surface; and a third step of condensing at least part of the oriented portions of the above fragmented product on the above part of the surface into a polymer.

Another aspect of the method of producing a fiber absorber of the present invention for use in liquid ejection is a method of producing a fiber absorber, as an assembly of numbers of fibers, for use in liquid ejection which has an olefin resin at least on its surface, has a lyophilic group provided at least on the part of the above surface, and is used for holding a liquid supplied to a liquid ejecting head under a negative pressure, the method including a first step of providing the above part of the surface with a liquid in which a polymer of alkylsiloxane including a lyophilic group is dissolved in such a manner as to form a first area where the density of the liquid provided is relatively high and a second area where the density of the same is relatively low; and a second step of obtaining a first lyophilic area relatively superior in lyophilic nature and a second lyophilic area relatively inferior to the above first lyophilic area in lyophilic nature in such a manner as to orient the above alkylsiloxane toward the above part of the surface and the above lyophilic group in the direction different from the above part of the surface.

Another aspect of the method of producing a fiber absorber of the present invention for use in liquid ejection is a method of producing a fiber absorber, as an assembly of numbers of fibers, for use in liquid ejection which has an olefin resin at least on its surface, has a lyophilic group provided at least on the part of the above surface, and is used for holding a liquid supplied to a liquid ejecting head under a negative pressure, the method including a first step of providing the above part of the surface with a liquid in which a fragmented product obtained by subjecting a polymer of alkylsiloxane including a lyophilic group to cleavage is dissolved in such a manner as to form a first area where the density of the liquid provided is relatively high and a second area where the density of the same is relatively low; and a second step of obtaining a first lyophilic area relatively superior in lyophilic nature and a second lyophilic area relatively inferior to the above first lyophilic area in lyophilic nature in such a manner as to condense the above fragmented product on the above part of the surface, in addition, orient the above alkylsiloxane toward the above part of the surface and the above lyophilic group in the direction different from the above part of the surface.

Another aspect of the method of producing a fiber absorber of the present invention for use in liquid ejection is a method of producing a fiber absorber, as an assembly of numbers of fibers, for use in liquid ejection which has an olefin resin at least on its surface, has a lyophilic group provided at least on the part of the above surface, and is used for holding a liquid supplied to a liquid ejecting head under a negative pressure, the method including the steps of: forming a fiber surface having a liquid, which contains polyalkylsiloxane, acid and alcohol, attached thereon in such a manner as to form a first area where the density of the liquid attached is relatively high and a second area where the density of the same is relatively low; and obtaining a first lyophilic area relatively superior in lyophilic nature and a second lyophilic area relatively inferior to the above first lyophilic area in lyophilic nature in such a manner as to heat and dry the liquid attached on the above fiber surface at temperatures higher than room temperature and lower than the melting point of the above olefin resin.

Another aspect of the method of producing a fiber absorber of the present invention for use in liquid ejection is a method of producing a fiber absorber, as an assembly of numbers of fibers, for use in liquid ejection which has an olefin resin at least on its surface, has a lyophilic group provided at least on the part of the above surface, and is used for holding a liquid supplied to a liquid ejecting head under a negative pressure, the method including the steps of: forming a fiber surface having a liquid, which contains polyalkylsiloxane, acid and alcohol, attached thereon in such a manner as to form a first area where the density of the liquid attached is relatively high and a second area where the density of the same is relatively low; and obtaining a first lyophilic area relatively superior in lyophilic nature and a second lyophilic area relatively inferior to the above first lyophilic area in lyophilic nature in such a manner as to dry the liquid attached on the above fiber surface and, during the drying process, orientate the above lyophilic group in the direction opposite to the above fiber surface so as to subjecting the fiber surface to surface treatment of giving lyophilic nature thereto.

A surface reforming method of the present invention is a method of subjecting the a fiber absorber, as an assembly of numbers of fibers, for use in liquid ejection which has a lyophobic surface and is used for holding a liquid supplied to a liquid ejecting head under a negative pressure to surface reforming so as to reform the above lyophobic surface into a lyophilic one, characterized in that it includes a step of attaching on the above lyophobic surface a fragmented product having both lyophilic and lyophobic groups, which is produced by subjecting a polymer having both lyophilic and lyophobic groups to cleavage, in such a manner as to orient the above lyophobic group toward the surface and the above lyophilic group in the direction different from that of the above lyophobic group so as to have a first lyophilic area relatively superior in lyophilic nature and a second lyophilic area relatively inferior to the above first lyophilic area in lyophilic nature.

Another aspect of the surface reforming method of the present invention is a method of subjecting a fiber absorber, as an assembly of numbers of fibers, for use in liquid ejection to surface reforming on part of its surface, characterized in that the surface reforming is performed in such a manner as to condense a cleavage polymer, which has been oriented in accordance with the affinity of the interfacial energy of a group similar to the surface energy of the part of the surface of the above fiber, on the above part of the surface, so as to have a first lyophilic area relatively superior in lyophilic nature and a second lyophilic area relatively inferior to the above first lyophilic area in lyophilic nature.

Another aspect of the surface reforming method of the present invention is a method of subjecting a fiber absorber, as an assembly of numbers of fibers, for use in liquid ejection to surface reforming on part of its surface using a liquid polymer, characterized in that it includes a condensation step of condensing a polymer fragmented product, which has a first group which can be subjected to cleavage and condensation and comprises a lyophilic group and a second group of which interfacial energy is almost the same as the surface energy of the part of the surface of the above fiber, into a polymer on the above part of the surface, so as to have a first lyophilic area relatively superior in lyophilic nature and a second lyophilic area relatively inferior to the above first lyophilic area in lyophilic nature.

A wettable surface structure of the fiber assembly of the present invention is a wettable surface structure of a fiber assembly used for holding a liquid to be supplied to a liquid ejecting head under negative pressure, characterized in that it has a lyophilic portion including a polymer having relatively long chain lyophilic groups and relatively short chain lyophobic groups alternately, the above lyophilic portion having a first lyophilic area relatively superior in lyophilic nature and a second lyophilic area relatively inferior to the above first lyophilic area in lyophilic nature.

The terms "lyophilic area relatively superior in lyophilic nature" used herein means any of the cases where the area shows stronger lyophilic nature than the other lyophilic areas because it has more lyophilic groups per area than the others and where the area can maintain a relatively lyophilic state for a longer period of time because lyophilic groups are attached on the area more strongly than the other lyophilic areas.

On the other hand, the terms "lyophilic area relatively inferior in lyophilic nature" used herein means any of the cases where the area shows weaker lyophilic nature than the other lyophilic areas and where the area can maintain a relatively lyophilic state only for a shorter period of time.

BRIEF DESCRIPTION OF THE DRAWINGS

FIG. 17A is a figure explaining the case where both a second group as a functional group and a first group for attaching to the surface of the element are located in a side chain of the polymer and FIG. 17B is a figure explaining the case where the first group is included in a main chain;

FIGS. 25A to 25D show a mode of use as the ink absorber in the ink tank, a total shape of the PE-PP fibrous body, a direction F1 of the orientation of the fiber, and the direction F2 orthogonal to the F1, the status before the above described PE-PP fibrous body is made by heat fusion, and the status in which the above described PE-PP fibrous body has been made by heat fusion, respectively;

FIGS. 27D, 27E, and 27F are partially enlarged views of FIGS. 27A, 27B, and 27C, respectively;

FIGS. 28D, 28E, and 28F are partially enlarged views of FIGS. 28A, 28B, and 28C, respectively;

DESCRIPTION OF THE PREFERRED EMBODIMENTS

Figure 1:
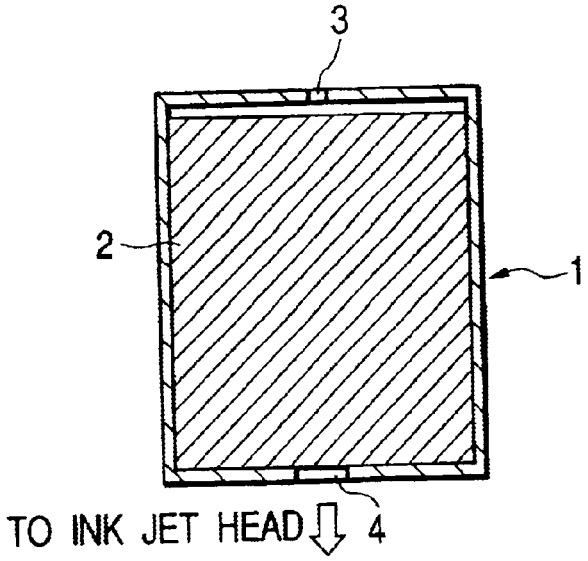
FIG. 1 is a diagrammatic sectional view of a liquid containing container according to a first embodiment of the present invention.

An embodiment of the present invention will be described below with reference to the drawings. In the present invention, a term "liquid affinity property" is used for a property excellent in a wettability against a liquid to be contained. In the embodiment described below, an aqueous ink is explained as the example of the ink and the case, where a hydrophilic property among liquid affinity properties is imparted thereto, will be explained. However, a kind of ink in the present invention is not restricted to aqueous one, but may be an oily ink. In this case, the property to impart to the surface is an lipophilic property. In addition, a liquid held by the fibrous absorber is not restricted to ink, but includes various kinds of liquids supplied to a liquid discharging head.

The liquid containing container will be described for a representing one to hold a recording liquid used for an ink jet recording head or a fixing liquid of the recording liquid.

First, below is a detailed description of the hydrophilic treatment of the fibrous absorber in the present embodiment together with a principle thereof. In the present invention, an object of the hydrophilic treatment is an external surface exposed to an outer part of the fiber composing the fibrous absorber. However, in the following description, an explanation will be given as the surface reform for an element in a wider sense.

The surface reforming method described below is a method to make the surface reform as the purpose possible by attaching the polymer (or, fragments (fragmented product) of the polymer) to the surface by making a specific orientation and imparting a property, which is possessed by a functional group of the polymer (or, fragments of the polymer), to the surface, using a functional group of a molecule contained in a substance constructing the surface of the element.

Here, "element" means that formed from various materials and holding a specific external shape and thus, accompanied by the external shape, it has the external surface exposed to outside. In addition, inside thereof, the element may be that having a space and cavity parts, which includes the part communicating with outside or a hollow part. An internal surface (internal wall) partitioning these parts can be a partial surface as the object for the surface reform in the present invention. The hollow part includes that having the inner surface diving it and being a space completely insulated from outside. However, those, which allow supplying a surface-treating liquid to inside the hollow part before reform treatment and become the hollow part insulated from outside after reform treatment, can be the object of the treatment of the present invention.

As described above, the surface reform method according to the present invention is applied to the object which is the surface, among all surfaces posses by various kinds of elements, capable of contacting a liquid solution for surface treatment from outside without deterioration of the shape of the element. Therefore, each or both the external surface of the element and the internal surface connected thereto are assigned to the object of the partial surface. Besides, the present invention also includes changing the property of the partially divided surfaces selected from the surface being the object. According to selection, reform of a desired partial surface region includes the a mode to select the external surface of the element and the internal surface to be connected thereto.

In the above described surface reform, a part, which is reformed and composes at least a part of the surface possessed by the element, is treated. In other words, the part means a part from the surface of the element or whole surface of the element selected according to requirement.

"Fragmentation of the polymer" to small molecules in the present specification means production of those, made by cleavage of a part of the polymer, or monomers. In practical example, included one is all those produced by cleavage of the polymer by a cleaving catalyst such as acid. "Polymer film formation" includes formation of real film or different orientation of respective parts toward a two-dimensional surface.

Preferably, the "polymer" in the present specification comprises a first part having a functional group and a second part having an interface energy differing from the interface energy of this functional group and almost equal to a surface energy of the objective element for attaching, and differs from a component material of the surface of the above described element. Therefore, according to the component material of the element to be reformed, a desired polymer may be freely selected from polymers having the interface energy almost equal to the surface energy of the surface of the element. It is more preferable that the "polymer" has properties cleavable and condensable after cleavage. Other than the above described first part and the second part, the functional group may be contained. In this case, in hydrophilic treatment as an example, it is preferable that a hydrophilic group as the functional group has a long chain relatively to the functional group (relatively, hydrophobic group to the above described hydrophilic group) other than the first and second parts.

The part to be subjected to the surface treatment in the present invention may be those made of a single material and may be a complex material made of some kinds of materials; in consideration of the quality of the surface to be treated, the polymer differing from the component material can be used.

Below is a specific explanation of the principle on which the surface reform is carried out by using the case where the surface composed of the single substance is reformed in order to make explanation of the principle easy.

"The principle on which the surface reform is carried out"

The surface reform, applicable to the present invention, of the element is achieved by using the polymer, which is made by binding of a main skeleton (a generic name of a main chain, a side chain, or a group) having the interface energy almost equal to the surface (interface) energy of the surface of the element (surface of base material) and the group having the interface energy differing from the surface (interface) energy of the surface of the element, attaching the polymer to the surface of the element by using the main skeleton, contained in the surface reform agent, having the interface energy almost equal to the interface energy of the surface of the element, and forming the polymer film (polymer cover), in which the group having the interface energy differing from the interface energy of the surface of the element, is oriented toward outside opposite to the surface of the element.

In other words in a different point of view concerning the polymer used as the above described surface reforming agent, it can be understood as that comprising the first group having a essentially different affinity from the group exposed to the surface of the element before surface reform and the second group having a substantially similar affinity to the group exposed to the surface of the element and contained in a repeated unit of the main skeleton.

Figure 17A:
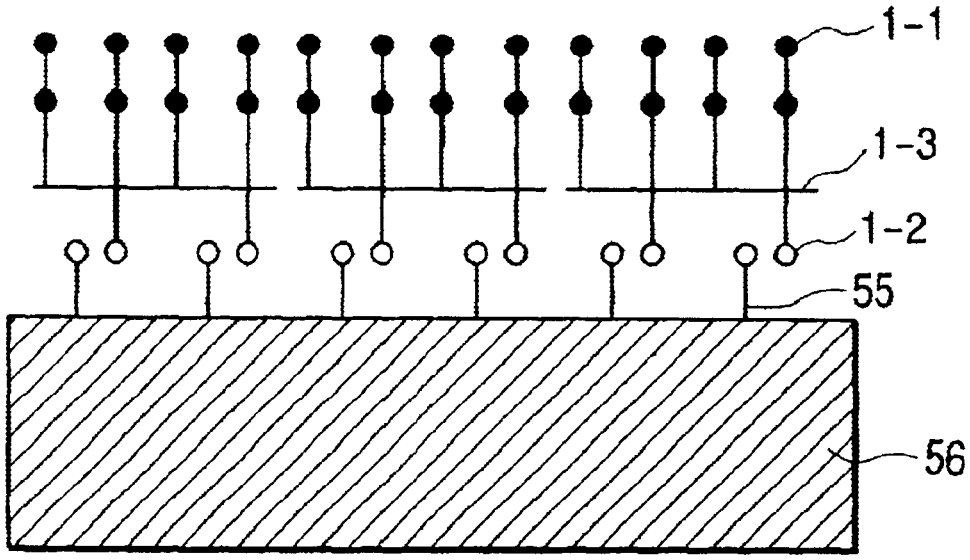
FIGS. 17A and 17B are figures diagrammatically showing an attaching form, which is made on a surface of an element (base material) to be reformed, of a polymer of a surface reforming agent to the element surface in a surface reforming method applicable to the present invention.
Figure 17B:
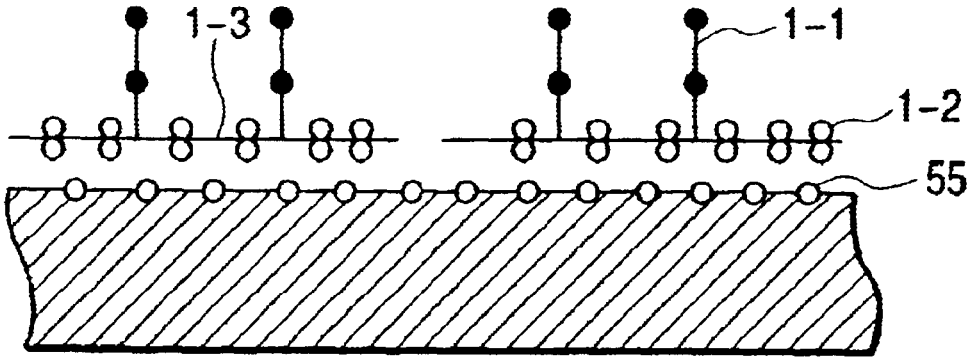

FIGS. 17A and 17B diagrammatically show a representative example of such orientation morphology. FIG. 17A shows the case using the polymer, in which the first group 1-1 and the second group 1-2 are bound as side chains and FIG. 17B shows the case in which the second group 1-2 composes a main chain 1-3 and the first group 1-1 composes a side chain.

When orienting as shown in FIGS. 17A and 17B, the superficial surface (outside) of the base material 56 constituting the surface to be subjected to the surface reform of the element become s a situation in which the group 1-1 having the different interface energy from the surface (interface) energy of the base material 56 is oriented to the surface and thus, a property of the group 1-1 having the different interface energy from the surface (interface) energy of the base material 56 is used for reform of the surface. Here, the surface (interface) energy of the base material 56 has been determined by the substance and the molecule, which constitute the surface and are derived from the group 55 exposed to the surface. In the example shown in FIGS. 17A and 17B, the first group 1-1 works as the functional group for surface reform. If the surface of the base material 56 is hydrophobic and the first group 1-1 is hydrophilic, hydrophilicity is imparted to the surface of the base material 56. If the first group 1-1 is hydrophilic and the group 55 of the base material 56 side is hydrophobic, when polysiloxane, for example, is used as described later, it is presumed that the situation shown in FIG. 37 exists on the surface of the base material 56. In this situation, by adjusting a balance of the hydrophilic group between the hydrophobic group on the surface of the base material 56 after reform, in the case where water and aqueous liquid mainly composed of water are passed through the base surface after reform treatment, passing condition and a passing flow rate can be regulated. By using the fibrous body, which is made of a polyolefin resin, for example, and has such surface condition on the external wall surface of the fiber, in the ink tank installed as a component, integrated with the ink jet recording head, or as a separate component, filling ink in the ink tank and supplying ink from the ink tank to the head are very easily carried out and also, by keeping an appropriate negative pressure inside the ink tank, a position of an ink interface (meniscus) can be better kept around a ejection orifice of the recording head immediately after ink ejection. By this, a component, of which static negative pressure is higher than a dynamic negative pressure, most suitable for a negative pressure-creating member to hold ink for ink supply to the ink jet recording head can be provided.

Figure 37:
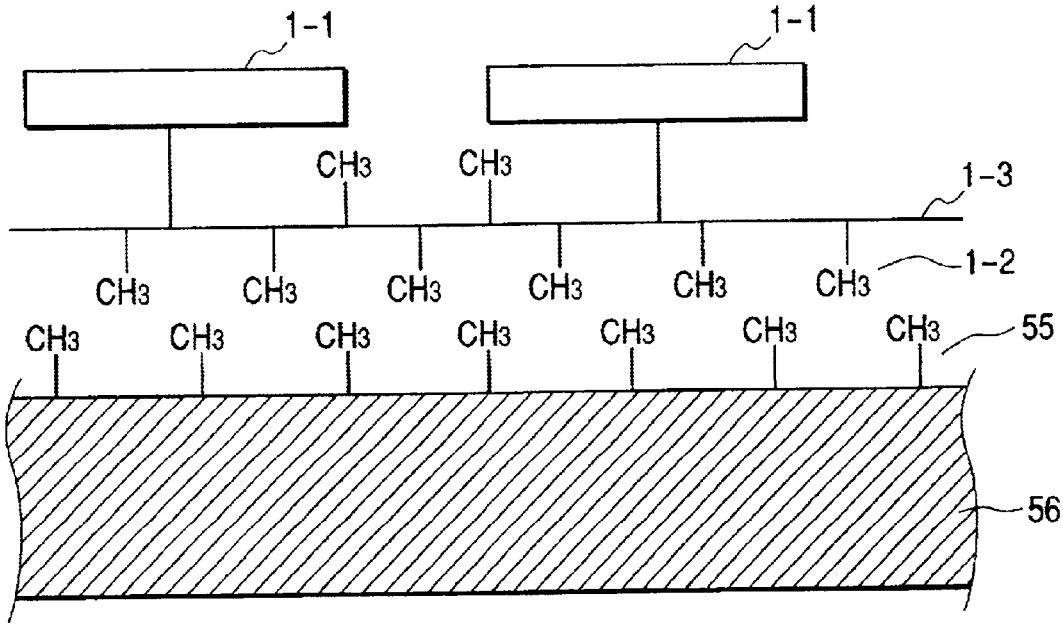
FIG. 37 is a figure diagrammatically showing an example of a presumable distribution of hydrophilic groups and hydrophobic groups the surface prepared by the deforming surface treatment applicable to the present invention.

Particularly, in case of a structure of the surface of the fiber of FIG. 37, the hydrophilic group 1-1 is a polymer group and hence, has a longer in a structure than that of a methyl group (hydrophobic group) of the side chain of the same side. Therefore, the hydrophilic group 1-1, when ink flows, tilts toward the flow rate, along with the surface of the fiber (and also, covers substantially the above described methyl group). As a result, the flow resistance greatly decreases. Oppositely, when ink supply is stopped and the meniscus is formed between fibrous bodies, the hydrophilic group 1-1 is oriented to a direction toward ink, in other words, a vertical direction against the surface of the fiber (the above described methyl group is exposed to the surface of the fiber) and thus, the balance can be kept between hydrophilic groups (large) and hydrophobic groups (small) in a molecule to create a sufficient negative pressure. Resembling to the above described embodiment in which the hydrophilic group 1-1 is formed by many (—C—O—C—) bonds and an OH group as a terminal group, many (at least a plurality of) hydrophilic group formed in the polymer and therefore, action of the above described hydrophilic group 1-1 is preferably ensured. In addition, in the case where hydrophobic group other than the above described methyl group is present in the polymer, it is preferable that the hydrophilic group is close to a polymer level to increase a range of existence of the hydrophilic group than the range of existence of the hydrophobic group. The balance to make a hydrophilic>hydrophobic relationship as described above may be accepted.

Meanwhile, the static negative pressure in the ink supply opening is expressed by the following equation.

Static negative pressure=(height from ink supply opening to ink interface)−(capillary force of fiber on ink interface)

This capillary force proportions to COSθ, if a contact angle, made by ink wetted with the fiber absorber, is assumed θ. Therefore, according to presence or absence of the hydrophilic treatment of the present invention, in ink showing a large change of the COSθ, it is made possible that the static negative pressure is kept to somewhat lower, namely, somewhat higher in terms of an absolute value.

Specifically, if the contact angle is 10° level, hydrophilic treatment increases about 2% in the maximum capillary force and if a combination, by which the fiber is difficult to be wetted by ink, such as the status of the contact angle 50° is lowered to 10° by hydrophilic treatment, the capillary force increases 50%. (COS0°/COS10°≅1.02 COS10°/COS50°≅1.5)

Here, concerning the specific method for manufacture of the element, which has a reformed surface shown in FIGS. 17A and 17B, the method by using an improver, which is a good solvent of the polymer used for surface reform and improves wettability of the treating agent to the base material, will be explained below. According to this method, after a treating liquid (surface reform solution), in which the polymer of the surface reform agent is evenly dissolved, is applied to the surface of the base material, the solvent contained in the treating liquid is removed and simultaneously, the polymer of the surface reform agent contained in this treating liquid is oriented as described above.

More specifically, in the solvent being a good solvent for the polymer and sufficiently wettable to the surface of the base material, a liquid (the surface treating liquid, preferably containing pure water in the case where the hydrophilic group is used as the functional group) is prepared by mixing the polymer of a predetermined quantity with a cleavage catalyst followed by application of the surface treating liquid to the surface of the base material, and evaporating and drying steps (for example, in a 60° C. oven) are installed to remove the solvent contained in the surface treating liquid.

What showing sufficient wettability to the surface of the base material and containing an organic solvent, the polymer as the surface reform agent is dissolved, in the solvent is more preferable in consideration of that even application of the polymer used for surface reform is made possible. In addition, the following is exemplified as an effect thereof: the polymer as the surface reform agent is evenly dispersed in a liquid layer, which is applied when an concentration increases according to evaporation of the solvent, to present an action for keeping the status of enough dissolution. Besides, enough wetting of the base material with the surface treating liquid allows spreading out evenly the polymer of the surface reform agent to the base material. As the result, The polymer can be evenly covered over the surface having an irregular shape.

The surface treating liquid has wettability with the surface of the base material and is a good solvent for the polymer as well as a volatile first solvent, which is the good solvent for the polymer, however, wettability thereof to the surface of the base material is relatively inferior to the first solvent. A second solvent, which shows a relatively lower volatility than the first solvent, can be employed in combination. As the example of such combination, the lately described combination of isopropyl alcohol with water is exemplified in the case where the surface of the base material consists of a polyolefin resin and polyoxyalkylene polydimethylsiloxane is used as the polymer.

Here, the effect caused by addition of an acid as the cleavage catalyst in the surface treating liquid is enumerated as follows. For example, when the concentration of an acid component rises according to evaporation of a material used in evaporating and drying steps of the surface treating liquid, the hot acid solution of the high concentration allows partial decomposition (cleavage) of the polymer used for surface reform and production of fragments of the polymer allows the orientation to a finer part of the surface of the base material. Further, in the final stage of evaporating and drying, through polymerization of the polymer of the surface reform agent by rebinding of cleaved parts of the polymer, the effect to enhance formation of the polymer film (polymer cover or preferably monomolecular film) is expected.

Furthermore, in evaporating and drying steps of the surface treating liquid, when the concentration of the acid component rises according to evaporation of the solvent rises, the acid of the high concentration removes impurities on the surface of and around the surface of the base material and thus, the effect to form a clean surface of the base material is expected. On such clean surface, it is expected to improve a physical attaching force of the base substance and molecules to the polymer of the surface reform agent.

In this example, in a part, the surface of the base material is decomposed by the hot acid of the high concentration, an activated point appears on the surface of the base material, and it is supposed that a secondary chemical reaction occurs to bind this activated point with fragments produced by cleavage of the above described polymer. In an occasion, it can be presumed that improvement of attaching and stabilization of the surface reform agent is partially appears on the base material by such secondary chemical adsorption of the surface reform agent with the base material.

Next, Cleavage of the main skeleton having surface energy almost equal to surface energy of the base material of the surface reform agent (including the surface treating liquid) and the polymer film-forming step based on condensation of fragments produced by cleavage on the surface of the base material are described concerning the case, where the functional group is the hydrophilic group and hydrophilicity is imparted to the surface of hydrophobic base material, as the example, with reference to FIG. 18 to FIG. 24. Here, the hydrophilic group is that having a structure capable of hydrophilicity as a whole of the group. Groups usable as the hydrophilic group are the hydrophilic group itself and those having a hydrophobic chain and the hydrophobic group but having a function as a group capable of imparting hydrophilicity to other structural part by substitution and locating the hydrophilic group.

Figure 18:
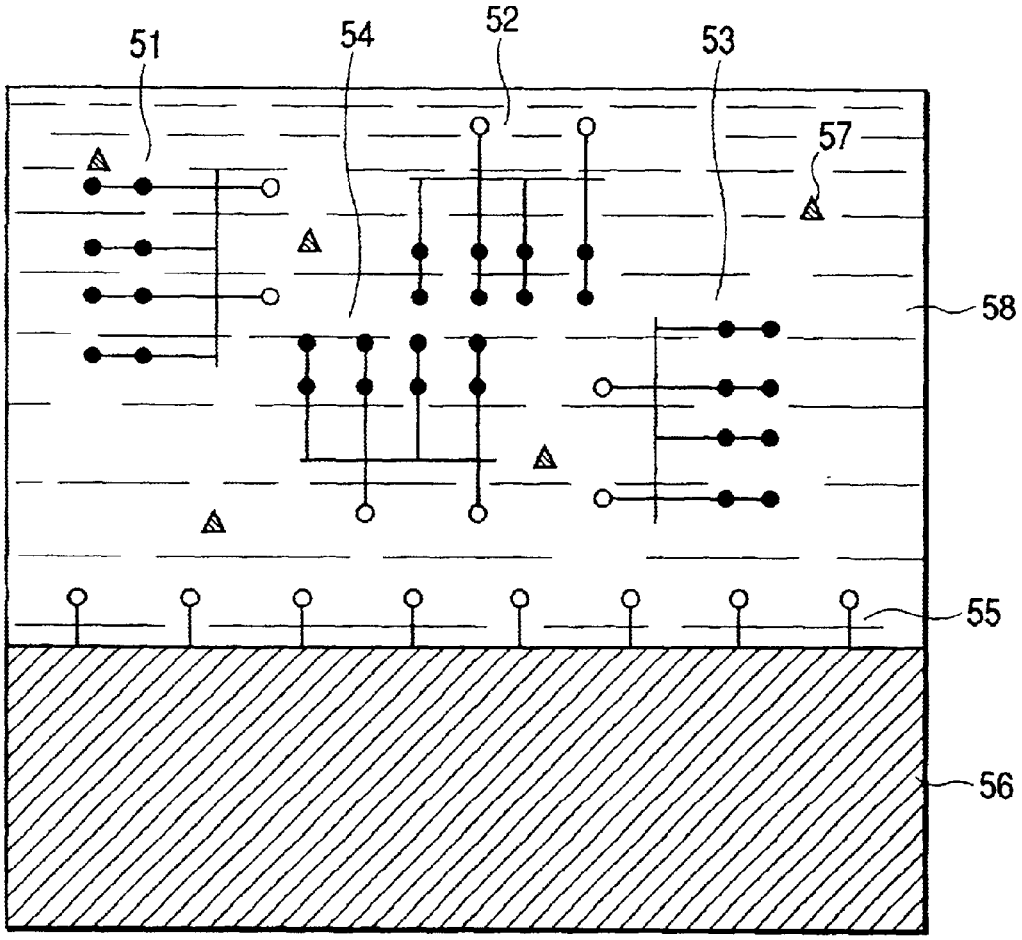
FIG. 18 is a figure diagrammatically showing a status in which a treating liquid, which contains the polymer of the surface reforming agent, is applied to form an applied layer on the base material according to the surface reforming method applicable to the present invention.
Figure 19:
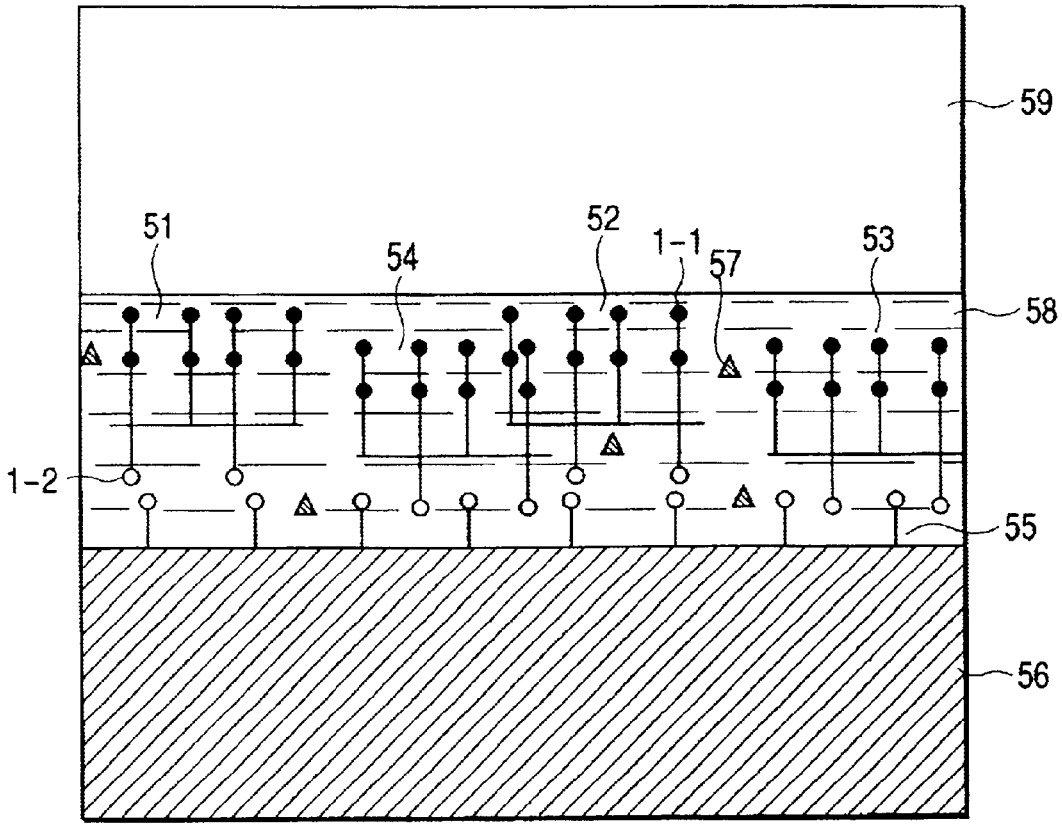
FIG. 19 is a conceptual rendering showing a process to remove partially a solvent contained in the applied layer containing the polymer of the surface reforming agent formed on the base material according to the surface reforming method applicable to the present invention.

FIG. 18 shows an enlarged view after application of the hydrophilic treatment liquid 58. At this point, the polymers 51 to 54 and the acid 57 being the hydrophilic treatment agent contained in the hydrophilic treatment liquid 58 are evenly dissolved in the hydrophilic treatment liquid on the surface of the base material 56. FIG. 19 shows the enlarged view of the drying step after application of the hydrophilic treatment liquid. In drying with heating in the drying step after application of the hydrophilic treatment liquid, the physical adsorbing force of the base substance 56 to the polymer 51 to 54 as the surface reform agent is improved by that the pure surface of the base material 56 is formed by such cleaning action of the surface of the base material 56 as that the increase in concentration of the acid component according to evaporation of the solvent removes impurities on the surface of and around the surface of the base material 56. On the other hand, in drying with heating in the drying step after application of the hydrophilic treatment liquid, there is a part, of the polymer 51 to 54 of the hydrophilic treatment agent, which is cleaved by the increase in concentration of the acid component according to evaporation of the solvent.

Figure 20:
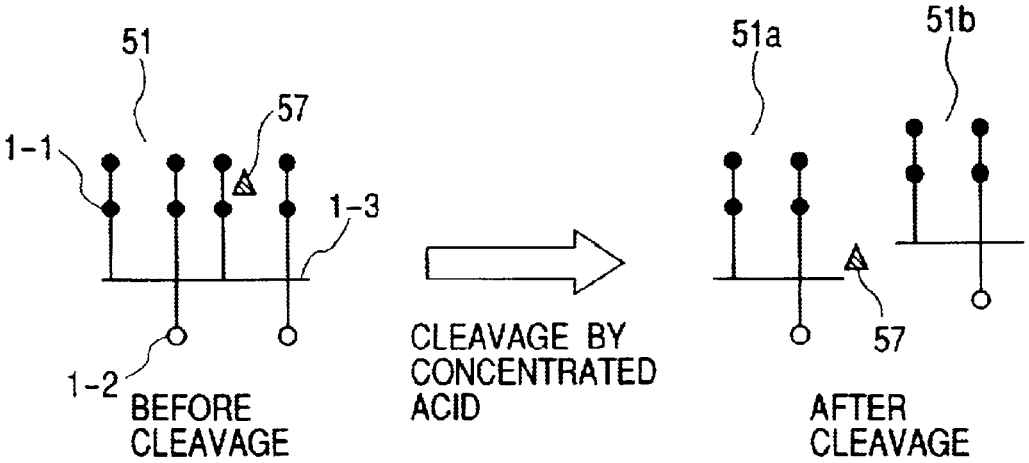
FIG. 20 is a diagrammatic figure showing a partial dissociation process, of the polymer of the surface reforming agent, included in a process to remove partially the solvent contained in the applied layer containing the polymer of the surface reforming agent and induced by an acid to be added to a treating solution.
Figure 21:
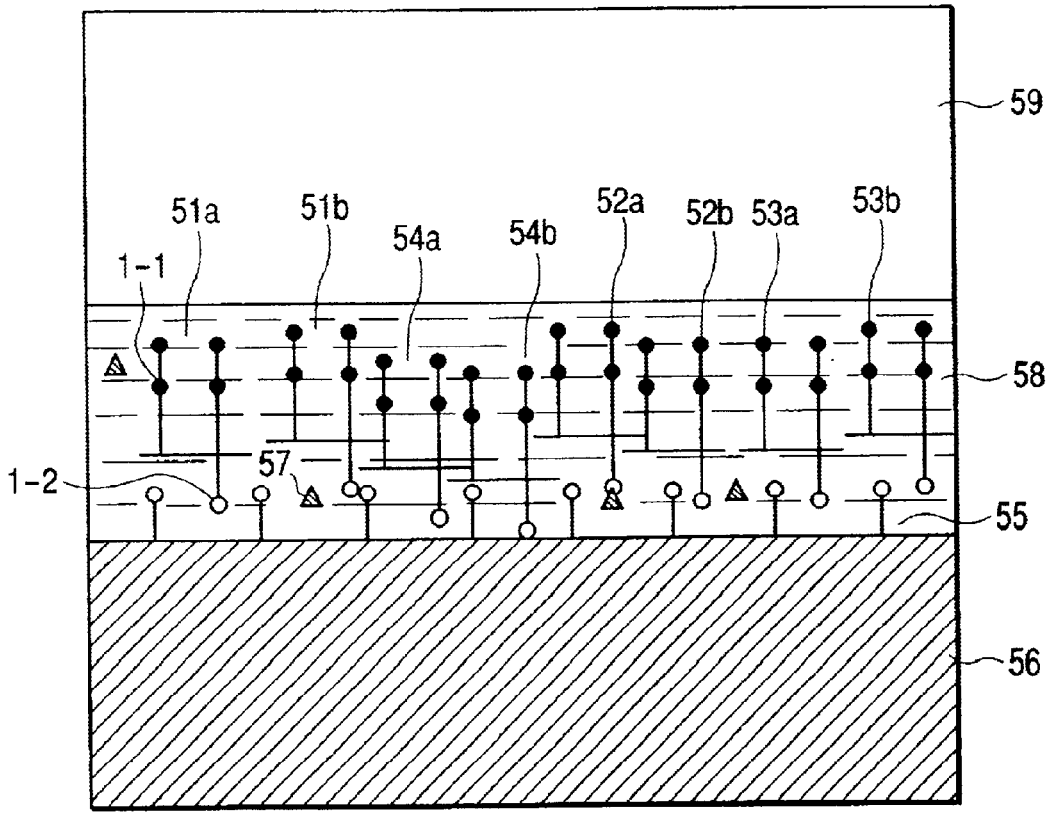
FIG. 21 is a diagrammatic figure showing a process, of the polymer of the surface reforming agent, included in a process to remove further the solvent contained in the applied layer containing the polymer of the surface reforming agent and forming an orientation of the polymer of the surface reforming agent or of fragments of the polymer thereof.

FIG. 20 shows a diagrammatic figure of decomposition of the polymer 51 by a concentrated acid 57. FIG. 21 shows an attitude of adsorption of the hydrophilic treatment agent, decomposed by such steps, to the base material. According to further progress of evaporation of the solvent, the main skeleton part having surface energy almost equal to surface energy of the base material of fragments 51*a* to 54*b* derived from the polymer, which constitutes the hydrophilic treatment agent reached dissolution saturation, adsorbs selectively to the surface of the pure base material 56 formed by cleaning. As the result, the group 1-1, which has surface energy different from surface energy of the base material 56 contained in the surface reform agent, is oriented to outside of the base material 56.

Figure 22:
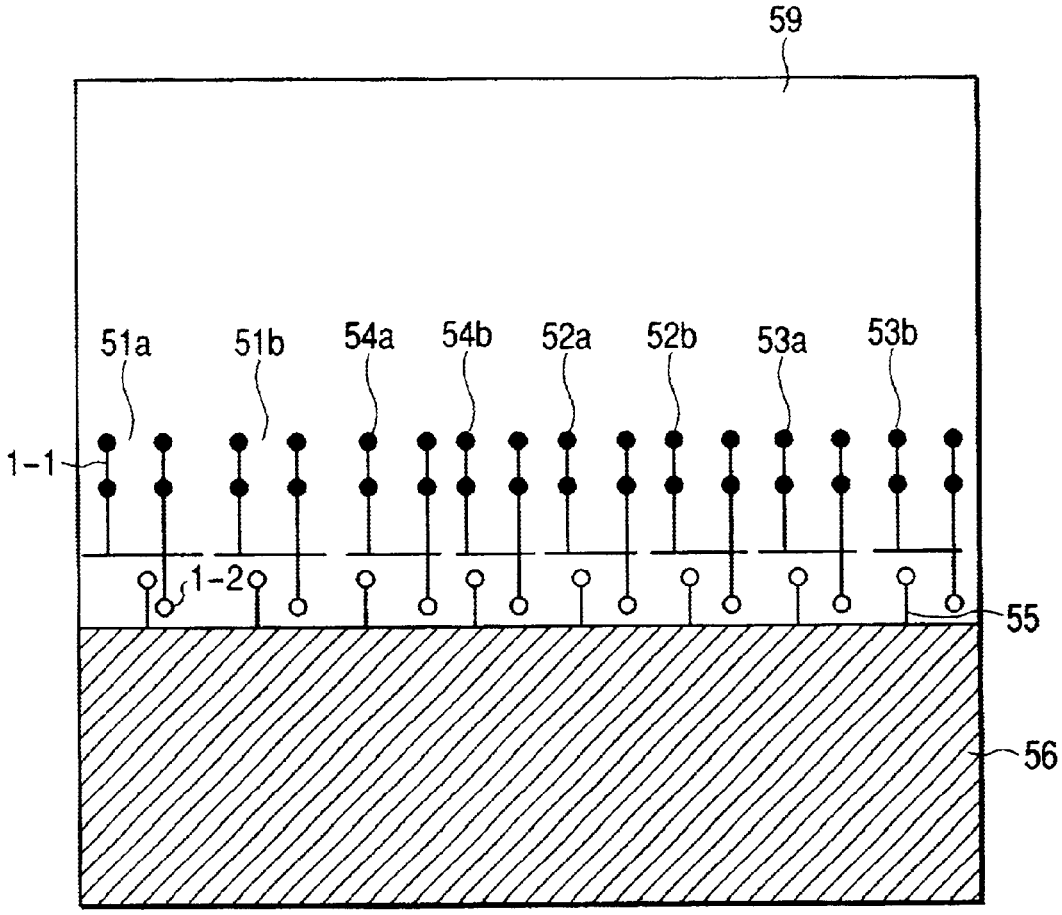
FIG. 22 is a diagrammatic figure showing a process, in which the solvent contained in the applied layer is dried to remove and the polymer of the surface reforming agent or fragments of the polymer thereof orient to attach to and be fixed to the surface.

Consequently, on the surface of the base material 56, the main skeleton part having surface energy almost equal to surface (interface) energy of this surface is oriented. The group 1-1 having surface energy different from surface energy of the base material 56 is oriented to outside opposite to the surface of the base material 56. In this condition, in the case where the group 1-1 is the hydrophilic group, hydrophilicity is imparted to the surface of the base material 56 resulting in the surface reformed. FIG. 22 shows the diagrammatic figure of the absorbing condition of the surface reform agent to the surface of the base material after application and drying of the hydrophilic treatment liquid.

Figure 23:
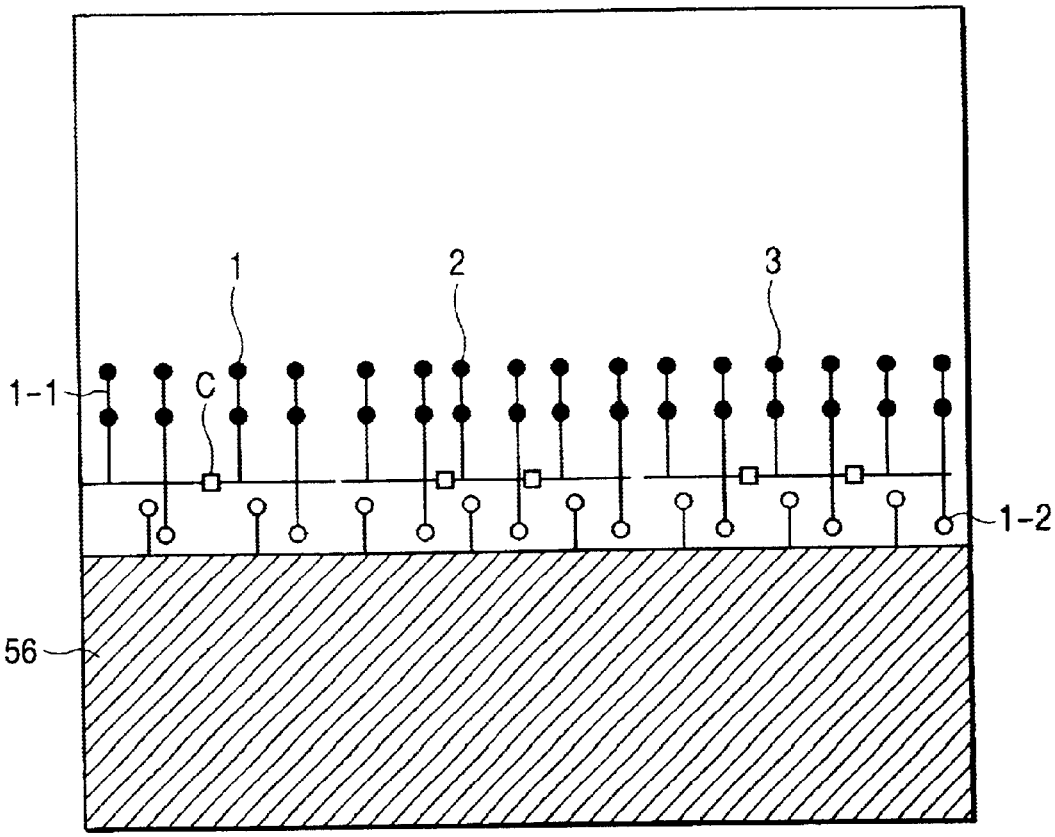
FIG. 23 is a diagrammatic figure showing a process, in which small molecules, which are produced by dissociation of the polymer of the surface reforming agent that attaches and is fixed to the surface, binds to each other again by a condensation reaction.

Use of such compound as polysiloxane as the polymer capable of binding with at least a part of fragments by condensation of fragments produced by cleavage creates a bond between fragments adsorbed to the surface of the base material 56 top become the polymer finally making the film of the surface reform agent stronger. FIG. 23 shows the diagrammatic figure of rebound C by such condensation reaction. In case of using polysiloxane, mechanisms of formation of fragments produced by cleavage and polymerization by condensation thereof are described below.

According to controlled drying of the surface treatment liquid in the surface to be treated, the concentration of a diluted acid contained in this surface treatment liquid increases and the concentrated acid (for example, $H_2SO_4$) cleaves siloxane bond of polysiloxane. As the result, fragments of polysiloxane and sililated sulfuric acid is produced (scheme 1). In accordance with further drying of the treating liquid presenting on the surface to be treated, the concentration of fragments contained in the surface treatment liquid increases to improve contact probability between fragments. As the result, as shown in the scheme 2, fragments are condensed to reproduce the siloxane bond. In sililated sulfuric acid as a secondary product, when the surface to be treated is hydrophobic, a methyl group of sililated sulfuric acid is oriented to the surface to be treated and a sulfonic group is oriented to the direction different from the surface to be treated, presumably resulting in some contributions to the hydrophilic property of the surface to be treated.

Scheme 1

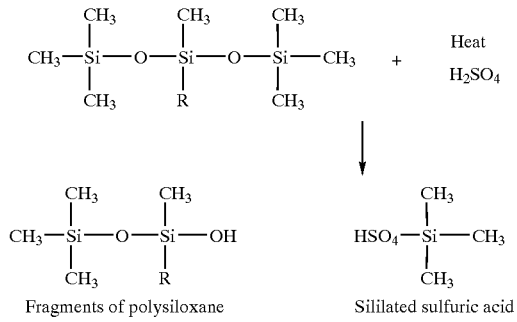

Scheme 2

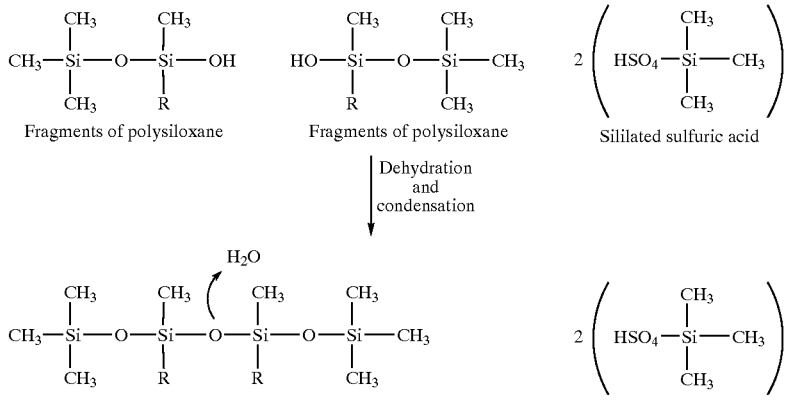

Figure 24:
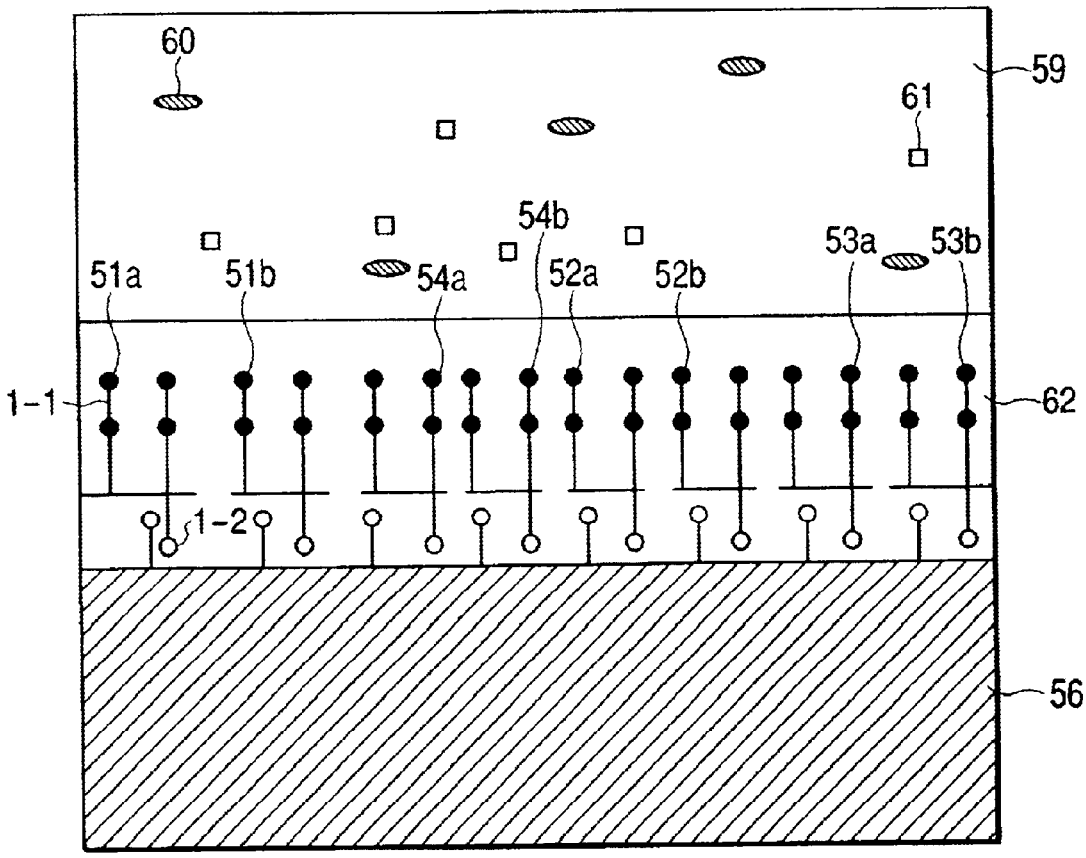
FIG. 24 is a diagrammatic figure showing a case where the surface reforming method applicable to the present invention is applied to hydrophilic treatment for a water repellent surface and an effect of addition of water to a treating solution.

FIG. 24 shows diagrammatically an example of the condition of the surface treatment liquid in the case using the surface treatment liquid having the composition of which solvent contains water. In the case where water is contained in the solvent of the treatment liquid, in evaporation of solvent from the treatment liquid for hydrophilic treatment with heating, water and a volatile organic solvent vaporize (a gas molecule of water and the gas molecule of organic solvent are represented by 61 and 60, respectively). Where, evaporating rate of volatile organic solvent is higher than that of water and therefore, water concentration of the treatment liquid gradually increases to rise a surface tension of the treatment liquid. As the result, the interface between the surface of the base material 56 to be treated and the treatment liquid presents a difference in surface energy. On the interface between the surface of the base material 56 to be treated and the treatment liquid (water-containing layer 62) in which concentration of water has increased by evaporation, the part having almost equal surface energy to that of the surface, to be treated, of the base material 56 in fragments 51*a* to 54*b*, which is derived from the polymer as the hydrophilic treatment agent, is oriented to the surface side, to be treated, of the base material 56. On the other hand, the part having the hydrophilic group of fragments derived from the polymer as the hydrophilic treatment agent is oriented to the water-containing layer 62 in which water concentration is increased by evaporation of the organic solvent. As the result, a predetermined orientation of fragments of the polymer is further improved.

The present invention relates to the fiber absorber for ink jet to hold ink by the negative pressure provides hydrophilic treatment to the surface of the fiber comprising the fiber absorber. According to surface reform, applicable to the present invention, for the above described element, an object of surface reform is not restricted to the fiber. Various elements and uses can be enumerated according to characteristics and kinds of the functional group, which the polymer has. The following is explanation of some examples thereof.

(1) The case where the functional group is the hydrophilic group

The element is that, such as the ink absorber used for the ink jet system, requiring absorbency (when the olefin fibers are contained, the above described embodiment is applicable). Hydrophilicity capable of absorbing a liquid (aqueous ink explained in the above described embodiments) instantaneously can be imparted by surface reform of the present invention. It is also effective in case of need of liquid holdability.

(2) The case where the functional group is lipophilic group

According to surface reform applied to the present invention, a function can be effectively imparted to the element necessary of lipophilicity.

(3) Other application of surface reform is all those which is capable of achievement using mechanisms of the above described principle and based on the present principle.

When a wettability-improving agent (for example, isopropyl alcohol: IPA) that can improve wettability to a surface of an element and wettability to be a medium for polymer; a medium allowing cleavage of polymer to occur; and a polymer that contains any of the above described functional groups and a group (or groups) having an interface energy differing from the interface energy of the functional group and almost equal to a partial surface energy of the surface of the element are used as a treatment agent, surface reform by condensation after cleavage expresses especially excellent effect to impart surely evenness and a characteristic which are not yielded by a conventional treatment agent.

In the present specification, such property excellent for wetting with liquid contained is named "lyophilic nature."

As a complementary concept of the present invention, there is the case where a neutralizer (calcium stearate and hydrotalcite) used for molding or forming the fiber and other additives are contained in the fiber. By applying the above described surface reforming method, degree of both of dissolution in ink and deposition by ink can be reduced. In the case where the polymer film according to the present invention is formed, these problems can be solved. Therefore, according to the above described surface reforming method, a range of use of additives such as the neutralizer can be expanded and a change of characteristic of ink itself can be prevented and further, the change of characteristic of ink jet head itself can be prevented.

Figure 36:
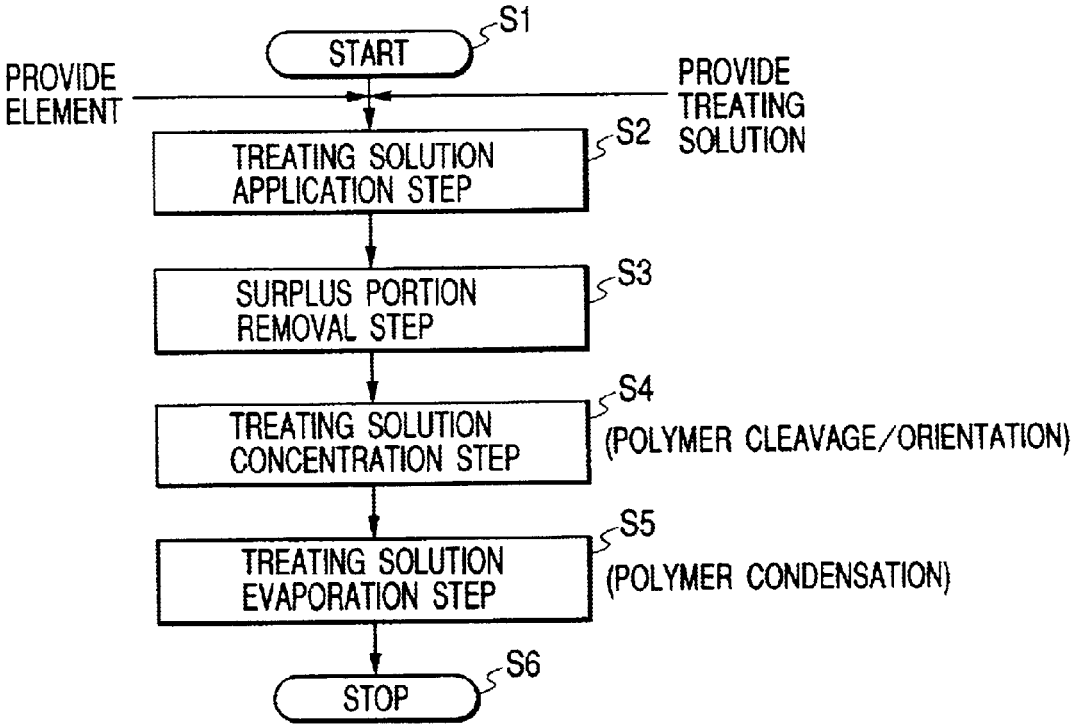
FIG. 36 is a process chart showing an example of a manufacturing process, through the deforming surface treatment, applicable to the present invention.

FIG. 36 shows an example of process chart of manufacture of these various elements. At start of manufacture (S1), the element and the treatment liquid are supplied and subsequently, through step of applying the treatment liquid to the surface (surface to be reformed) of the element to reform (S2), the step of removing excess matter from the surface to be reformed (S3), steps of concentration and evaporation of the treatment liquid for cleavage of the polymer and orientation of fragments on the surface to be reformed (S4), and the step of condensation of the polymer for polymerization by binding between fragments (S5), the element having the surface reformed is yielded (S6).

The step of concentration of the treatment liquid and the step of evaporation of the treatment liquid can be preferably carried out a continuous heating and drying steps under a temperature (for example, 60° C.) lower that a boiling point of the solvent at the temperature higher than a room temperature, and in the case where polysiloxane is used in water, acid, and organic solvent (for example, isopropyl alcohol) having the hydrophilic group for reforming the surface, which consists of a polyolefin resin, be carried out for about 45 minutes to two hours, for example. These steps are carried out for about two hours, for example, in use of the aqueous solution of 40 wt % isopropyl alcohol. If water content is reduced, the drying process time can be shortened. Reduction of water content can shorten the drying process time.

In the example presented in FIG. 36, fragments are formed on the face of the element to be reformed by cleavage of the polymer. However, the treatment liquid already contained fragments can be supplied to a top of the face of the element to be reformed in order to orient it.

The composition of the treatment liquid can be, as described above, used based on a constitution comprising a wettability-improving agent, which, for example, has wettability to the face to be reformed for improving wettability of the treatment liquid to the face to be reformed and is the good solvent for the polymer being an effective component of the surface reform agent, solvent, polymer cleavage catalysts, the functional group to impart the reform effect to the face to be reformed, and the polymer having groups to yield the attaching function to the face to be reformed.

EXAMPLE 1 OF APPLICATION OF THE PRINCIPLE

Figure 25A:
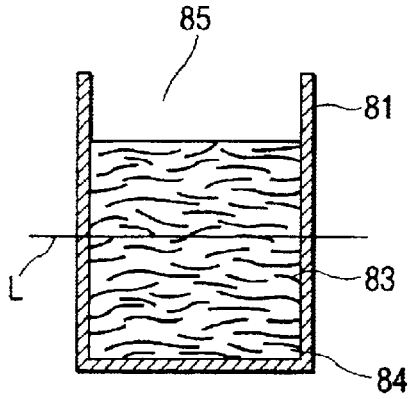
FIGS. 25A, 25B, 25C and 25D are diagrammatic figures showing a PE-PP fibrous body usable for an ink absorber in an ink tank.

Next, the following is the example of application of the principle for the above described surface hydrophilic treatment to a polypropylene-polyethylene fibrous body. Actual polypropylene-polyethylene fibrous body, for example, is that prepared in a block shape composed of the fiber having a shape usable as the ink absorber used for the purpose, in which liquid such as water is impregnated to keep ink. For example, as shown in FIG. 25A, the fibrous body 83 functioning as an absorbing holder 84 for various liquids such as ink is contained in the container 81 with the suitable shape having an opening 85 opened to atmosphere in a predetermined orientation in order to use as a liquid holding container. Such ink absorber can be preferably used in an ink tank used for the ink jet recording apparatus. Particularly, as mentioned later using FIGS. 27A to 27F and FIGS. 28A to 28F, in the case where the fibrous absorber 84, which is subjected to a treatment in which an excess treatment solution 86 is squeezed from spaces of fibers by strongly pressurizing the fibrous absorber 84 in which the hydrophilic treatment solution 86 is impregnated followed by drying, is contained in the tank, it is preferable that a squeezing direction of the treatment solution coincides with an compressing direction of the fibrous absorber in inserting into the tank. In other words, when the fibrous absorber compressed in squeezing work of treatment solution recovers as described above, for example, even if the hydrophilic treatment agent 86B has not attached firmly to a branching point of the fiber, the defect can be canceled in inserting the fibrous absorber into the tank.

The fiber 83A is specifically constituted from a biaxial fibrous body made of polypropylene and polyethylene. Individual fibers measure about 60 mm length. The biaxial fibrous body, of which sectional shape is exemplified in FIG. 26A, has almost circular (closed annular) external shape (outer circumferential shape) of a section in a direction vertical to an axis and also has the core member 83*b* made of the polypropylene fiber having relatively high melting point to make the sheath member 83*a* by covering circumference thereof with polyethylene with a relatively low melting point. After fibers of the fiber block made of short fibers having such sectional structure, is orientated in a same direction by using a carding machine, heated to cause fusion of fibers. Specifically, heating is carried out under a temperature higher than the melting point of polyethylene of the sheath member and lower than the melting point of polypropylene of the core member to make a structural body in which polyethylene of the sheath member located in a position, in which fibers contact each other, is fused each other.

Figure 25B:
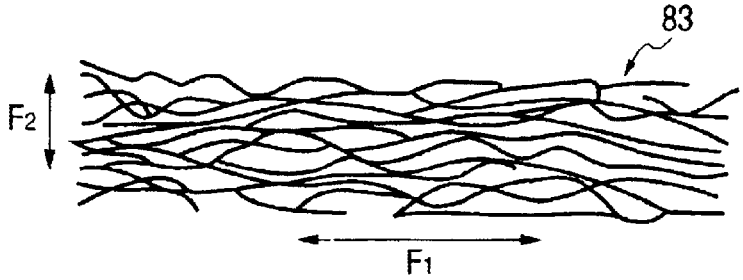
Figure 25C:
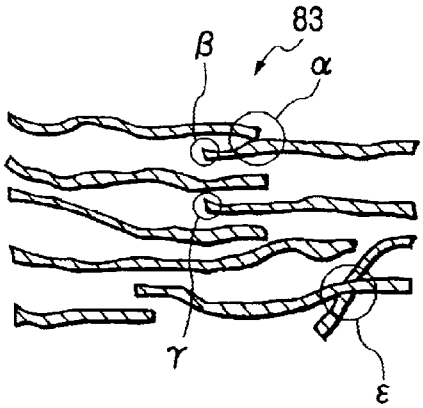
Figure 25D:
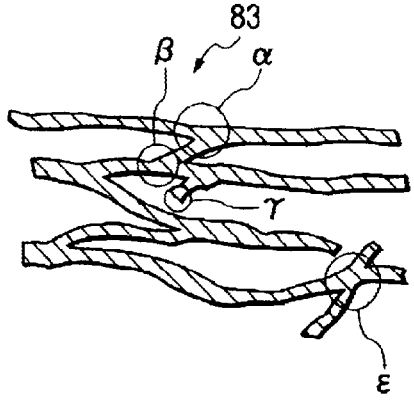

In the above described fibrous structural body 83, as shown in FIG. 25C, the orientation of fibers is arranged in the same direction by using the carding machine and thus, fibers are mainly arranged in a length direction (F1) continuously and fibers 83 partially contact with each other. By heating, in this contact point (point of intersection), mutual contact occurs to form a network structure resulting in having a mechanical elasticity in the orthogonal direction (F2). According to this, a tensile strength to the length direction (F1) shown in FIG. 25B increases. On the contrary, the orthogonal direction (F2) has an inferior tensile strength and the elastic structure having a recovery force against squeezing deformation.

Figure 26A:
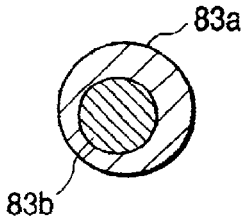
FIGS. 26A and 26B are examples of the sectional structure of the PE-PP fibrous body shown in FIGS. 25A and 25B are figures diagrammatically showing the example in which a PE sheath material covers almost concentrically over the PP core material and the example in which the PE sheath material covers eccentrically over the PP core material, respectively.

When this fibrous structural body 83 is detailedly analyzed, as shown in FIG. 25C, individual fibers are crimped. According to crimping, a complicated network structure is formed between adjacent fibers to cause fusion. A part of crimped fibers directs to the orthogonal direction (F2) to complete a three-dimensional fusion. Fibrous structural body 83 actually used in the present example is formed in a sliver by using a tow of the biaxial fibers in which polyethylene with the melting point of 132° C. almost concentrically, as shown in FIG. 26A, covered the polypropylene fiber of the core member with the melting point of 180° C. In the fiber structural body used, the main fiber direction (F1), in which fibers are oriented and hence, if liquid is soaked, internal fluidity and an attitude of holding in a static condition are clearly differ between the fiber direction (F1) and the intersectional direction (F2).

In the fibrous absorber used in the embodiment described below, the main the fiber direction (F1) is arranged to become substantially vertical to the perpendicular direction. Therefore, a gas-liquid interface (interface between ink and gas) in the fibrous absorber 83 becomes substantially parallel to the direction of the main fiber direction F1. In the case where a change is caused by an environment change, the gas-liquid interface keeps almost horizontal direction (the direction substantially horizontal to the perpendicular direction) and therefore, after the change of environment finishes, the gas-liquid interface moves back to the original position. Consequently, variation of the gas-liquid interface to the perpendicular direction does not increase according to a cycle number of the change of environment. Through the main fiber direction of the fibrous absorber is determined by such manner, variation of the gas-liquid interface to the gravity direction can be prevented.

Here, if tilting to the perpendicular direction even if it is somewhat scale, the orientation direction of the fiber expresses theoretically the above described effect even if it is somewhat scale. However, in practice, in the case where it ranges approximately ±30° to a horizontal plane, obvious effect was observed. Therefore, the expression "substantially vertical to the perpendicular direction" or "almost horizontal" must include the above described slope in the present specification.

In this example, the shape of the objective element is the fibrouus structural body and has a higher liquid holding performance that the element having a plane surface and thus, the treating liquid solution is made with the following composition.

TABLE 1

| Constituent | Composition (wt %) |
|---|---|
| (polyoxyalkylene)-poly(dimethylsiloxane) | 0.40 |
| Sulfuric acid | 0.05 |
| Isopropyl alcohol | 99.55 |

(1) Hydrophilic treatment method for PP-PE fibrous absorber

Figure 27A:
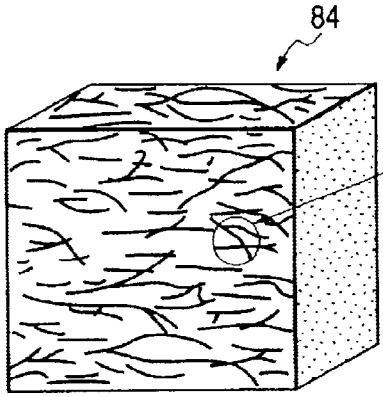
FIGS. 27A, 27B, 27C, 27D, 27E and 27F show diagrammatic figures showing a case where the surface reforming method according to the present invention is applied to hydrophilic treatment for the water repellent surface of the PE-PP fibrous body shown in FIGS. 27A, 27B, and 27C diagrammatically show an untreated fibrous body, the process to soak the fibrous body in hydrophilic treatment solution, and the process to compress the fibrous body to remove an excessive treatment solution after soaking, respectively.
Figure 27D:
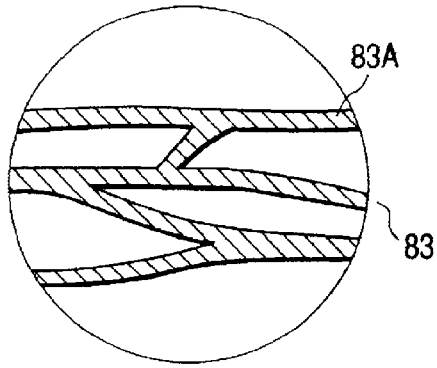
Figure 27B:
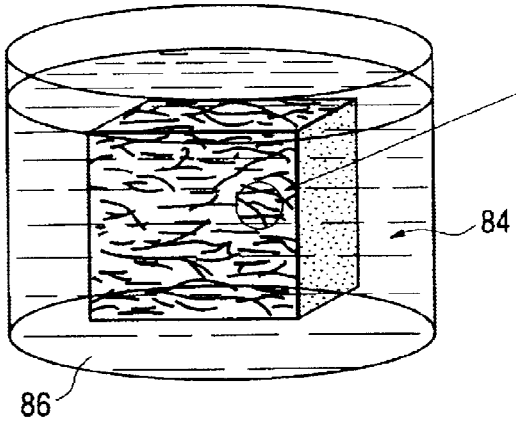

Polypropylene-polyethylene fibrous absorber with the structure shown in FIG. 27A was soaked in the hydrophilic treatment liquid of the above described composition (FIG. 27B). Here, the treatment liquid is held in the space in the fibrous absorber. Subsequently, the fibrous absorber is squeezed (FIG. 27C) to remove excess treatment solution held in the space of the fiber 83. The fiber absorber 83 removed from a fixing jig such as a wire net recovers the original shape (FIG. 28A) to make the surface of the fiber apply with a liquid layer 86A. The fiber, of which surface has been wetted with the liquid, was dried for 1 hour in a 60° C. oven (FIG. 28B).

COMPARATIVE EXAMPLE 1 AND REFERENCE EXAMPLE 1

In addition, as a comparative example 1, the same operation as the method described in FIGS. 27A to 27F and FIGS. 28A to 28F was carried out also for liquid, which was prepared in the above described fibrous body hydrophilic treatment liquid 86, containing only sulfuric acid and isopropyl alcohol. In other words, the liquid prepared by removing (polyoxyalkylene)-poly(dimethylsiloxane) from the treatment liquid shown in the Table 1. As a reference example, the PP-PE fibrous absorber untreated was used.

Figure 27E:
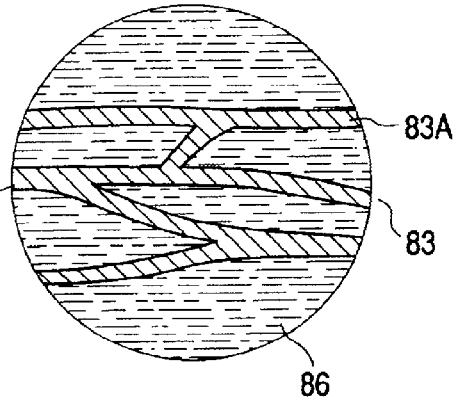
Figure 27C:
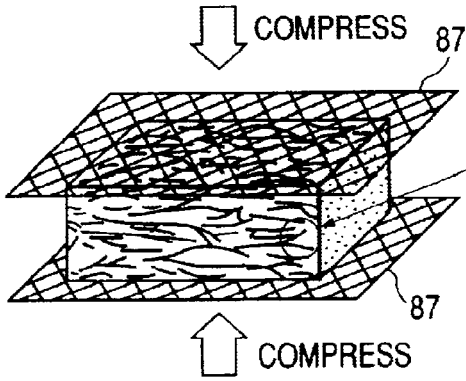
Figure 27F:
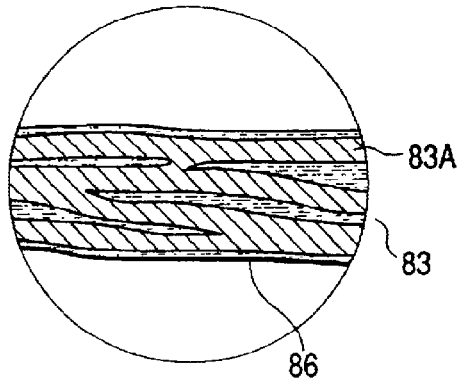
Figure 28A:
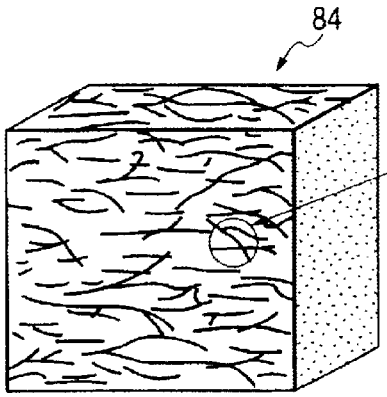
FIGS. 28A, 28B, 28C, 28D, 28E and 28F shows the process following to the process shown in FIGS. 28A, 28B and 28C diagrammatically show the applied layer formed on the surface of the fibrous body, the process to remove by drying the solvent contained in the applied layer, and a cover of hydrophilic treatment agent covering over the surface of the fiber, respectively.
Figure 28D:
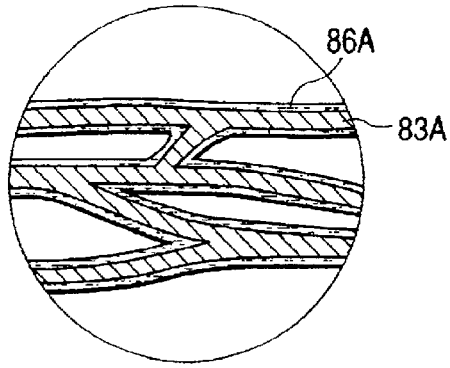
Figure 28B:
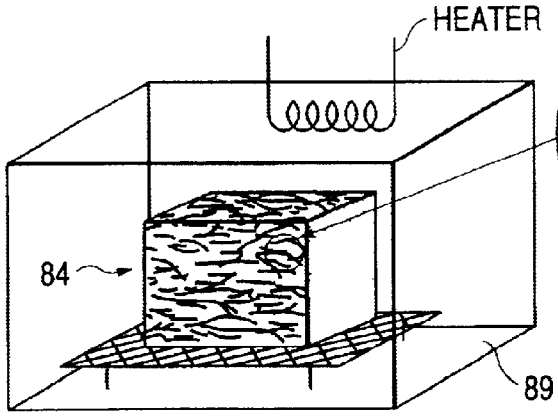
Figure 28E:
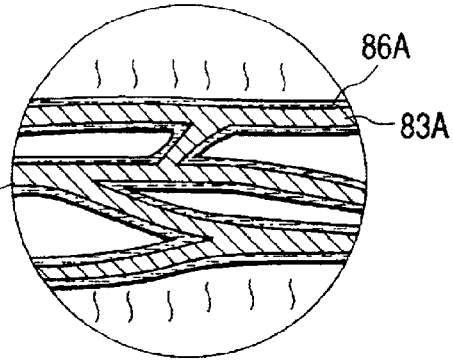
Figure 28C:
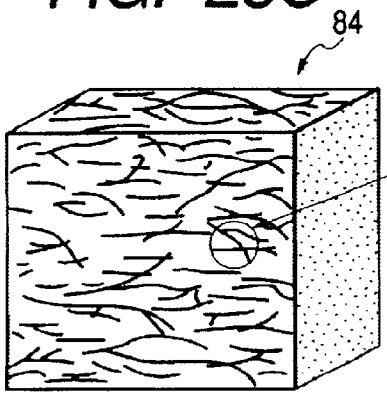
Figure 28F:
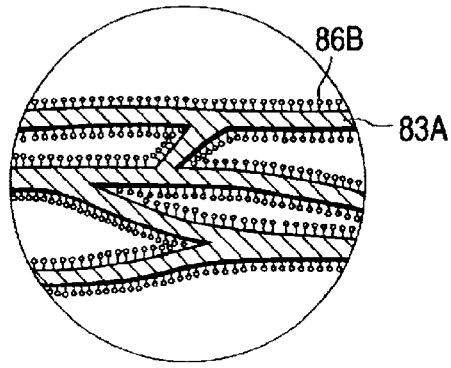

FIGS. 27D to 27F are partially enlarged figures of FIGS. 27A to 27C, respectively and FIGS. 28D to 28F are partially enlarged figures of FIGS. 28A to 28C, respectively.

In contrast to a weight 0.5 g of the PP-PE fibrous absorber used in the above described example 1 to which the principle was applied, the hydrophilic treatment liquid to be applied to the hole of the fibrous absorber by the above described application method is 0.3 to 0.5 g. Also in the comparative example 1, a quantity of liquid applied is the same as the example 1 to which the principle was applied.

The followings are evaluation and the results thereof about the condition of the surface treated in various fibrous absorbers obtained by the above described operation.

(1) Hydrophilicity evaluation method for the PP-PE fibrous absorber

A) Evaluation by dropping pure water using a dropping pipette

For the PP-PE fibrous absorber subjected to the treatment of the example 1 to which the principle was applied, the PP-PE fibrous absorber of the comparative example 1, and the untreated PP-PE fibrous absorber of the reference example, in dropping pure water from a top part using the dropping pipette, respectively, impregnating performance of pure water was observed.

B) Evaluation of pure water impregnation

A container with a size, in which the PP-PE fibrous absorber can be completely put, was filled with pure water. In this container, the PP-PE fibrous absorber treated by the example 1 to which the principle was applied, the PP-PE fibrous absorber of the comparative example 1, and the untreated PP-PE fibrous absorber of the reference example were mildly put observing impregnating status of pure water into respective PP-PE fibrous absorbers.

(2) The result of hydrophilicity evaluation for the PP-PE fibrous absorber

A) The result of the evaluation by dropping pure water using a dropping pipette

In the PP-PE fibrous absorber treated by the example 1 to which the principle was applied, in dropping pure water from a top part using the dropping pipette, pure water impregnated instantaneously into the inside of the fibrous absorber.

On the other hand, in the PP-PE fibrous absorber of the comparative example 1, and the untreated PP-PE fibrous absorber of the reference example 1, though pure water was dropped from a top part using the dropping pipette, pure water did never impregnate into the fibrous absorber and formed a drop with a spherical shape put on the surface of the PP-PE fibrous absorber.

B) The result of the evaluation of pure water impregnation

When the PP-PE fibrous absorber treated by the example 1 to which the principle was mildly put in the container filled with pure water, the PP-PE fibrous absorber gradually fell in water. From these experiments, it is at least concluded that the surface of the PP-PE fibrous absorber treated by the example described using FIGS. 27A to 27F and FIGS. 28A to 28F has hydrophilicity.

On the other hand, the PP-PE fibrous absorber of the comparative example 1 and the untreated PP-PE fibrous absorber of the reference example 1 were mildly put in the container filled with pure water, the PP-PE fibrous absorber of the comparative example 1 and the untreated PP-PE fibrous absorber showed a completely floating situation on pure water. Subsequently, no observation of absorbing water was made but evidently showed water repellency.

From the above described results, it is concluded that also for the PP-PE fibrous absorber, by applying the treatment liquid consisting of polyalkylsiloxane having a polyoxyalkylene oxide chain, acid, and alcohol followed by drying, a polyalkylsiloxane cover is formed as shown in FIG. 28C to allow effective surface hydrophilic treatment. As the result, it has been known that the PP-PE fibrous absorber subjected to the above described treatment can satisfactorily have the function of the ink absorber also for aqueous ink.

The above described result, in other words, in surface reform applied to the present invention, for the purpose to obtain proof of formation of a polymer cover by attaching of polyalkylsiloxane having the polyoxyalkylene oxide chain on the surface of the PP-PE fiber, the observation by SEM photography of the surface of the fiber was carried out.

Figure 29:
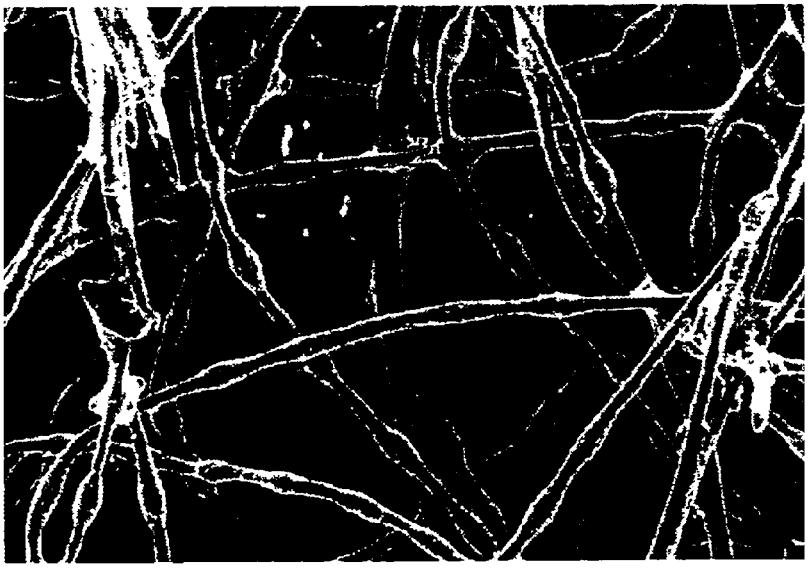
FIG. 29 shows a 150 times enlarged SEM photograph, replacing to a drawing, indicating a shape and the surface condition of an untreated PP-PE fiber of a reference example 1 (untreated PP-PE fiber absorber)
Figure 30:
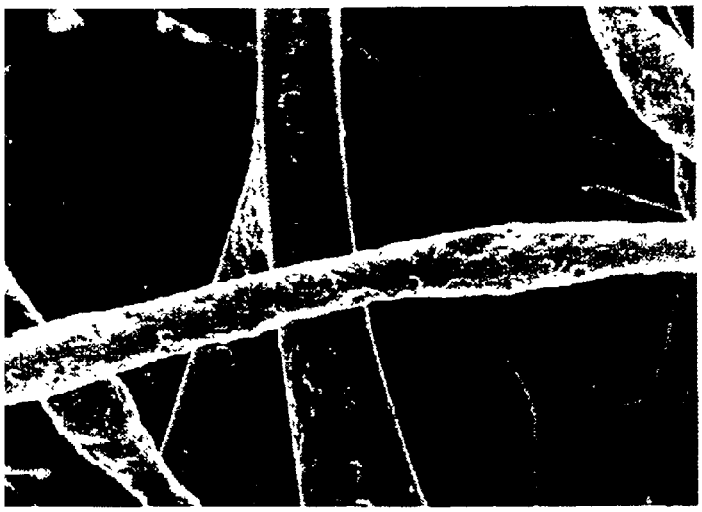
FIG. 30 shows a 500 times enlarged SEM photograph, replacing to a drawing, indicating a shape and the surface condition of an untreated PP-PE fiber of a reference example 1 (untreated PP-PE fiber absorber)
Figure 31:
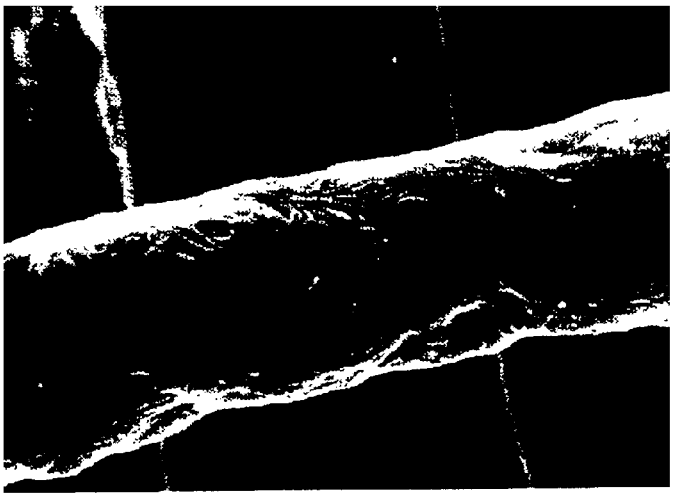
FIG. 31 shows a 2000 times enlarged SEM photograph, replacing to a drawing, indicating a shape and the surface condition of an untreated PP-PE fiber of a reference example 1 (untreated PP-PE fiber absorber)
Figure 32:
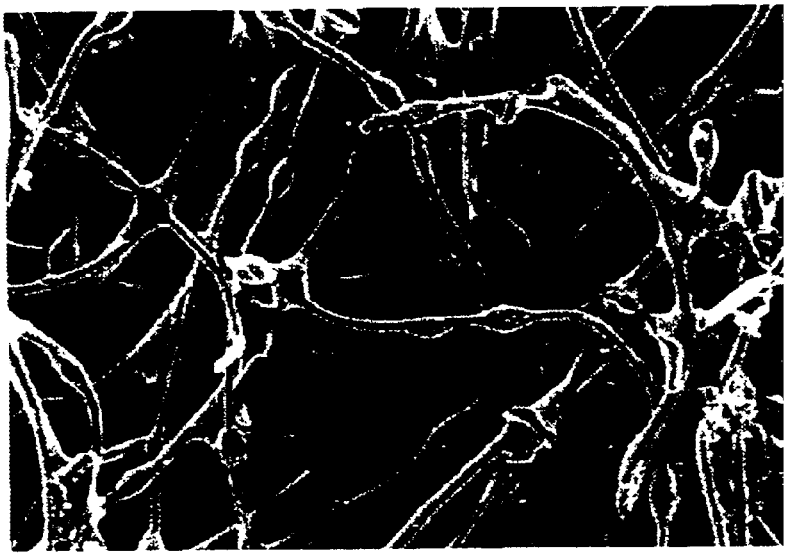
FIG. 32 shows the 150-times enlarged SEM photograph indicating a shape and the surface condition of an acid-treated PP-PE fiber of a comparative example 1 (PP-PE fiber absorber treated by an acid and an alcohol only)

FIG. 29, FIG. 30, and FIG. 31 show enlarged SEM photographs of the surface of the untreated PP-PE fiber of the reference example 1 (the untreated PP-PE fibrous absorber). FIG. 32 shows the enlarged SEM photograph of the surface of an acid-treated PP-PE fiber of the comparative example 4 (the PP-PE fibrous absorber treated with acid and alcohol only).

Figure 33:
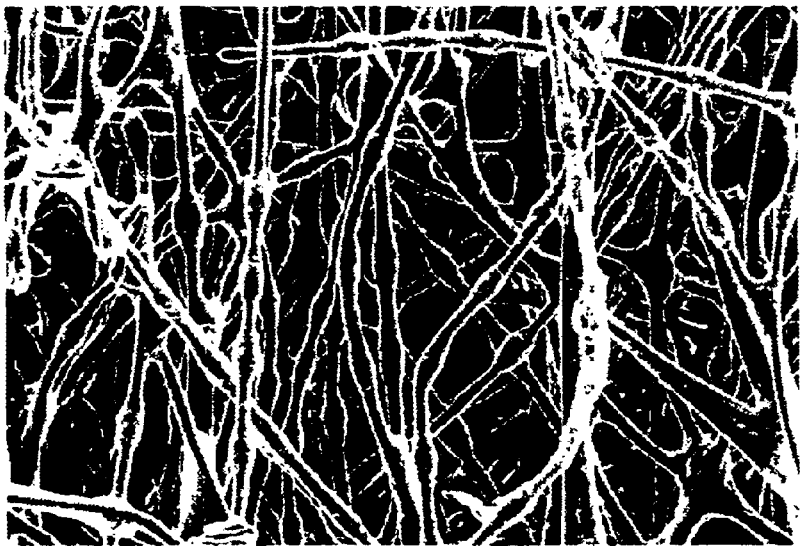
FIG. 33 shows a 150 times enlarged SEM photograph, replacing to a drawing, indicating a shape and the surface condition of a treated PP-PE fiber of an example 1 (hydrophilically treated PP-PE fiber absorber) to which the principle was applied.
Figure 34:
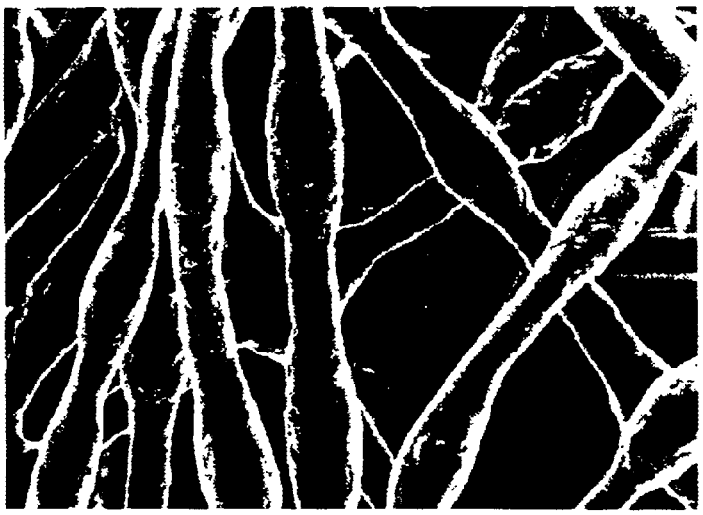
FIG. 34 shows a 500 times enlarged SEM photograph, replacing to a drawing, indicating a shape and the surface condition of a treated PP-PE fiber of an example 1 (hydrophilically treated PP-PE fiber absorber) to which the principle was applied.
Figure 35:
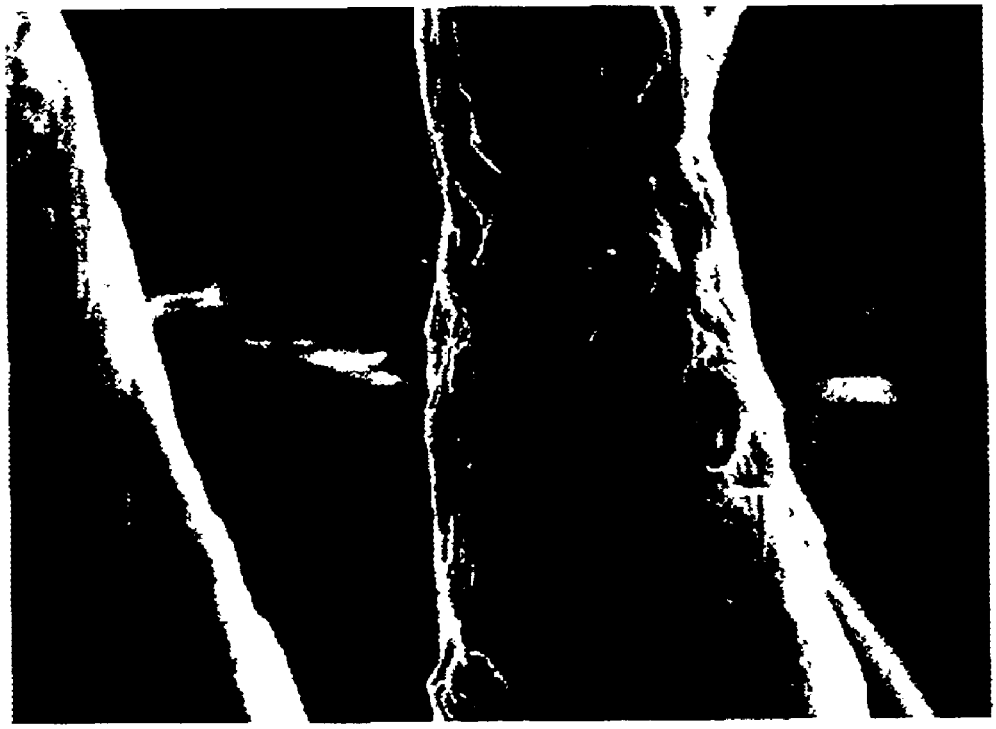
FIG. 35 shows a 2000 times enlarged SEM photograph, replacing to a drawing, indicating a shape and the surface condition of a treated PP-PE fiber of an example 1 (hydrophilically treated PP-PE fiber absorber) to which the principle was applied.

FIG. 33, FIG. 34, and FIG. 35 show enlarged SEM photographs of the surface of the treated PP-PE fiber of examples (the PP-PE fibrous absorber hydrophilically treated) described using FIGS. 27A to 27F and FIGS. 28A to 28F.

First, in all these enlarged SEM photographs of the surface of the PP-PE fiber, an evident structural change, which is caused by attaching of an organic matter, is not found on the surface of the fiber. In fact, the detailed comparison of 2000 times enlarged photographs of the untreated PP-PE fiber of FIG. 31 with those of the PP-PE fiber hydrophilically treated of FIG. 35 shows no difference between SEM observations of the surfaces of the untreated PP-PE fiber and the PP-PE fiber hydrophilically treated. Therefore, in the PP-PE fiber hydrophilically treated, (polyoxyalkylene)-poly(dimehtylsiloxane) attaches to the surface of the fiber in evenly thin film form (seemingly monomolecular film) and hence, morphologically, does not allow discrimination from the original surface of the fiber. Therefore, It is concluded that no difference is found from the SEM observation.

On the other hand, according to viewing the SEM photograph of the PP-PE fiber, of FIG. 32, treated with acid and alcohol only, break of the point of intersection (fusion point) of fibers frequently occurs and many node-like structure is found in fibers. This change indicates the result of induction and enhancement of deterioration of PE-PP molecules of the surface of the fiber, particularly the PE of a superficial layer, caused by the acid of the high concentration caused by evaporation of solvent in the heating and drying steps and heat of the drying step itself.

On the other hand, though the hydrophilic treatment solution also contains the acid of the same concentration and same heating and drying are carried out, break of fiber connecting part and the node in the fiber, which are observed in the acid-treated PP-PE fiber treated with acid and alcohol only, are not found. This fact indicates that in hydrophilic treatment of the example 1 to which the principle was applied, deterioration of PE molecules of the surface of the fiber was inhibited. This phenomenon can be explained as that an action of the acid caused break of PE molecules of the surface of the fiber and some substance and structure captured a radical when the radical produced in a molecule to inhibit chained break of PE by the radical. A possible secondary phenomenon and effect are to inhibit break of PE/PP caused by a radical chain through involvement of (polyoxyalkylene)-poly(dimehtylsiloxane) attaching to the surface in capturing the radical and formation of a chemical bond to the surface of PE by capturing the radical produced.

In compilation of these descriptions, in the example 1 to which the principle was applied, it is concluded that reform of the surface of the fiber is achieved by attaching of (polyoxyalkylene)-poly(dimehtylsiloxane) to the surface of the fiber in evenly thin film form. In the process, cleaning effect of the surface of the fiber is expected by the acid and the solvent contained in the solution used for hydrophilic treatment and also the action to enhance physical adsorption of the polyalkylene oxide chain is supposed. In addition to this, not lower possibility of the chemical bond of the broken part of the PE molecule to the polyalkylene oxide chain, according to break of the PE molecule by the highly concentrated acid and heat, is presumed.

Further, the example 1, to which the principle was applied, shows that over the surface of the fiber formed from a curved surface, as shown diagrammatically in FIG. 28C, for example, the polymer cover is easily achieved. As described above, annular covering of a circumferential part (a part of which section has the outer circumference of a closed circular shape) with the polymer cover, allows preventing easy falling down of the part, of which surface has been reformed by covering with the polymer, from the element.

Figure 26B:
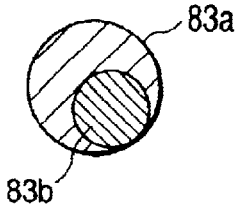

In some cases, the biaxial fiber, as shown in FIG. 26B, is eccentric, has a core part (core member) 1*b* exposed partially to the outer wall face, and includes both the surface made from the superficial layer (the sheath member) and the surface made from the core part. Also in such case, surface reform treatment according to the above described present invention allows imparting hydrophilicity to both the surfaces of the exposed part of the core part and the superficial layer. In addition, in the case where a surfactant having hydrophilic performance is simply applied and dried, partial initial hydrophilic property can be yielded. However, when mildly washing is done using pure water, the surfactant immediately dissolves in water to dissolve out finally resulting in loss of hydrophilicity.

EXAMPLES 2 AND 3 TO WHICH THE PRINCIPLE WAS APPLIED

Next, an example of application of the principle of surface hydrophilicity treatment as above described to the PP fibrous body will be described below. Specifically, as the PP fibrous body, a fiber block, having a 2 denier fiber diameter, formed in a cubic shape of 2 cm×2 cm×3 cm.

First, the hydrophilic treatment solution of the following two compositions were prepared.

TABLE 2

Composition of hydrophilic treatment solution

| Component | Composition (wt %) |
|---|---|
| (Polyoxyalkylene)-poly(dimehtylsiloxane) | 0.1 |
| Sulfuric acid | 0.0125 |
| Isopropyl alcohol | 99.8875 |

TABLE 3

Composition of hydrophilic treatment solution

| Component | Composition (wt %) |
|---|---|
| (Polyoxyalkylene)-poly(dimehtylsiloxane) | 0.1 |
| Sulfuric acid | 0.0125 |
| Isopropyl alcohol | 40.0 |
| Pure water | 59.8875 |

The second composition (the example 3 to which the principle was applied) is made to the above described composition by adding predetermined quantities of isopropyl alcohol and pure water in this order. Also here, sulfuric acid and (polyoxyalkylene)-poly(dimehtylsiloxane) contained are those four times diluted.

Following the step of hydrophilic treatment method of the PP-PE fibrous absorber explained using FIGS. 27A to 27F and FIGS. 28A to 28F, the PP fibrous body (the example 2 to which the principle was applied) treated with the solution of the first composition (Table 2), in which isopropyl alcohol is used as the main solvent, water, and the PP fibrous body (the example 3 to which the principle was applied) treated with the solution of the second composition to be used as a mixing solvent of isopropyl alcohol.

REFERENCE EXAMPLE 2

The PP fibrous body untreated was assigned to the reference example 2.

Similar to the example 1 to which the principle was applied, the surface of the PP fibrous body, of the reference example 2, untreated, having water repellency was reformed to the surface showing hydrophilicity as well as the PP fibrous body of the example 2 to which the principle was applied and the PP fibrous body of the example 3 to which the principle was applied. For the purpose to evaluate a degree of hydrophilicity, aqueous ink ($\gamma$=46 dyn/cm) of 7 g was put in a Petri dish and on the surface of ink liquid, the PP fibrous body of the example 2 to which the principle was applied, the PP fibrous body of the example 3 to which the principle was applied, and the untreated PP fibrous body of the reference example 2 were put mildly.

The untreated PP fibrous body of the reference example 2 showed the status of floating on aqueous ink. In the PP fibrous body of the example 2 to which the principle was applied and the PP fibrous body of the example 3 to which the principle was applied, ink was absorbed up from a bottom face of the fibrous body. However, if the PP fibrous body of the example 2 to which the principle was applied is compared with the PP fibrous body of the example 3 to which the principle was applied, the evident difference was found in the quantity of aqueous ink absorbed up and the PP fibrous body of the example 2 to which the principle was applied absorbed up the whole volume of ink in the Petri dish. However, in the PP fibrous body of the example 3 to which the principle was applied, about a half volume of ink left in the Petri dish.

Between the PP fibrous body of the example 2 to which the principle was applied and the PP fibrous body of the example 3 to which the principle was applied, the total quantity of (polyoxyalkylene)-poly(dimehtylsiloxane) which is the polymer covering those surfaces, there is not a substantial prominent difference. This may be the result of difference between the degree of orientation of the polymers themselves of the cover.

For example, in the PP fibrous body of the example 2, to which the principle was applied, the polymer covering the surface is almost oriented, but partially attaches in the situation in which the orientation contains an irregularity. On the other hand, in the PP fibrous body of the example 3 to which the principle was applied, the above described irregular orientation has been distinctly reduced.

In the hydrophilic treatment using (polyoxyalkylene)-poly(dimehtylsiloxane), it is understood that water is added to the solvent as well as isopropyl alcohol allows accomplishing cover with a dense and regularly arranged orientation. The treatment liquid itself needs to wet the surface thereof evenly and thus, isopropyl alcohol should be contained at least about 20%. Even if the content of isopropyl alcohol smaller than the content of 40% isopropyl alcohol of the above described example 3, to which the principle was applied, covering is possible. In other words, in the steps to evaporate and dry the solvent, isopropyl alcohol is lost by faster volatilization and during volatilization, the content of isopropyl alcohol further decreases. In consideration of this, even if the content of isopropyl alcohol smaller than the content of 40% isopropyl alcohol, covering is possible. Besides, in view of industrial safety, the content of isopropyl alcohol is preferably less than 40%.

Furthermore, it is natural that the above described concept of the art in the above described reform method and reformed surface and element according to the present invention is applicable to all porous bodies other than fibers as the negative pressure creating member.

The negative pressure creating member adapted to hydrophilicity evenly by the method disclosed in the section as described above (Other Embodiments), concerning reabsorption of ink after removal of ink (liquid) impregnated in the negative pressure creating member as described in the Section of Problem to be Solved by the Invention, yields the effect, by which the quantity of ink held by the negative pressure creating member after reabsorption is almost equal, in other words the initial negative pressure can be recovered regardless of removed amount of and repetition frequencies of ink.

On the other hand, in the embodiment in which an liquid containing chamber is detachably installed in the negative pressure creating member-containing chamber, concerning a holding amount of liquid in the negative pressure creating member-containing chamber in replacing the liquid containing chamber, there are various cases such as the case where liquid is held up to a position around a joint pipe being a joint part to ink leading orifice, the case where liquid is consumed up to the position around an ink supply opening, or the case where there is no ink to consume (supply). According to application of the above described invention, by hydrophilic treatment of the negative pressure creating member in the negative pressure creating member-containing chamber by any one of methods disclosed in the above described (Other Embodiments) section, after replacing the liquid containing chamber, the negative pressure in the ink supply opening of the negative pressure creating member-containing chamber can be always recovered to the initial level (the negative pressure and quantity) regardless of frequencies of replacement and a remained quantity of liquid in the negative pressure creating member-containing chamber before replacement. Here, in consideration of partial hydrophilic treatment according to the present invention, in a treating part, there is the remained quantity of liquid in the negative pressure creating member before replacement in the position around the treating part (for example, the case where liquid around the joint pipe has been only consumed), whole the negative pressure creating member should be not treated hydrophilically by the above described method, but the above described hydrophilic treatment may be adapted to do from the part where liquid is consumed to the part where liquid is added to.

(First Embodiment)

FIG. 1 is the diagrammatic sectional view of the liquid containing container according to the first embodiment of the present invention.

The ink tank having the shape shown in FIG. 1, in which the PP fibrous body (entangled body of polypropylene fibers (hereafter, the PP fibrous body indicated by shadowing in the figure)) 2 as the negative pressure creating member for the ink jet head to do recording by ejecting liquid is arranged in an entire inside thereof and is used for containing liquid, to supply to the ink jet head, held by the PP fibrous body 2. On a top end of a tank case, an atmosphere communication orifice 3 is installed. As the PP fibrous body 2, those, in which the surface of the PP fiber entangled has been hydrophilically treated, is used. Hydrophilic treatment is not restricted to entire part of the PP fiber similar to the present example, but also may be only to the circumferential part of the orifice 4 to supply ink to the head.

For the ink tank according to the present embodiment, using ink having the following physical properties, impregnating degree and flow resistance of ink were measured.

| (Ink used for measurement) | |
|---|---|
| C. I. FB (food black) II | 5.0 parts |
| Glycerin | 5.0 parts |
| Ethylene glycol | 5.0 parts |
| Urea | 5.0 parts |
| IPA (isopropyl alcohol) | 5.0 parts |
| Ion exchanged water | 75.0 parts |

Ink with the above described physical properties used was of the surface tension of 44 (dyne/cm) and viscosity 2.2 (cP). Components of ink are not restricted to components consisting of the above described physical properties.

For impregnating degree and flow resistance of ink, measurement was carried out for case with hydrophilic treatment (the present invention) and case without hydrophilic treatment (a conventional example). For ink impregnating degree, ink was dropped on the surface of the fibrous body to observe natural impregnation or not. Flow resistance was measured by absorbing ink from a bottom end of the liquid containing container in an absorbing volume of 3.0 (g/min) using a manometer connected to an absorbing part.

Table 4 shows the result of the above described measurement.

TABLE 4

| | Ink impregnating degree | Flow resistance (mm Aq) |
|---|---|---|
| Without hydrophilic treatment | Never impregnated | 30 |
| With hydrophilic treatment | Instantaneously impregnated | 15 |

As known from the result of the above described measurement, wettability to ink with a high surface tension is increased by hydrophilic treatment and hence, a process and facilities to inject ink in the absorber in the ink tank can be simplified. In addition, wetting status of ink can be made even. Further, the ink flow resistance in supplying ink to the ink jet head can be decreased and thus, easy development can be made easy to a printer requiring a high flow rate supply for a high speed printing.

(Second Embodiment)

Figure 2A:
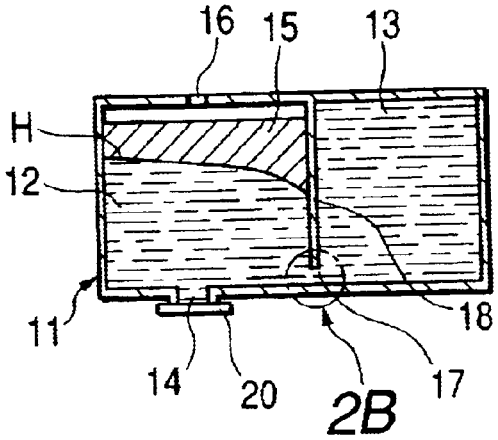
FIGS. 2A and 2B are diagrammatic sectional views of a liquid containing container according to a second embodiment of the present invention.
Figure 2B:
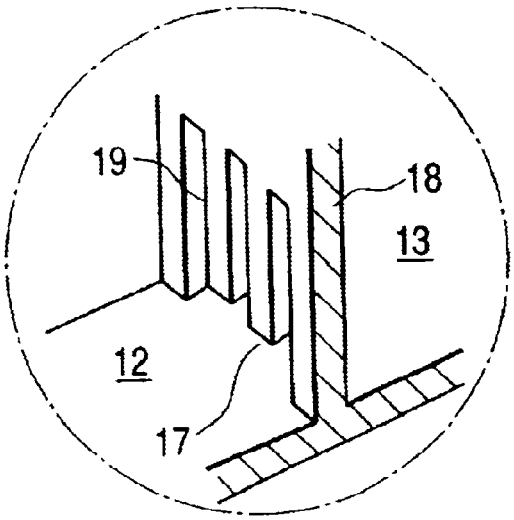

FIGS. 2A and 2B show the diagrammatic sectional views of the liquid containing container according to the second embodiment of the present invention. In this figure, ink itself and ink held by the fibrous body are expressed with a dotted transverse line and the fibrous body itself is expressed with a dot.

The ink tank 11 with the shape shown in FIGS. 2A and 2B comprise the negative pressure creating member-containing chamber 12 and the ink containing chamber 13.

The negative pressure creating member-containing chamber 12 comprises a case having the ink supply opening 14 to supply ink (containing such liquid as the treatment liquid) to outside such as the ink jet head, which performs recording by ejecting liquid from the ejecting orifice, and the PP fibrous body 15 as the negative pressure creating member housed in the case. The case, furthermore, comprises the PP fibrous body 15 housed in internal part and the atmosphere communication orifice 16 to communicate with atmosphere. The ink supply opening 14 may be that previously opened and that first closed with a seal 20 and opened for use by removing the seal 20.

On the other hand, the ink containing chamber 13, in which ink is contained inside, comprises the ink leading orifice 17, around the bottom face, to lead liquid to the negative pressure creating member-containing chamber 12. On the face of the negative pressure creating member-containing chamber 12 side of a partitioning wall 18 between both chambers 12 and 13, in which the ink leading-in orifice 17 is opened, an atmosphere leading-in groove 19 to enhance gas-liquid exchange described later extends from a predetermined height of the partitioning wall 18 to the ink leading-out orifice 17.

Herewith, the function of the atmosphere leading-in groove 19 will be explained. In FIGS. 2A and 2B, when ink is consumed from the ink supply opening 14, the surface H of liquid in the PP fibrous body 15 of the negative pressure creating member-containing chamber 12 lowers. In addition, when consumption of ink from the ink supply opening 14 increases, a gas is led to the ink containing chamber 13. Then, the surface level of liquid in the PP fibrous body 15 keeps almost constant height at the top end of the atmosphere leading-in groove 19. Air enters the ink containing chamber 13 from the atmosphere communication orifice 16 through the atmosphere leading-in groove 19 and the ink leading-out orifice 17 and then, ink moves from the ink containing chamber 13 to the PP fibrous body 15 of the negative pressure creating member-containing chamber 12. Therefore, when ink is consumed from the ink jet head, ink is filled in the PP fibrous body 15 according to consumption and the PP fibrous body 15 keeps the liquid surface level resulting in the almost constant negative pressure and thus, ink supply of the ink jet head is become stable.

In the ink tank comprising the above described constitution, the PP fibrous body 15 used is that of which surface of fibers entangled has been hydrophilically treated. Hydrophilic treatment has been applied to all the PP fibrous body or, the part (area 20 hydrophilically treated and indicated with shadowing in FIG. 3) of the PP fibrous body 15 contacting with the atmosphere leading-in groove 19 and adjacent area thereof or the area (area 21 hydrophilically treated and indicated with shadowing in FIG. 4) from this contact part to the ink supply opening 14.

Figure 3:
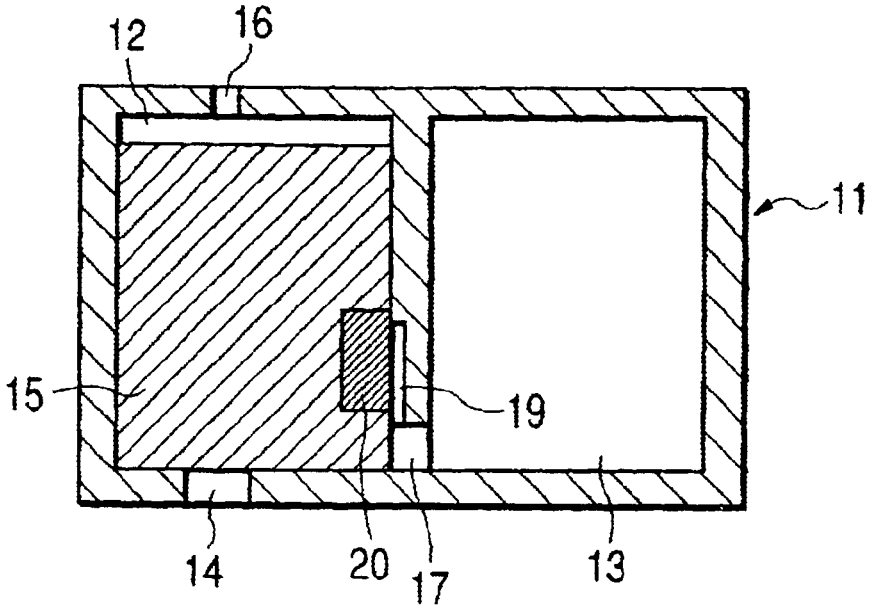
FIG. 3 is a figure showing an example of a hydrophilically treated region in an absorber of a liquid containing container according to a second embodiment of the present invention.

According to the example of embodiment shown in FIG. 3, in order to hold ink stably by the part corresponding to the atmosphere leading-in groove 19 of the PP fibrous body 15 and adjacent area thereof, before reaching the status of gas-liquid exchange, it can be prevented operation of gas-liquid exchange by a careless air pass. Besides, ink consumption is stopped in gas-liquid exchange status, the part corresponding to the atmosphere leading-in groove 19 of the PP fibrous body 15 and adjacent area thereof are filled with ink to close rapidly the atmosphere leading-in groove 19.

Figure 4:
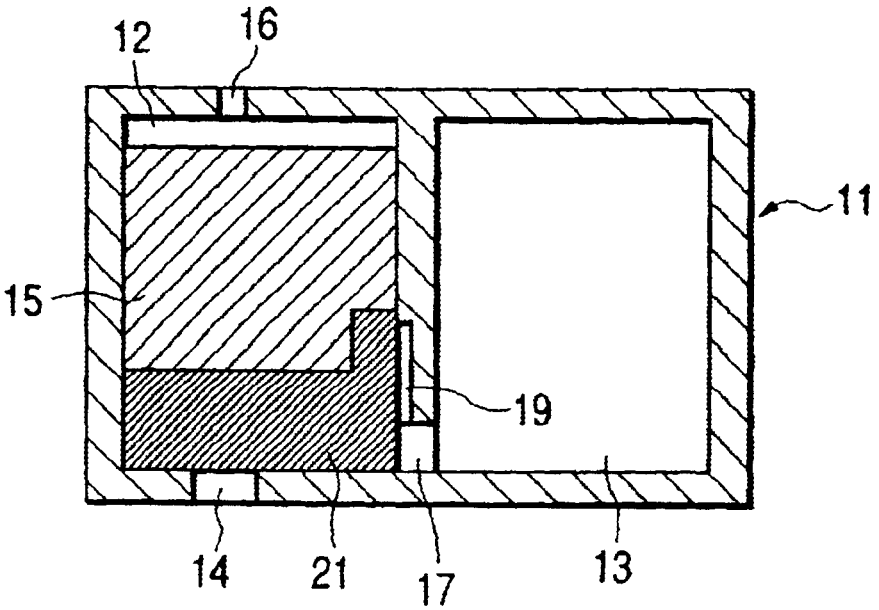
FIG. 4 is a figure showing an example of a hydrophilically treated region in an absorber of a liquid containing container according to a second embodiment of the present invention.

Furthermore according to embodiment shown in FIG. 4, on the basis of hydrophilic treatment of area from the part corresponding to the atmosphere leading-in groove 19 of the PP fibrous body 15 and adjacent area thereof to the part corresponding to the ink supply opening 14, in addition to the effect of the embodiment of FIG. 3, ink in the negative pressure creating member-containing chamber 12 can be stably and continuously sent to the ink supply opening 14 to the ink jet head without to improve ink supply performance. The ink flow resistance in supplying ink to the ink jet head reduces and therefore, development to the printer requiring a high flow rate supply for a high speed printing becomes easy.

In embodiments shown in FIG. 3 and FIG. 4, the height of the area hydrophilically treated and contacting to the atmosphere leading-in groove 19 is not restricted to the position illustrated and may be assigned to the height optimal to carry out a stable gas-liquid exchange action. Particularly, in the case where active ink drawing to the absorber is taken into account, in the degree not disturbing the air pass in gas-liquid exchange, the area to be hydrophilically treated is preferably located around the top end of the atmosphere leading-in groove.

(Third Embodiment)

Figure 5:
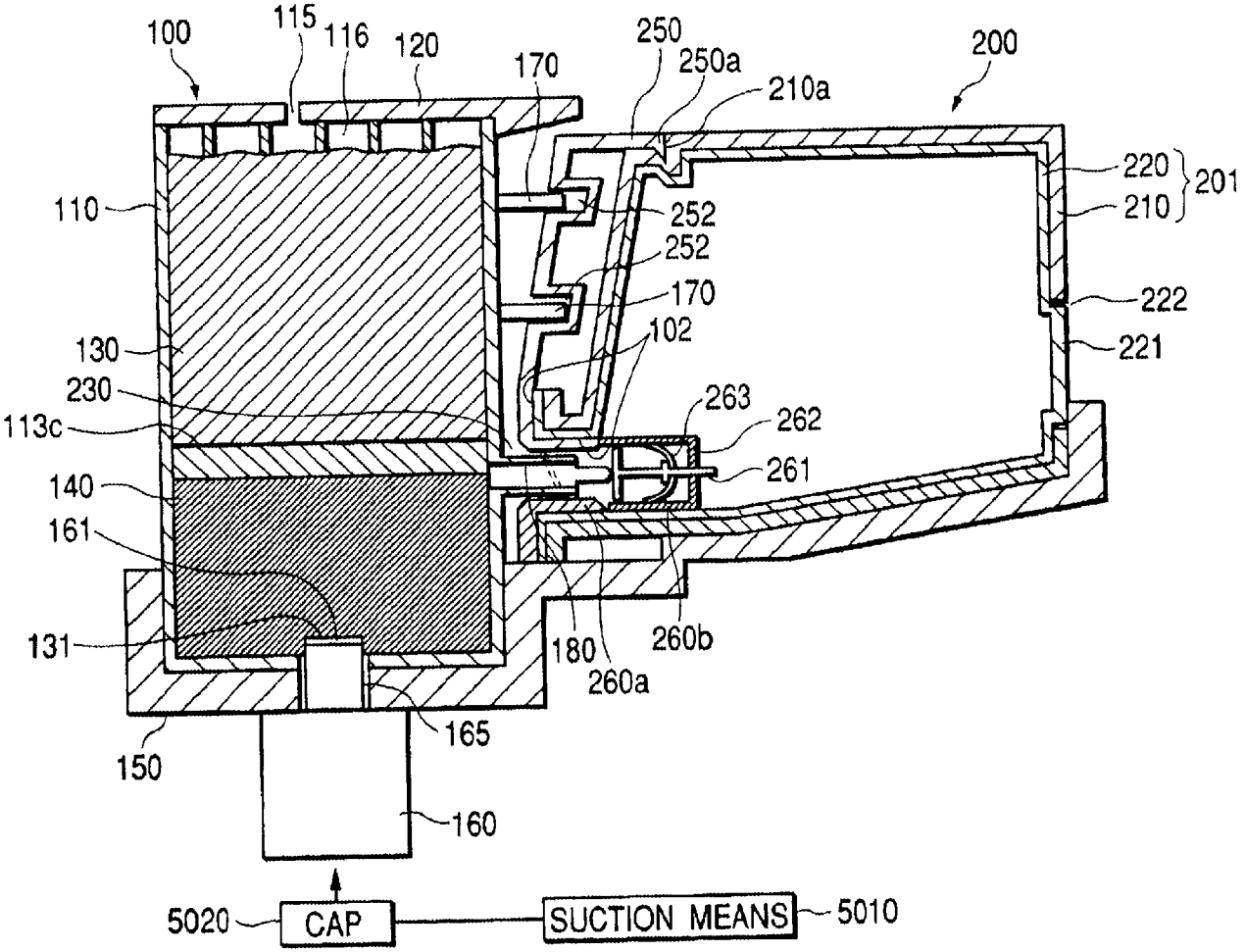
FIG. 5 is a figure showing an example of a hydrophilically treated region in a negative pressure creating member (absorber) in an ink jet head cartridge, which is the liquid containing container according to a third embodiment of the present invention.

FIG. 5 is the figure showing the ink jet head cartridge, which is the liquid containing container according to the third embodiment of the present invention.

The ink jet head cartridge according to the present embodiment, as shown in FIG. 5, comprises an ink jet head unit 160, a holder 150, a negative pressure regulating chamber unit 100, and an ink tank unit 200. The negative pressure regulating chamber unit 100 is fixed to the holder 150 and downward of the negative pressure regulating chamber unit 100, the ink jet head unit 160 is fixed through the holder. The negative pressure regulating chamber unit 100 comprises a negative pressure regulating chamber container 110 on which top has an opening part, a negative pressure regulating chamber lid 120 attached to the top face of the negative pressure regulating chamber container 110, two absorbers 130 and 140, installed in the negative pressure regulating chamber container 110, for impregnation to hold ink. The absorbers 130 and 140 is, in the status of use of the ink jet head cartridge 70, stacked to make double layers for contacting closely each other resulting in filling in the negative pressure regulating chamber container 110. A capillary force created by the absorber 140 located in the lower step is higher than the capillary force created by the absorber 130 located in the higher step and thus, the absorber 140 located in the lower step shows a higher ink holding performance. Toward the ink jet head unit 160, ink in the negative pressure regulating chamber unit 100 is supplied through an ink supply tube 165.

The absorber 130 communicates with the atmosphere communication orifice 115 and the absorber 140 contacts closely with the absorber 130 on the top face thereof and also contacts closely with a filter 161 on the bottom face thereof. A boundary 113*c* between the absorbers 130 and 140 is located upward than the top end of a joint pipe 180 as the communicating part in the attitude in use.

The absorbers 130 and 140 comprise those made by entangling polyolefin resin (for example, the biaxial fiber in which PE is formed on the superficial layer of PP). The absorbers 140 used is that made by hydrophilic treatment of fibers of the part (part shadowed in FIG. 5) from around the position of a half of the opening of the joint pipe 180 to the supply opening 131.

By locating the boundary 113*c* between the absorbers 130 and 140 in the top part, preferably around the top end of a joint pipe 180 similar to the present embodiment, of the joint pipe 180 in the attitude in use, in gas-liquid exchange action mentioned later, the interface between ink and gas in the absorbers 130 and 140 in gas-liquid exchange action can be assigned to the boundary 113*c*. As the result, the static negative pressure in the head part can be stabilized in ink supplying action. In addition, by making strength of the capillary force of the absorber 140 relatively higher than the capillary force of the absorber 130, in the case where ink exists in both the absorbers 130 and 140, after ink in the upper absorber 130 is consumed, ink in the bottom absorber 140 can be consumed. Further, in the case where gas-liquid interface changes according to the environmental change, after first the absorber 140 and area around the boundary 113*c* between the absorbers 130 and 140 are filled, ink go to the absorber 130.

The ink tank unit 200 is adapted to have constitution removable from the holder 150. The joint pipe 180 which is the connecting part installed on the surface of the ink tank unit 200 of the negative pressure regulating chamber container 110 is connected to the joint orifice 230 of the ink tank unit 200 by inserting in the inside thereof. Through the connecting part of the joint pipe 180 and the joint orifice 230, the negative pressure regulating chamber unit 100 and the ink tank unit 200 are constituted to supply ink in the ink tank unit 200 to inside of the negative pressure regulating chamber unit 100. In the part in the position upper than the joint pipe 180 in the face of the ink tank unit 200 side of the negative pressure regulating chamber unit 100, an ID member 170, projected from the face thereof, for prevention of wrong installation of the ink tank unit 200 is installed integrally.

On the negative pressure regulating chamber lid 120, the atmosphere communication orifice 115 to communicate inside the negative pressure regulating chamber container 110 with external atmosphere (here, the absorber 130 housed in the negative pressure regulating chamber container 110 and external atmosphere) is formed and the space, which is formed by a rib projected from the face of the absorber 130 of the negative pressure regulating chamber lid 120, and a buffer space 116 composed of the area without ink (liquid) in the absorber, are prepared around the atmosphere communication orifice 115 in the negative pressure regulating chamber container 110.

In the joint orifice 230, a valve mechanism is installed. The valve mechanism comprises a first valve frame 260*a*, a second valve frame 260*b*, a valve body 261, a valve lid 262, and an energizing member 263. The valve body 261 is supported in the second valve frame 260*b* slidably and energized toward the first valve frame 260*a* side by the energizing member 263. In the status in which the joint pipe 180 is not inserted in the joint orifice 230, an edge part of the part of the first valve frame 260*a* side of the valve body 261 is pressed to the first valve frame 260*a* by an energizing force of the energizing member 263 and hence, air tightness inside the ink tank unit 200 is maintained.

The joint pipe 180 is inserted in the inside part of the joint orifice 230 and the valve body 261 is pressed by the joint pipe 180 to move it from the first valve frame 260*a* and thus, through the opening formed on the side face of the second valve frame 260*b*, inside of the joint pipe 180 communicates with inside part of the ink tank unit 200. According to this, air tightness of the ink tank unit 200 is released to supply ink in the ink tank unit 200 to inside of the negative pressure regulating chamber unit 100 through the joint orifice 230 and the joint pipe 180. In other words, by opening of the valve in the joint orifice 230, inside of the ink containing part of the ink tank unit 200 in the closed status becomes a communicating status though only the above described opening.

The ink tank unit 200 comprises the ink containing container 201 and the ID member 250. The ID member 250 is for prevention of wrong installation in installation of the ink tank unit 200 and the negative pressure regulating chamber unit 100. In the ID member 250, the above described first valve frame 260*a* is formed. By using the first valve frame 260*a*, the valve mechanism is constituted to regulate flow of ink in the joint orifice 230. The valve mechanism performs opening and closing actions by engaging with the joint pipe 180 of the negative pressure regulating chamber unit 100. On a front face, which becomes the negative pressure regulating chamber unit 100 side, of the ID member 250, a recessed part 252 for the ID is formed to prevent wrong insertion of the ink tank unit 200.

The ink containing container 201 is a hollow container having an almost polygonal pier shape and a negative pressure creating function. The ink containing container 201 is constituted from the case 210 and an internal bag 220. The case 210 and the internal bag 220 are adapted to be removable, respectively. The internal bag 220 has flexibility and the internal bag 220 is deformable according to leading of ink contained in inside. The internal bag 220 has a pinch-off part (fused part) 221 and is supported by the pinch-off part in the status of engaging the internal bag 220 with the case 210. In the part, around the pinch-off part 221, of the case 210, the external atmosphere communicating orifice 222 is formed to allow leading atmosphere to the space between the internal bag 220 and the case 210 through the external atmosphere communicating orifice 222.

The ID member 250 is connected to each of the case 210 and the internal bag 220 of the ink containing container 201. The ID member 250 is connected by fusion of the seal face 102 of the internal bag 220, which corresponds to the ink leading part, for the internal bag 220, of the ink containing container 201, with a corresponding face of the part of the joint orifice 230 in the ID member 250. According to this, the supply opening part of the ink containing container 201 is completely sealed to prevent leak of ink from the seal part of the ID member 250 and the ink containing container 201 in attaching and detaching of the ink tank unit 200.

In connection of the case 210 and the ID member 250, when an engaging part 210*a*, formed on the top face of the case 210, and a click part 250*a*, formed in the top part of the ID member 250, are at least engaged, the ID member 250 is almost fixed to the ink containing container 201.

Concerning the ink jet head unit 160, recovery to a normal status is become possible by ejecting ink forcedly from the ink ejecting orifice thereof by closing the ink ejecting orifice with a cap 5020 and absorbing ink from absorbing means 5010 in a closed status of the ink ejecting orifice with the cap.

Figure 6:
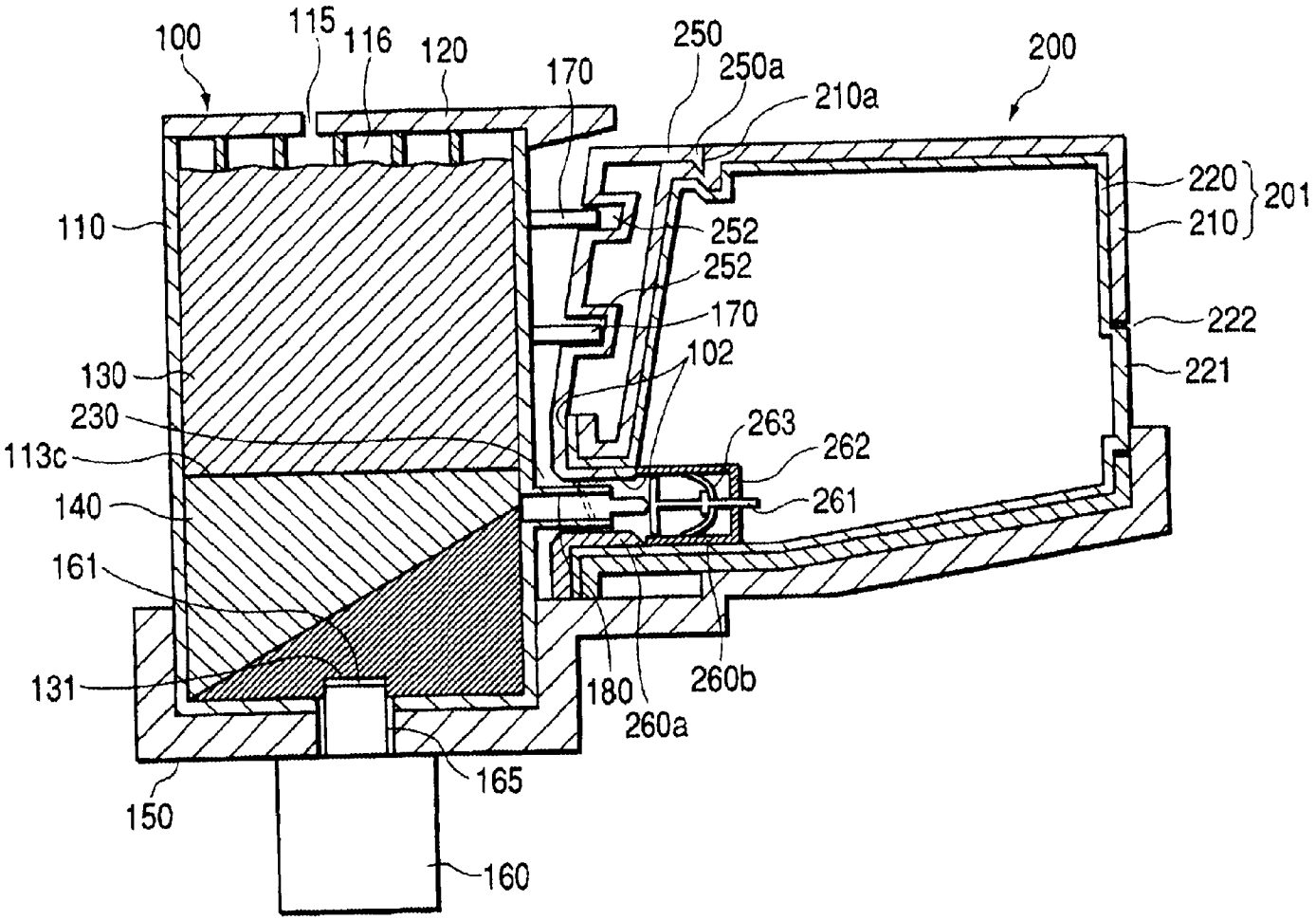
FIG. 6 is a figure showing an example of a hydrophilically treated region in a negative pressure creating member (absorber) in the ink jet head cartridge, which is the liquid containing container according to a third embodiment of the present invention.

As a modified example of the third embodiment described for FIG. 5, as shown in FIG. 6, hydrophilic treatment step may be obliquely put from the position around a half of the opening of the joint pipe 180 in one side of the negative pressure regulating chamber container 110 to an angled corner of the bottom face of the negative pressure regulating chamber container 110 in which the supply opening 131 has been formed.

Next, on the basis of the embodiment of FIG. 6, movement of ink between the ink tank unit 200 and the negative pressure regulating chamber unit 100 will be explained below.

Figure 9A:
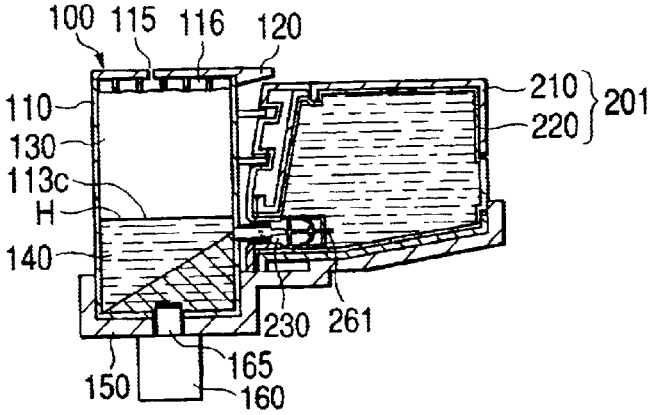
FIGS. 9A, 9B, 9C and 9D are figures showing an example of a moving status of ink in an ink jet head cartridge, which is the liquid containing container according to a third embodiment of the present invention.
Figure 9B:
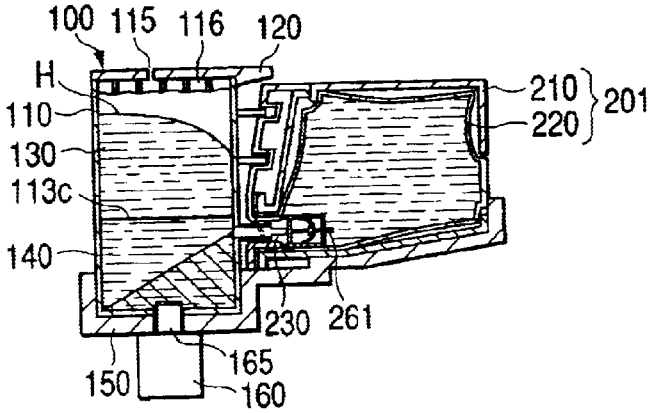

As shown in FIG. 9A, when the ink tank unit 200 is connected to the negative pressure regulating chamber unit 100, as shown in FIG. 9B, ink in the ink containing container 201 moves to inside of the negative pressure regulating chamber unit 100 until pressures of inside of the negative pressure regulating chamber unit 100 and inside of the ink containing container 201 become equal (this status is named starting status for use).

When ink consumption is started by the ink jet head unit 160, balancing in a direction in which values of the static negative pressure created by both the internal bag 220 and the absorber 140 increases, ink held by both the internal bag 220 and the absorber 140 is consumed. Here, if ink is held by the absorber 130, ink in the absorber 130 is also consumed.

Figure 9C:
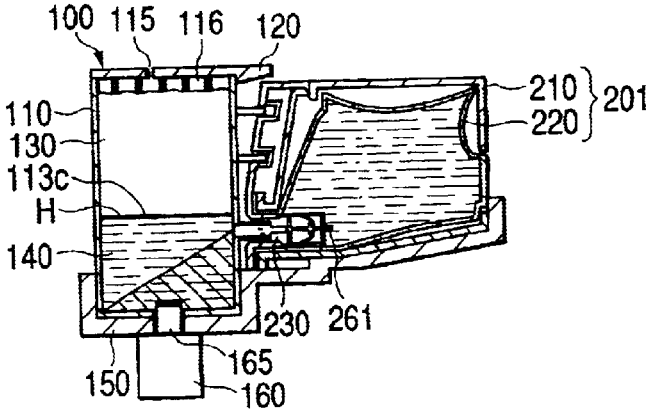

When the joint pipe is communicated with atmosphere by reduction of ink amount in the negative pressure regulating chamber unit 100 caused by the status of FIG. 9C, gas is immediately led to inside of the internal bag 220 and replacing to this, ink in the internal bag 220 moves to inside of the negative pressure regulating chamber unit 100. By this step, the absorbers 130 and 140 keep almost constant negative pressures against leading out of ink keeping the gas-liquid interface. Through such gas-liquid exchange status, when the total volume of ink in the internal bag 220 moves to inside of the negative pressure regulating chamber unit 100, ink remained in the negative pressure regulating chamber unit 100 is consumed.

Figure 7:
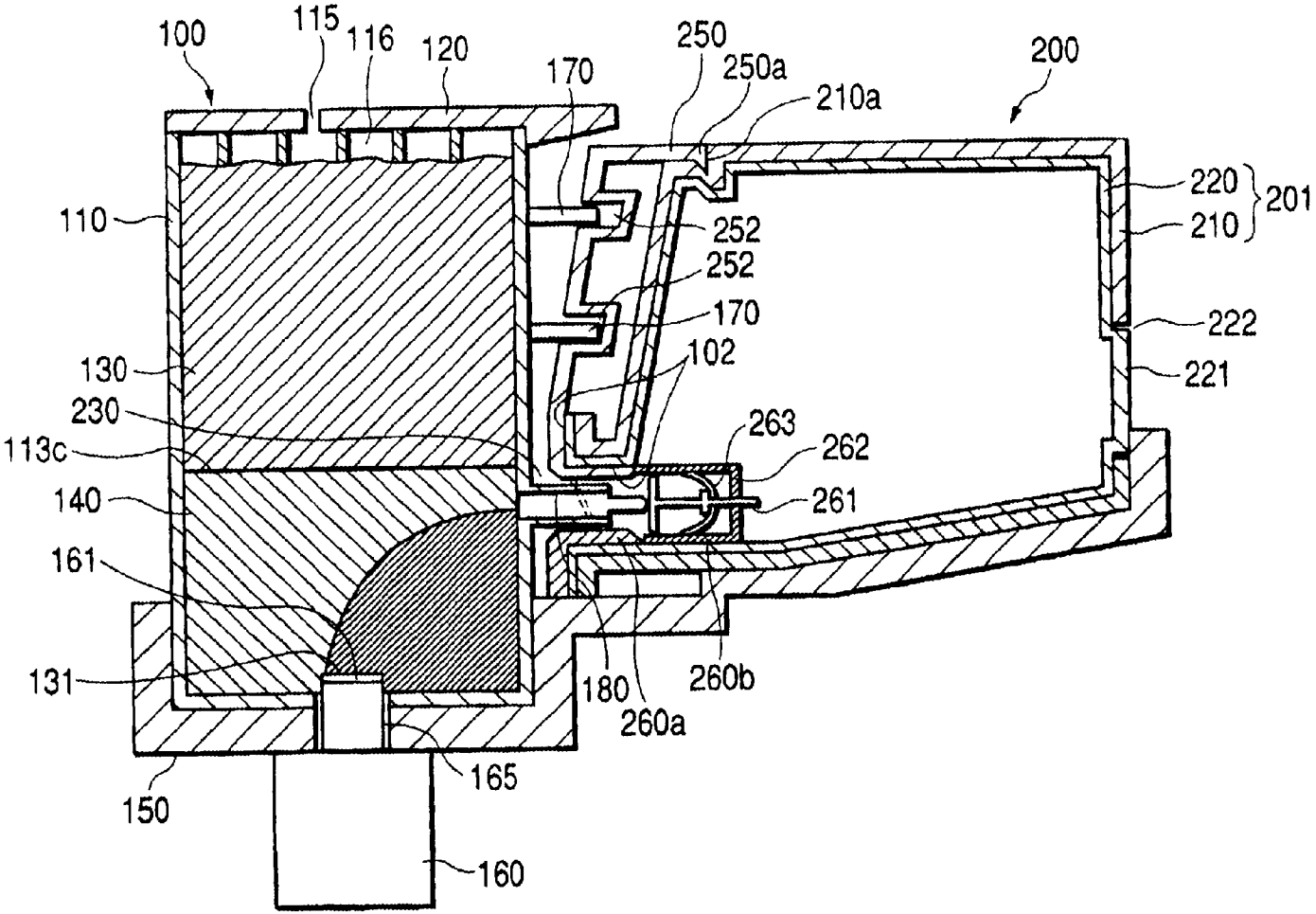
FIG. 7 is a figure showing an example of a hydrophilically treated region in a negative pressure creating member (absorber) in an ink jet head cartridge, which is the liquid containing container according to a third embodiment of the present invention.

According to the above described constitution, in the polyolefin fibrous body being the ink absorber as the negative pressure creating member, ink supplying area at least from the joint pipe 180 to the supply opening 131 is hydrophilically treated. Not only restricted to that this hydrophilically treated area, as shown by shadowing in FIG. 5, is presented evenly from about a half height position of the opening of the joint pipe 180 to the bottom face of the negative pressure regulating chamber container 110, in which the supply opening 131 has been formed, but also it may be presented that for example, as shown by shadowing in FIG. 6, the hydrophilically treated area may be obliquely presented from the position around a half of the opening of the joint pipe 180 in one side of the negative pressure regulating chamber container 110 to the angled corner of the bottom face of the negative pressure regulating chamber container 110 in which the supply opening 131 has been formed. Or, as shown by shadowing in FIG. 7, the hydrophilically treated area may be presented arcuately in the shortest distance as possible from the position around a half of the opening of the joint pipe 180 in one side of the negative pressure regulating chamber container 110 to the supply opening 131. Further, as shown by shadowing in FIG. 8, the following is possible: the boundary line 113*c* between the absorbers 130 and 140 is matched to the height around the half of the opening of the joint pipe 180 to subject the whole of the absorber 140 to hydrophilic treatment. The example of the hydrophilically treated area shown in FIG. 5 to FIG. 7 can be also applied to the absorber in the liquid containing container of the second embodiment shown in FIGS. 2A and 2B, 3 and 4.

Figure 9D:
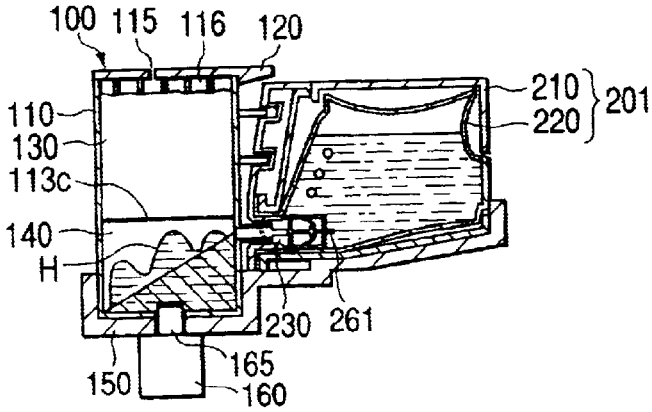
Figure 10:
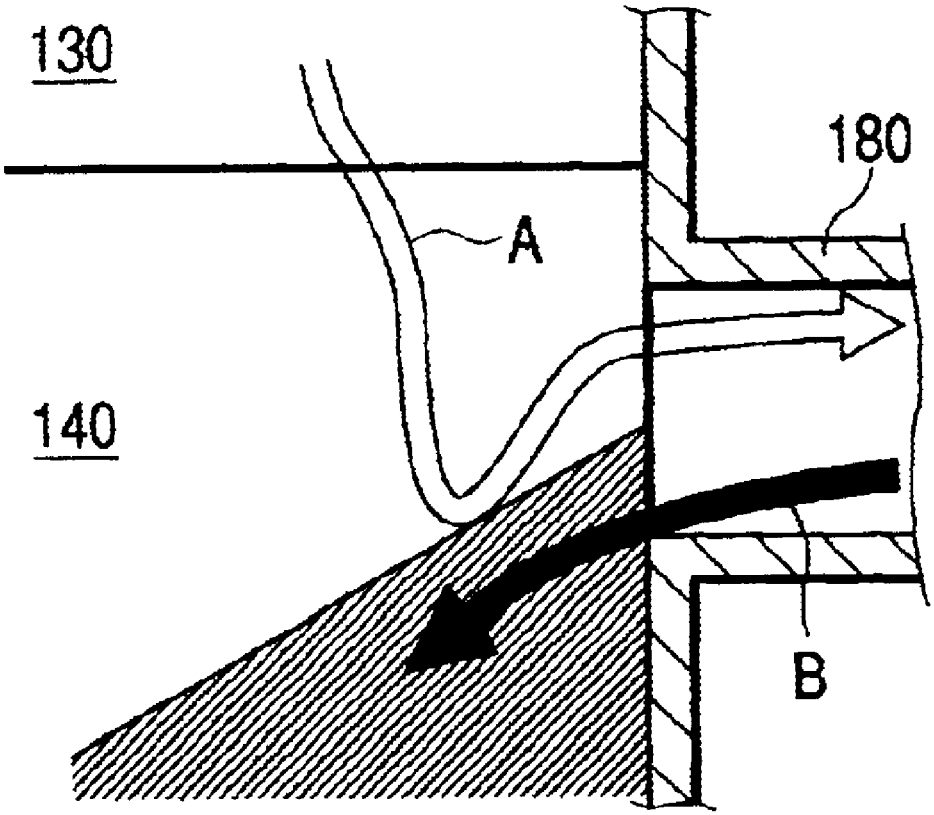
FIG. 10 is a figure explaining an effect of a hydrophilically treated region in gas-liquid replacement in an ink jet head cartridge, which is the liquid containing container according to a third embodiment of the present invention.

According to the above described embodiment, as shown in FIG. 9D in the gas-liquid exchange action, even if the liquid surface of the upper absorber 130 lowers by disturbance by microscopic difference in density of the absorber, in the hydrophilically treated area (shadowed area in the figure), (a projected lowered liquid surface is stopped. In other words, as shown in FIG. 10), air (for example, an arrow A in the figure) in gas-liquid exchange keeps the ink flow (an arrow B in the figure) to flow in the top part of the joint pipe 180 and thus, the stable gas-liquid exchange action is carried out.

Because around the supply opening 131 is hydrophilically treated, ink stays always around it and therefore, discontinuous ink flow hardly takes place also in the supply opening 131.

Furthermore, when a new ink containing container 201 is replaced to, the hydrophilically treated area of the absorber 140 actively induces ink and therefore, head recovery can be rapidly realized by the cap 5020 and the absorbing means 5010, as explained in the section of the seventh embodiment later. In addition, ink amount required for head recovery can be controlled by changing the range of the hydrophilically treated area and number of hydrophilic groups per a unit area.

Figure 11:
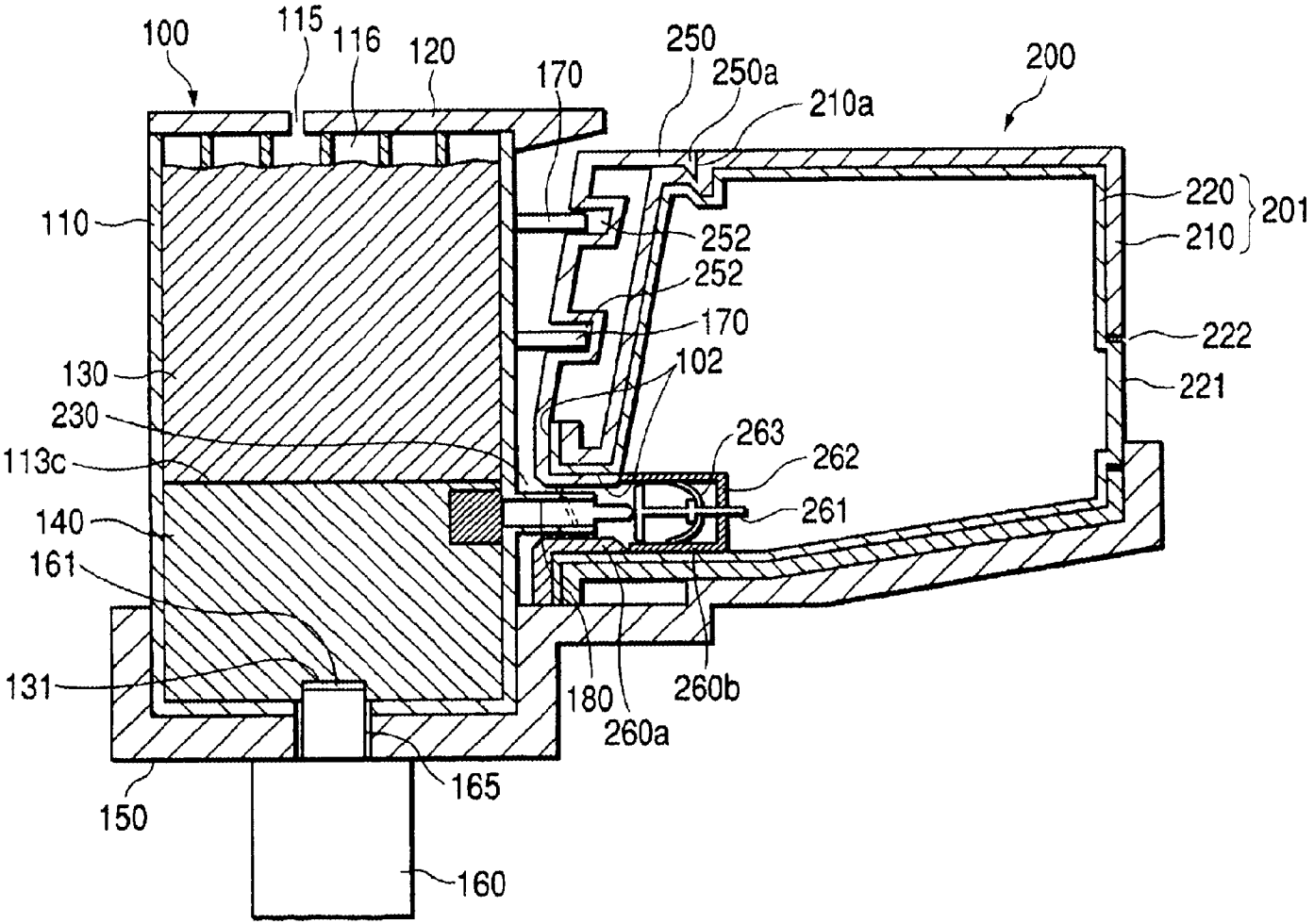
FIG. 11 is a figure showing an example of a hydrophilically treated region in a negative pressure creating member (absorber) in an ink jet head cartridge, which is the liquid containing container according to a third embodiment of the present invention.

The modified example of the present embodiment, as shown in FIG. 11, may be that in which hydrophilic treatment is applied only to the opening of the joint pipe 180 of the absorber 140 and the part corresponding to peripheral area thereof. According to the example of FIG. 11, in addition to drawing of ink in gas-liquid exchange explained in the second embodiment, ink remained in the joint pipe 180 is easy to be absorbed when the ink tank unit 200 is removed and therefore, ink dropping can be prevented.

Not illustrated, but as another modified example, the absorber integrated with absorbers 130 and 140 may be arranged to make area corresponding to the absorber 140 hydrophilic to impart the capillary force corresponding to the absorber 140 and also to make the hydrophilic area according to the present invention.

In the examples of embodiments shown in FIG. 5 to FIG. 11, the height of the hydrophilically treated area contacting with the opening of the joint pipe 180 is not restricted to the position illustrated and may be determined to the height around the pipe opening most suitable for stable gas-liquid exchange action. Particularly, in consideration of active drawing of ink to the absorber, it is preferable that the hydrophilically treated area is located in the pipe opening face in the degree of no disturbance of the air pass in gas-liquid exchange.

(Fourth Embodiment)

Figure 12:
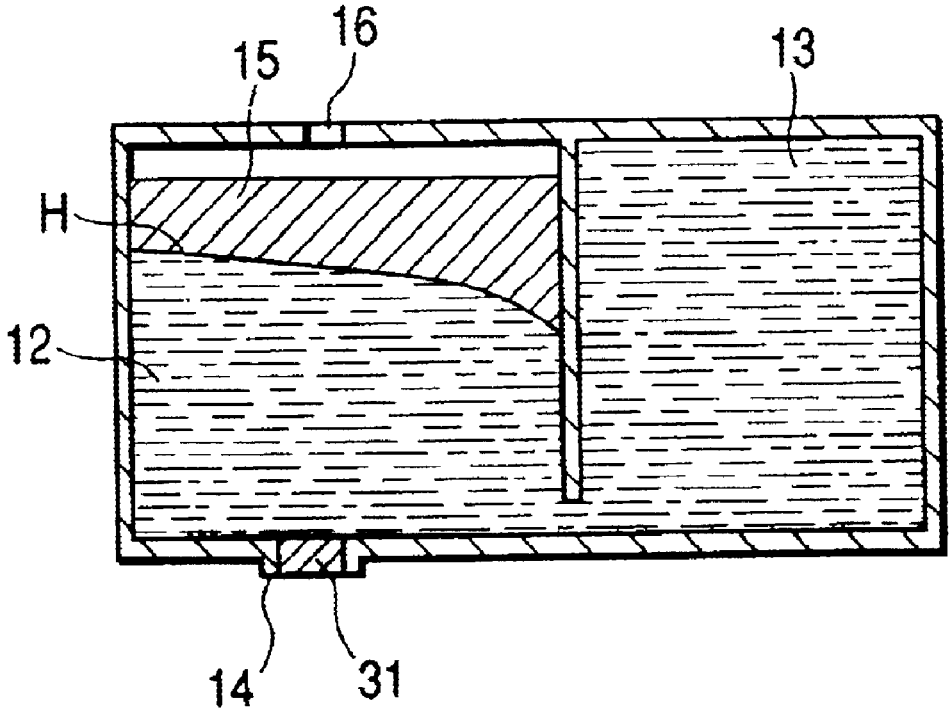
FIG. 12 is a diagrammatic sectional figure showing the liquid containing container, which has a pressurized contact body, according to a fourth embodiment of the present invention.

FIG. 12 is the diagrammatic sectional figure showing the liquid containing container according to the fourth embodiment of the present invention. In this figure, ink itself and ink held by the absorber are expressed with the dotted transverse line and the absorber containing no ink is expressed with the dot.

The liquid containing container of the embodiment shown in FIG. 12 is that in order to hold ink actively to increase connectivity on ink to the ink jet head side, a pressure contacting body of the PP fiber as the member having the higher capillary force than that of the absorber 15 of the PP fiber in the negative pressure creating member-containing chamber 12 is installed in the ink supply opening 14 in the liquid containing container of the second embodiment shown in FIGS. 2A and 2B.

In the present example, hydrophilic treatment was conducted for the pressure contacting body 31 subjected to such hydrophilic treatment can be installed not only to the liquid containing container according to the second embodiment, but also to the ink supply openings of the liquid containing containers according to the first and third embodiments.

The embodiment by which the pressure contacting body is, in case of need of supplying ink to the head side with a high flow rate, installed in the ink supply openings may deteriorate distinctly ink suppliability because the flow resistance produced in the part of the pressure contacting body becomes very large. However, by applying hydrophilic treatment to the pressure contacting body, the ink flow resistance can be reduced to increase fluidity of ink finally resulting in ink supply with the high flow rate.

In addition, in the case where bubbles stay in the pressure contacting body, an ink path becomes narrow and hence, the flow resistance may further increase. However, by effect of hydrophilic treatment, staying of bubbles can be prevented and therefore, rise of the flow resistance can be suppressed.

(Fifth Embodiment)

Figure 13:
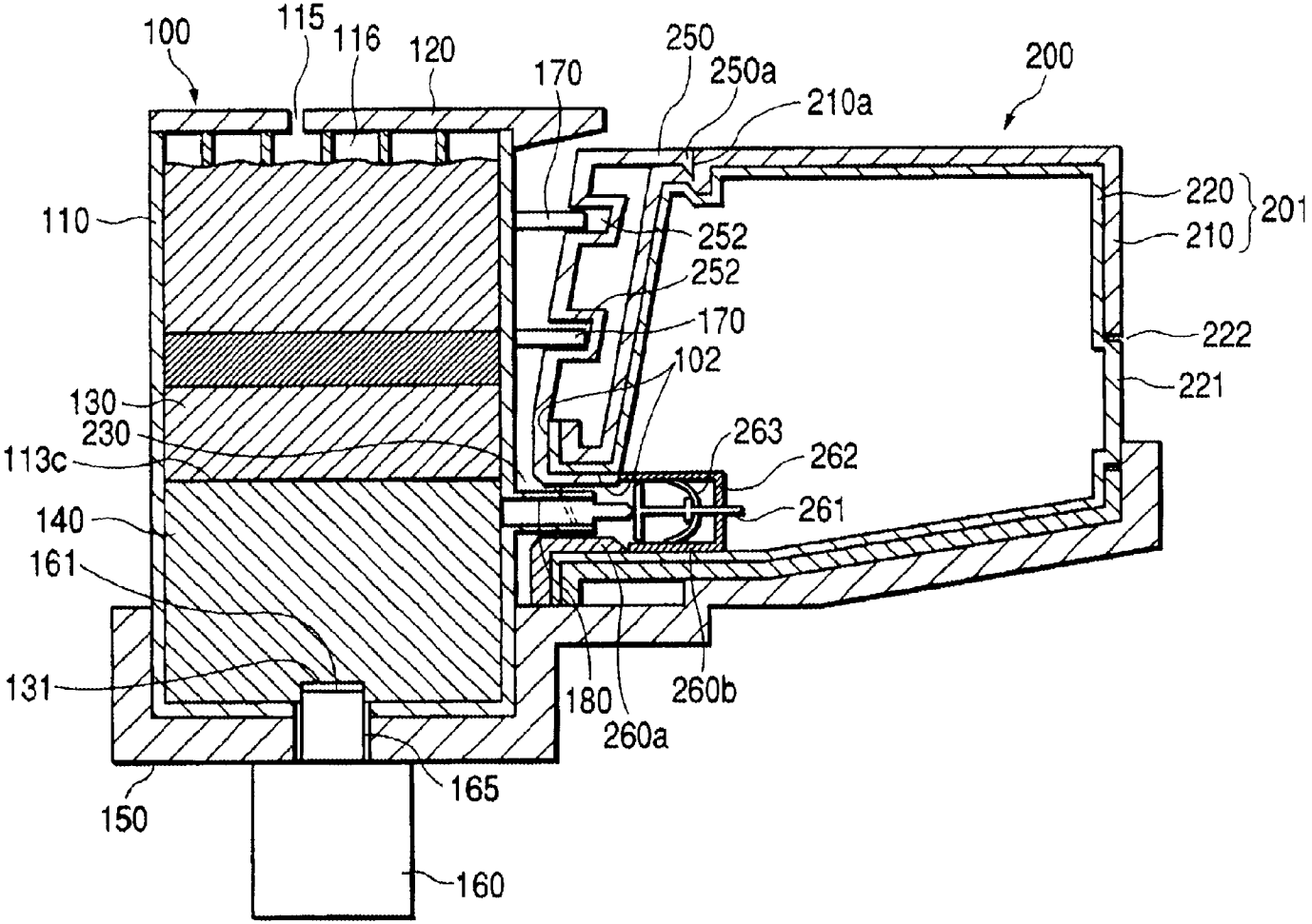
FIG. 13 is a diagrammatic sectional figure showing the liquid containing container according to a fifth embodiment of the present invention.

FIG. 13 is the diagrammatic sectional figure showing the liquid containing container according to the fifth embodiment of the present invention.

The liquid containing container of the embodiment shown in FIG. 13 that in which in the ink jet head cartridge of the third embodiment, the hydrophilically treated area (the part indicated with shadowing in the figure) is located in the upper absorber 130 made from the PP fibrous body in the negative pressure regulating chamber container 110 as a plane layer crossing to a gravity direction.

Figure 14A:
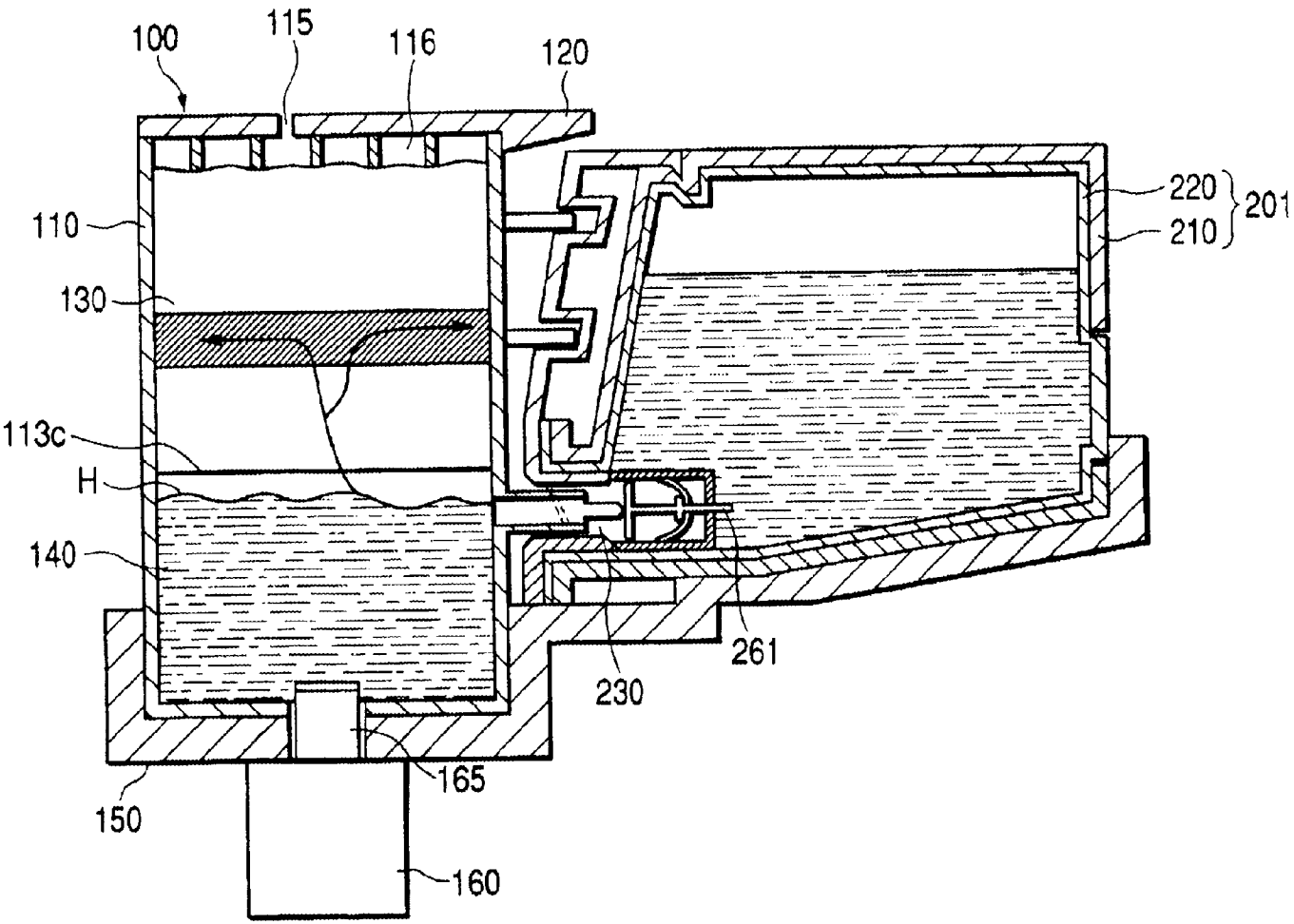
FIGS. 14A and 14B are figures explaining a difference between effects in presence and absence of the hydrophilically treated region shown in FIG. 13.
Figure 14B:
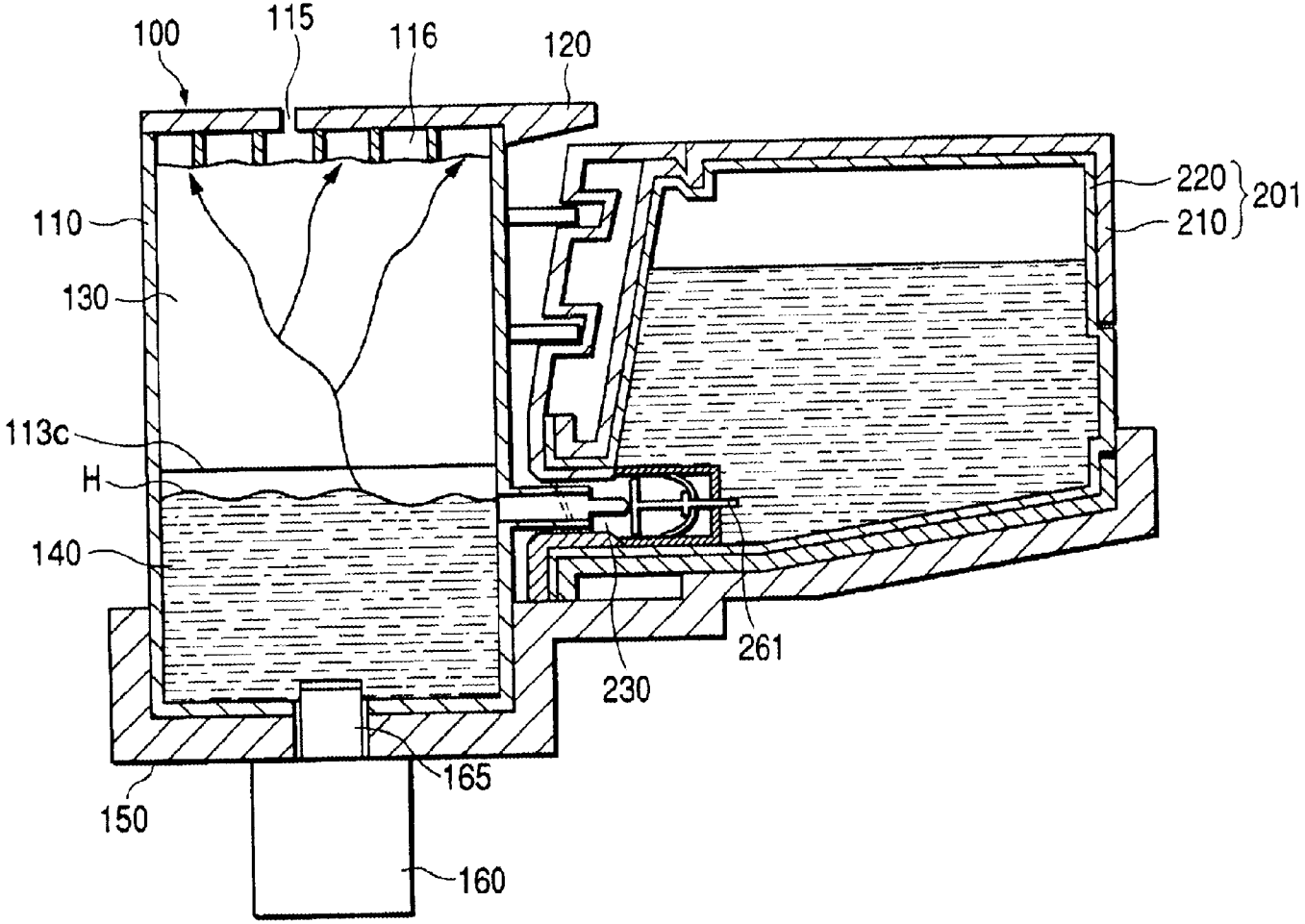

FIGS. 14A and 14B are figures explaining the difference between effects in presence (FIG. 14A) and absence (FIG. 14B) of the hydrophilically treated region like this example.

When ink and gas in the ink containing container 201 abruptly expand according to the environmental change, ink flows in the negative pressure regulating chamber container 110 to raise the liquid surface H. Here, as shown with the arrow in FIG. 14B, ink flows to a place, having a coarse density of fibers and a low resistance, of the absorbers 130 and 140. By this, an abrupt pressure rise in the container is eased. However, in order to express satisfactorily such pressure easing function (also buffer function), the conventional liquid containing container requires excessively large volume of the upper part of the negative pressure regulating chamber container. However, if the hydrophilically treated area like the present embodiment is prepared, the flow toward the upper part of the ink absorber according to abrupt pressure rise is captured in the hydrophilically treated area to disperse the pressure in the direction of crossing to the gravity direction as shown in the arrow in FIG. 14A. By this, the above described buffer function can be fully expressed without the excessively large volume of the upper part of the negative pressure regulating chamber container.

Such hydrophilically treated area may be prepared as a multistep structure along with the gravity direction. The present embodiment can be applied not only to the liquid containing container according to the third embodiment, but also to the ink supply openings of the liquid containing containers according to the second embodiment.

(Sixth Embodiment)

FIGS. 15A to 15E are figures explaining a hydrophilically treating method for the absorber in the liquid containing container according to the sixth embodiment of the present invention.

Figure 15A:
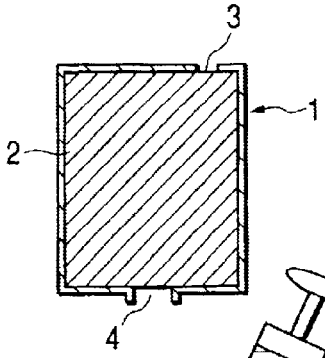
FIGS. 15A, 15B, 15C, 15D and 15E are figures explaining a hydrophilically treating method for the absorber in the liquid containing container according to a sixth embodiment of the present invention.
Figure 15B:
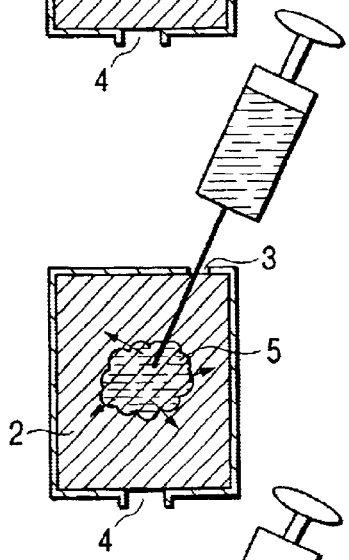
Figure 15C:
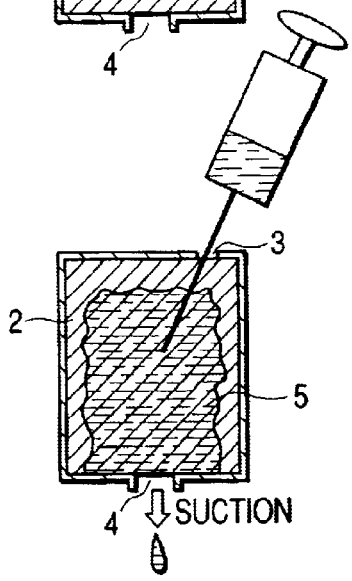
Figure 15D:
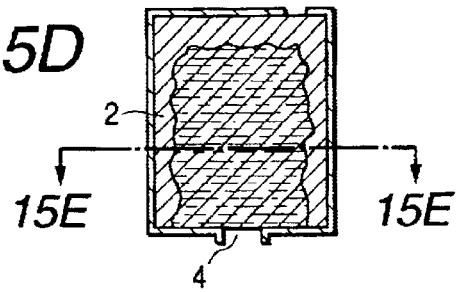

In the present embodiment, as shown in FIG. 15D, the PP fibrous body (indicated by the dot in the figure) 2 as the negative pressure creating member for the ink jet head to do recording by ejecting liquid is arranged in an entire inside thereof and is used for containing liquid, to supply to the ink jet head, held by the PP fibrous body 2. On a top end of a tank case, an atmosphere communication orifice 3 is installed. As the PP fibrous body 2, those, in which the surface of the PP fiber entangled has been hydrophilically treated, is used. Hydrophilic treated area, as shown with shadowing in the figure, contacts closely with the circumferential face of the orifice 4 of the container and separated from the internal surface of other parts of the container in a certain distance. The hydrophilically treated area by such manner is formed to prevent the following: in the case where there is a little space between the PP fibrous body and the inside surface of the tank, hydrophilic treatment has been applied to entire the PP fibrous body, transfer of ink is stopped between a liquid surface contacting with the inside surface of the tank and the PP fibrous body to allow leading air along with the inside surface of the tank and finally resulting in invasion of air from the ink supply opening.

Next, referring FIGS. 15A to 15E, the method for forming the above described hydrophilically treated area will be described below.

Figure 15E:
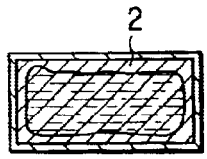

First, as shown in FIG. 15B, a needle of a syringe is inserted from the atmosphere communication orifice 3 in the PP fibrous body 2 to inject the hydrophilic treatment liquid 5 in a central part of the PP fibrous body 2. Then, as shown in FIG. 15C, the hydrophilic treatment liquid 5 is sucked from the ink supply opening 4 and the hydrophilic treatment liquid 5 is exhausted before the hydrophilic treatment liquid 5 reaches an inner side face of the tank 1. Subsequently, by drying the PP fibrous body 2, the liquid containing container with the shape shown in FIG. 15D is completed. FIG. 15E is the transverse sectional view along with an 15E—15E line of FIG. 15D.

Figure 38A:
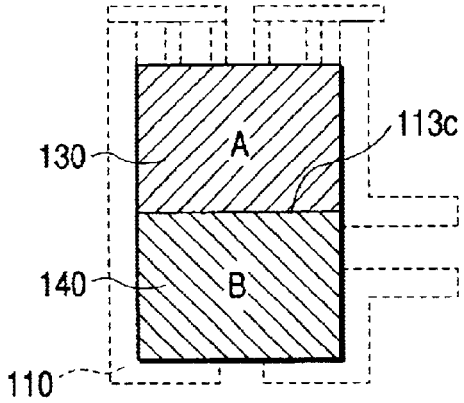
FIGS. 38A, 38B and 38C are figures showing an example of the hydrophilic treatment, applicable to the present invention, in a negative pressure creating member (the absorber) in the ink jet head cartridge.
Figure 38B:
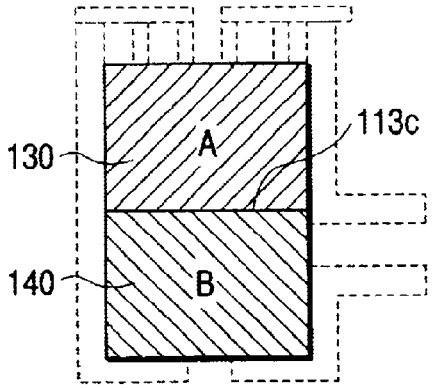
Figure 38C:
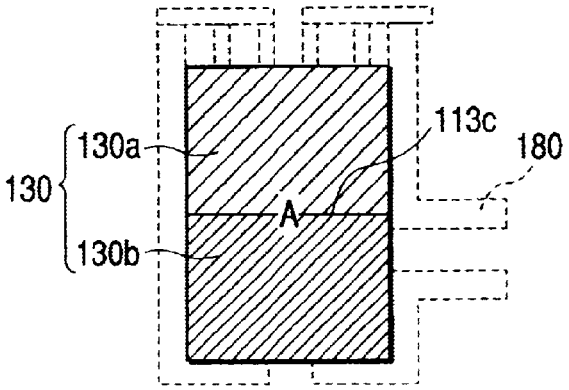

In the ink jet head cartridge described referring the third embodiment, embodiments shown in FIGS. 38A to 38C can be used.

FIG. 38B is the embodiment in which the entire area of the top absorber 130 and the bottom absorber 140 is assigned to the hydrophilically treated area in the polyolefin fibrous body being the ink absorber as the negative pressure creating member and FIG. 38A is the embodiment in which the entire area of the bottom absorber 140 only is assigned to the hydrophilically treated area. In either embodiment, the boundary face 113*c* of the absorbers 130 and 140 is located around the top of the joint pipe 180 in the attitude in use.

FIG. 38C is the embodiment in which a single absorber 130 only housed in the negative pressure regulating chamber container 110 and the entire bottom area is subjected to the hydrophilically treated area with almost horizontal interface 113*c*. The interface 113*c* between untreated and treated areas for hydrophilic treatment is located around the top of the joint pipe 180 in the attitude in use.

The FIGS. 38A, 38B, and 38C are those freely replaceable to the negative pressure creating member housing chamber (part) in the above described embodiment. In FIG. 38A, in viewing the absorbers 130 and 140 made from fibers as fibrous bodies, the absorber 140 is the ink supply opening side and the absorber 130 is the atmosphere communicating orifice side. And, it can be presumed that the partial hydrophilic treatment is applied to entire absorber 140.

In any of FIGS. 38A, 38B, and 38C, for the action of the polyolefin fibrous body to water in a contact angle of 80° or larger, the hydrophilically treated area is located in the supply opening side and thus, aqueous ink holdability and a negative pressure-creating liquid level can be equalized to a same level in at least the absorber 140. Therefore, stabilizing the negative pressure can be realized. Similarly, in the case where hydrophilic treatment is carried out using the above described treatment liquid, keeping an excellent suppliability by reduction of the flow resistance cause by the hydrophilic group, in interruption or stop of an ink jet record, the liquid surface level is easily made horizontal and holding performance and distribution of ink are make even and therefore, the stable negative pressure can be instantaneously ensured.

Particularly in FIG. 38C, the fibrous body can be prepared as a single member and thus, it is cost low in comparison with the case using two members; the same action as the above described action by the interface between two members is not yielded, but the effect can be yielded by the boundary between hydrophilic and hydrophobic areas.

In FIG. 38B in which the absorber 130 is also hydrophilically treated, a cause itself of ink leaking can be fundamentally solved by applying interface effect between the absorbers 130 and 140 and by a satisfactory liquid-absorbing effect even in any change of pressure.

In any FIGS. 38A to 38C, a face to receive ink supplied from the joint pipe 180 is hydrophilically treated and hence, not only ink to be supplied, but also ink from a container, removable from the pipe 180, filled with ink can assuredly absorbed. In addition, all related to gas-liquid exchange and the fiber orientation described above are naturally applied to any one of FIGS. 38A to 38C.

Figure 8:
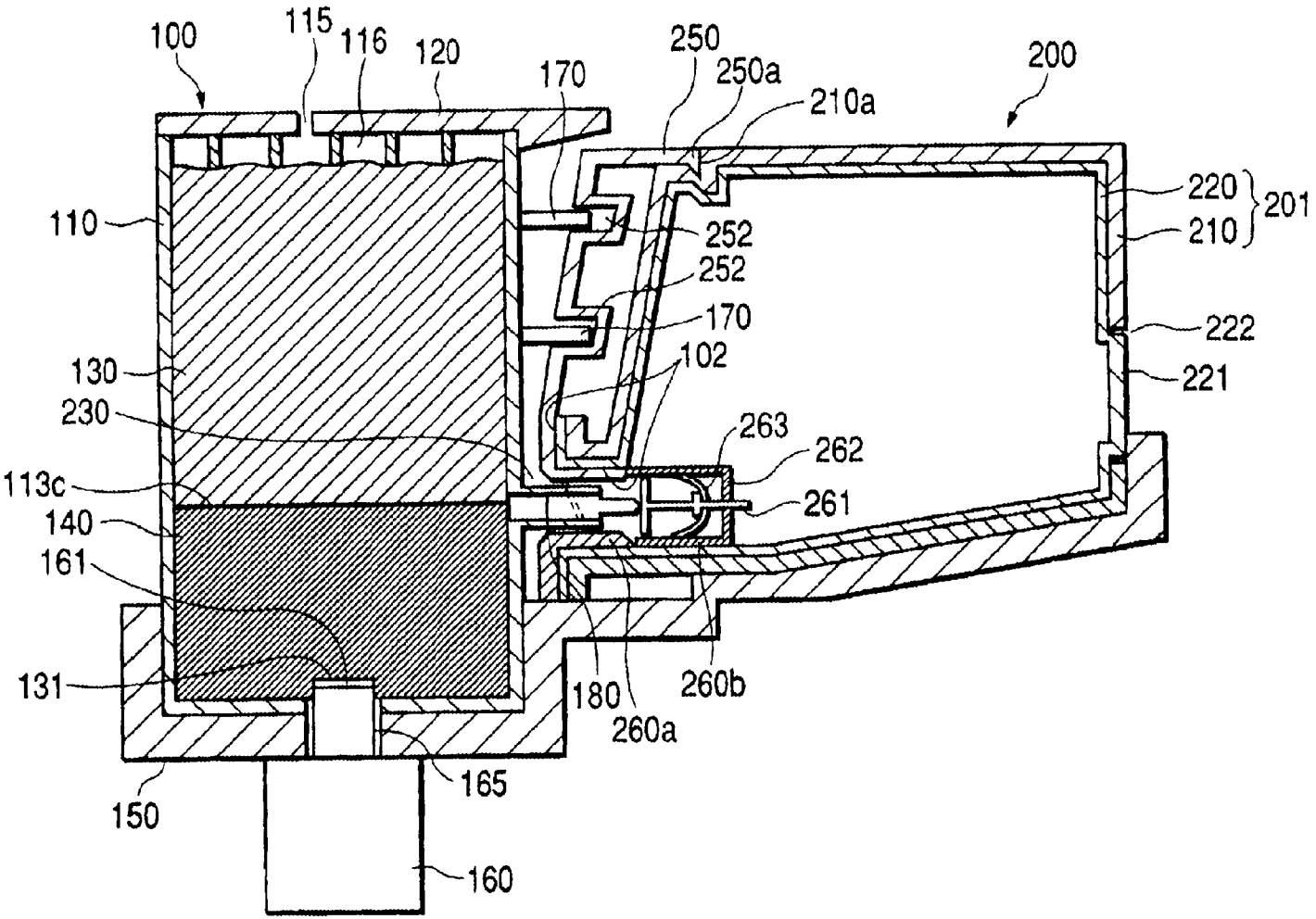
FIG. 8 is a figure showing an example of a hydrophilically treated region in a negative pressure creating member (absorber) in an ink jet head cartridge, which is the liquid containing container according to a third embodiment of the present invention.

In comparison with the embodiment explained suing FIG. 8, the embodiment of FIGS. 38A to 38C is that containing not only provide the effect of the embodiment of FIG. 8, but also all effects caused by the partial hydrophilic treatment according to the present invention.

In the above described embodiment, explanation was done using the example in which the joint pipe is installed in the negative pressure creating member housing chamber. However, Even in the constitution in which the joint pipe has not been installed in the negative pressure creating member housing chamber, the ink leading orifice is pressed to inside the negative pressure creating member housing chamber to press the negative pressure creating member, respective parts can express effects described above, respectively.

(On a gradation treatment in hydrophilic treatment)

By the way, to the present invention, the constitution, in which the density of hydrophilically treated part is changed according to the position for the fibrous absorber, can be applied. The method for such treatment will be described below with reference to some examples.

Figure 41A:
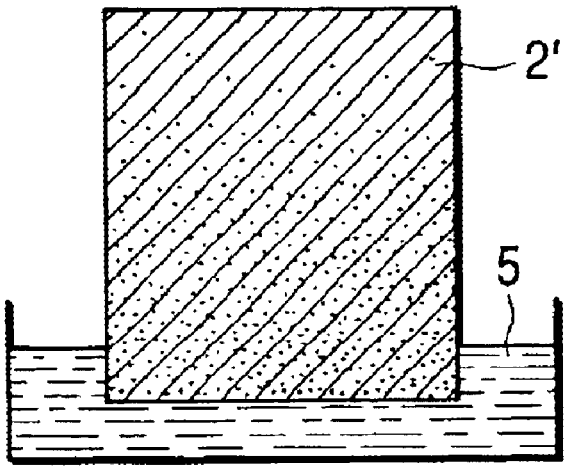
FIGS. 41A and 41B are figures explaining an example of the hydrophilic treatment method for the fiber absorber shown in FIG. 39.

First, the first method will be explained with reference to FIGS. 41A and 41B. By the first method, as shown in FIG. 41A, only a part of the untreated fibrous absorber 2' is soaked in the above described hydrophilic treatment liquid 5. By this treatment, in the part soaked in the treatment liquid 5, the treatment liquid 5 attaches to whole surface of fibers of the fibrous body 2'. However, in the part not soaked in the treatment liquid 5, the treatment liquid 5 is elevated by the capillary force between fibers and hence, caused by a variability of space magnitude between fibers, according to increase in the height from the liquid surface of the treatment liquid 5, a proportion of the part, to which the treatment liquid 5 attaches, becomes small.

Figure 41B:
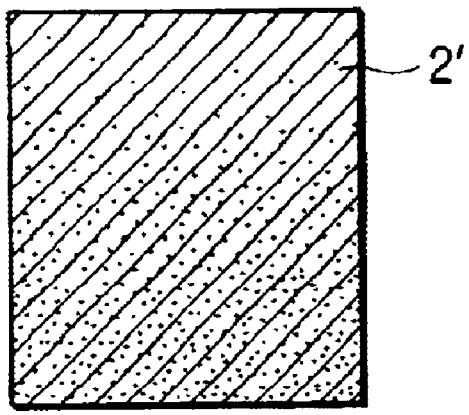

In this status, the fibrous absorber 2' is picked up from the treatment liquid 5 to pass through the above described drying step after application of hydrophilic treatment liquid 5, as shown in FIG. 41B, the fibrous absorber 2, of which density of a part hydrophilically treated gradually decreased from the bottom end toward the top end, is yielded.

Next, the second method will be explained with reference to FIGS. 42A to 42C. In the second method, first, as shown in FIG. 42A, the fibrous absorber 2", in which the hydrophilic treatment liquid is impregnated evenly in whole parts, is prepared.

Figure 42A:
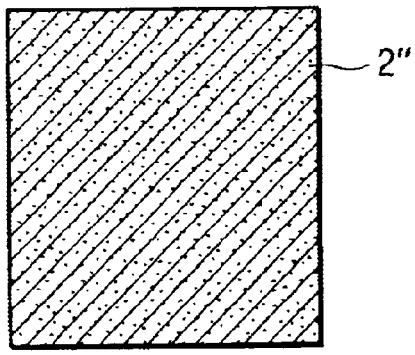
FIGS. 42A, 42B and 42C are figures explaining another example of the hydrophilic treatment method for the fiber absorber shown in FIG. 39.
Figure 42B:
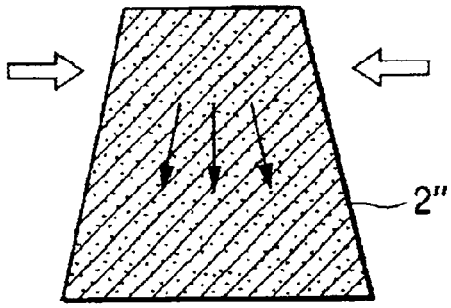

Subsequently, as shown in FIG. 42B, a part of the fibrous absorber 2" (in he present example, the top end) is compressed. By this treatment, the hydrophilic treatment liquid in the part compressed moves to the part not compressed in accordance with that spaces between fibers of the fibrous absorber 2" becomes small. In the present example, the hydrophilic treatment liquid moves from the top end side toward the bottom end side of the fibrous absorber 2".

Figure 42C:
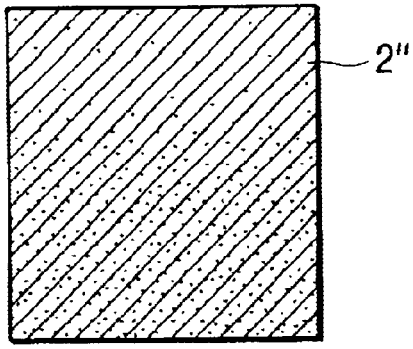

Next, as shown in FIG. 42C, compression to the fibrous absorber 2" is released. By this step, the part compressed recovers shape thereof by recovering force of the fibrous absorber 2". However, by the capillary force created by in recovery of the fibrous absorber 2", the hydrophilic treatment liquid attached to the surface of fibers of the part compressed is dispersed. As the result, the part compressed becomes the status in which the hydrophilic treatment liquid dispersed to attach to make attaching density of the hydrophilic treatment liquid small as the degree of compression as high. In other words, density of the part, to which the hydrophilic treatment liquid attaches, of the fibrous absorber 2" gradually increase from the part compressed toward the part uncompressed.

Notification should be made herewith as that amount of the hydrophilic treatment liquid impregnated in the fibrous absorber 2" in the status, shown in FIG. 42A, is the amount for which, in recovery of the fibrous absorber 2", the hydrophilic treatment liquid moved to the part uncompressed does not return to the part compressed again.

Finally, by operating the above described drying step after application of hydrophilic treatment liquid for such fibrous absorber 2", the fibrous absorber, of which hydrophilicity reduced gradually from the part compressed toward the part uncompressed, is yielded.

Figure 43:
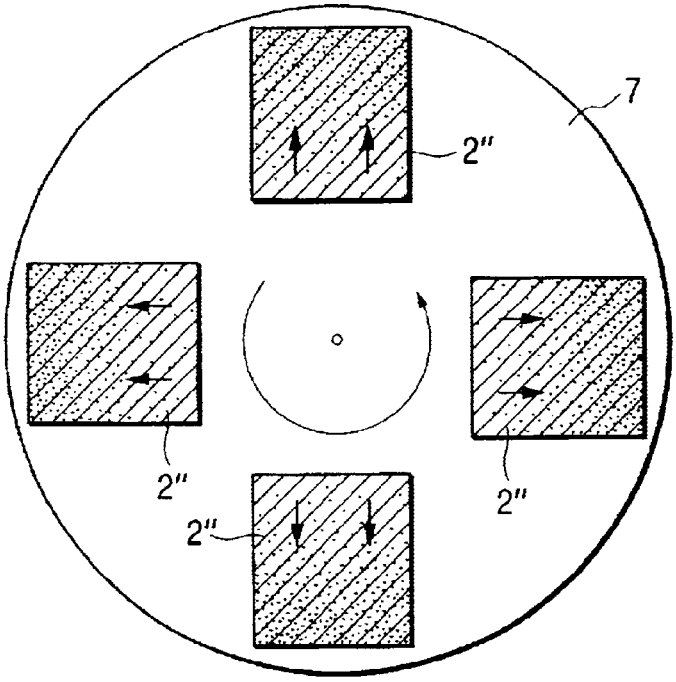
FIG. 43 is a figure explaining a further example of the hydrophilic treatment method for the fiber absorber shown in FIG. 39.

Next, the third method will be described with reference to FIG. 43. In the third method, the fibrous absorber 2", in which the hydrophilic treatment liquid is impregnated evenly in whole parts, is first prepared as similar as to the second method. Subsequently, the fibrous absorber 2" is mounted on an adjacent part of a rotating disc 7 to rotate the rotating disc 7. By this operation, the hydrophilic treatment liquid contained in the fibrous absorber 2" moves to outside of the rotating disc 7 by centrifugal force. In the inside, density of the part, to which the hydrophilic treatment liquid attaches, decreases. Then, density of the part, to which the hydrophilic treatment liquid attaches, increases from the inside to the outside of the rotating disc 7. Here, also in the innermost side of the fibrous absorber 2", to leave the hydrophilic treatment liquid, a rotation of the rotating disc 7 is preferably adjusted to around from 60 rpm to 300 rpm (1 $s^{-1}$ to 5 $s^{-1}$). In addition, for efficient treatment, as shown in FIG. 43, it is preferable that a plurality of the fibrous absorber 2" is mounted on the rotating disc 7 to carry out simultaneous treatment of a plurality of the fibrous absorber 2".

Subsequently, the fibrous absorber 2" is removed from the rotating disc 7 to be subjected to the above described drying step after application of hydrophilic treatment liquid and then, the fibrous absorber, of which hydrophilicity gradually reduces from one end to the other end, can be yielded.

Figure 44A:
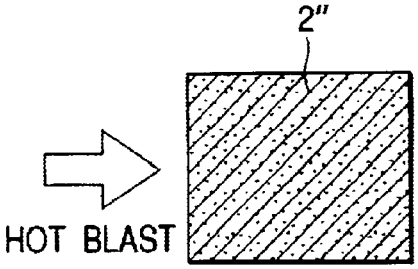
FIGS. 44A and 44B are figures explaining a furthermore example of the hydrophilic treatment method for the fiber absorber shown in FIG. 39.
Figure 44B:
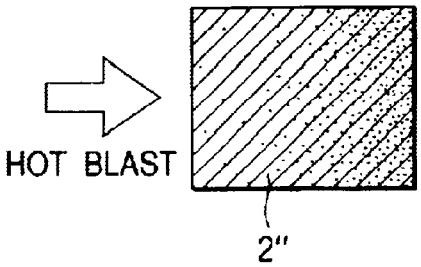

Next, the fourth method will be described with reference to FIGS. 44A and 44B. In the fourth method, the fibrous absorber 2", in which the hydrophilic treatment liquid is impregnated evenly in whole parts, is prepared as similar as to the second method. Subsequently, in the above described drying step after application of hydrophilic treatment liquid, hot blast is blown from one end of the fibrous absorber 2". In this operation, in an initial stage, strong hot blast is blown to move hydrophilic treatment liquid in the fibrous absorber 2" to the other end. Also in this operation, similar to the third method, strength of blast wind is regulated to leave hydrophilic treatment liquid also in the other end of the fibrous absorber 2". Then, when hydrophilic treatment liquid has been moved, the strength of blast wind is adjusted to strength, by which hydrophilic treatment liquid does not move, to dry hydrophilic treatment liquid contained in the fibrous absorber 2". By this, the fibrous absorber, of which hydrophilicity reduces gradually from the other end to the one end, is yielded.

Meanwhile, according to arrangement of the shape of the ink tank and the arrangement of the supply opening, there is the case where the above described method cannot deal with. For example, as shown in FIG. 45, in the case where the tank case 21 to house the fibrous absorber 24 has a transversely long cubic shape and the supply opening 22 is opened in the end part of the bottom face of the tank case 21, the above described method results in that hydrophilic treatment is not carried out, in spite of that a right bottom end part in the status shown in FIG. 45 is far from the supply opening 22, hydrophilic treatment is not carried out or density of the part to be hydrophilically treated becomes lower.

Such case can be solved by applying the method described for FIGS. 41A and 41B. First, as shown in FIG. 46A, the one end of the untreated fibrous absorber 24' is soaked in hydrophilic treatment liquid 25. Next, the fibrous absorber 24' is picked up from hydrophilic treatment liquid 25 and as shown in FIG. 46B, the fibrous absorber 24' is rotated 90° to soak the fibrous absorber 24' again in hydrophilic treatment liquid 25 as shown in FIG. 46C. And, for the fibrous absorber 24', the above described drying step after application of hydrophilic treatment liquid is carried out and hence, as shown in FIG. 45, the fibrous absorber 24 can be yielded to reduce gradually hydrophilicity from a region A to the region E, specifically, to make hydrophilicity around two mutually adjacent faces located in the position far from the supply opening strongest and gradually weaker according to increase in the distance from there.

Figure 45:
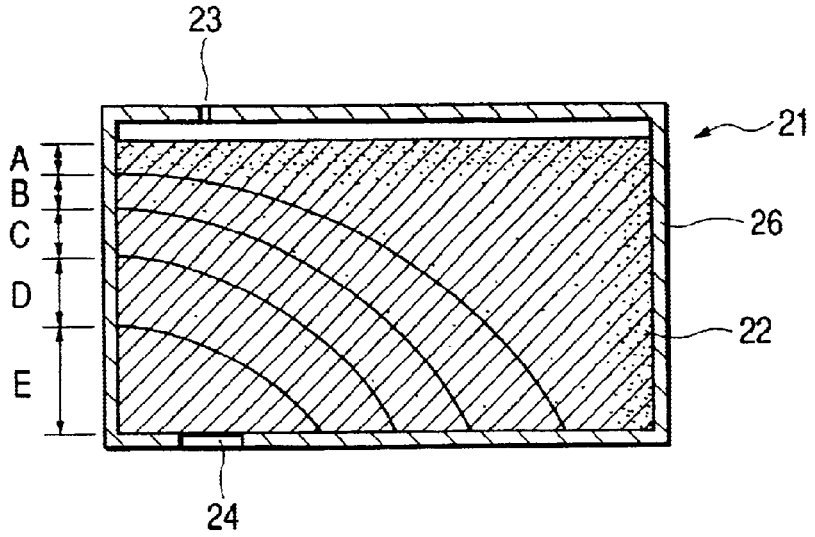
FIG. 45 is a longitudinal section view of an example of modification of the ink tank according to a seventh embodiment of the present invention.
Figure 46A:
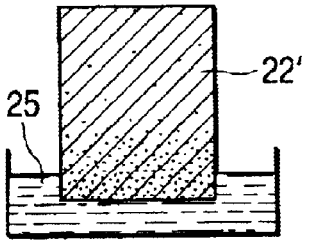
FIGS. 46A, 46B and 46C are figures explaining an example of the hydrophilic treatment method for the fiber absorber shown in FIG. 45.
Figure 46B:
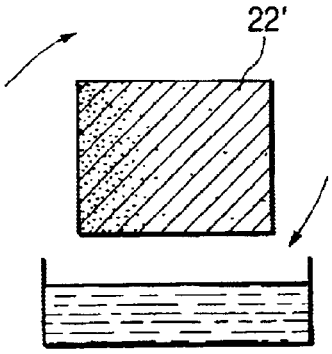
Figure 46C:
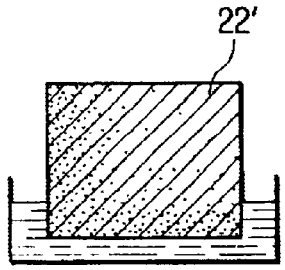

In case of a transversely long ink tank 20 shown in FIG. 45, particularly in the internal bottom face of the ink tank, a space between the tank case 21 and the fibrous absorber 24 may cause to that ink in the space in the region E moves to the region A to separate from the supply opening 22. Thus, for prevention of such phenomenon, no space between the tank case 21 and the fibrous absorber 24 is preferable.

(Seventh Embodiment)

Figure 39:
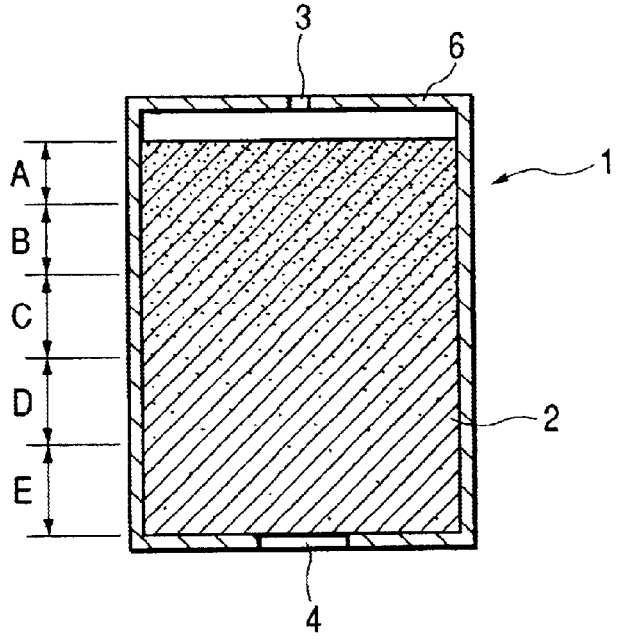
FIG. 39 is a longitudinal section view of the ink tank according to a seventh embodiment of the present invention.

FIG. 39 is the longitudinal section view of the ink tank according to the seventh embodiment of the present invention.

The ink tank 1 according to the present invention comprises the tank case 6 having the supply opening 4 to supply ink (including liquid such as waterproof reinforced liquid to apply waterproof treatment to a recording medium before ink ejection) to the recording head to record by ejecting ink from the ejecting orifice and the fibrous absorber 2, housed in the tank case 6, to hold ink under the negative pressure. The tank case 6 has the atmosphere communication orifice 3 to communicate the fibrous absorber 2 housed inside with external atmosphere.

The fibrous absorber 2 is composed of a bundle of fibers prepared in the status in which PP (polypropylene) fibers and PE (polyethylene) fibers are intermingled and the fiber orientation of those intermingled fibers is almost arranged. Length of individual fibers composing the fibrous absorber 2 is about 60 mm. The fibers, as shown in FIGS. 26A and 26B, shows the sectional shape almost concentric and formed making PE having a relatively low melting point to the sheath material 83*a* and PP having a relatively high melting point to the core material 83*b*. The fibrous absorber 2 of the present invention is fabricated by arranging fiber orientation of the fiber block made from short fibers by using the carding machine followed by heating to cut in a desired length. A heating temperature is, preferably, the temperature higher than the melting point of PE and lower than the melting point of PP.

As shown in FIG. 25A, respective fibers are oriented to the length direction (F1) by using the carding machine. The direction orthogonally crossing direction (F2) thereto has a structure having a connection by fusion of part of the contact point (intersection point) of every fiber by heating. Therefore, the fibrous absorber 2 is difficult to break by applying a tensile force in the F1 direction shown in FIG. 25A. However, in comparison with the case of F1 direction, when stretched in the F2 direction, fibers are easy to separate by break of the connecting point of fibers.

When the crimped short fiber as show in FIG. 25B is heated in the condition of oriented arrangement of fibers, the status as shown in FIG. 25C is yielded. Here, the region $\alpha$, in which a plurality of fibers stacked in the direction of fibers in FIG. 25B, is fused in the intersection point as shown in FIG. 25C. As the result, fibers becomes difficult to cut in the direction of F1 shown in FIG. 25A. In addition, by using the crimped short fiber, a terminal part region ($\beta$, $\gamma$ indicated in FIG. 25B) of the short fiber is, as shown in FIG. 25C, fused with other short fibers three-dimensionally ($\beta$) and left as the terminal part as it is ($\gamma$). In addition, all fibers are not always arranged in the same direction and hence, short fibers originally contacting, obliquely crossing, with other short fibers ($\epsilon$, shown in FIG. 25B) are fused as they are after heating ($\epsilon$, shown in FIG. 25C). Through these processes, also along with the F2 direction, in comparison with the conventional one direction fiber bundle, fibers with higher strength is prepared.

In the fibrous absorber made of one direction fiber bundle, capillary force occurs by the space between fibers. However, in the fibrous absorber 2 according to the present embodiment, there is such main fiber direction and thus, between main fiber direction (F1) and the fiber direction (F1) orthogonally crossing fiber direction (F2), fluidity of and holding manner in a still condition of ink become different.

In the present embodiment, such fibrous absorber 2 is arranged to make the main fiber direction (F1) substantially vertical to the perpendicular direction. Therefore, the gas-liquid interface (boundary between gas and liquid) in the fibrous absorber 2 becomes substantially parallel to the direction of the main fiber direction (F1). In the case where the change is caused by the environmental change, the gas-liquid interface keeps an almost horizontal direction (substantially vertical direction to perpendicular direction) and thus, the gas-liquid interface recovers the original position after the environmental change ceases. Consequently, as conventional, according to a cyclic number of the environmental change, variation of the gas-liquid interface to the perpendicular direction does not increase. By such determination of the main fiber direction of the fibrous absorber 2, variation of the gas-liquid interface in the gravity direction can be prevented.

Here, the direction of fiber orientation, even if inclining somewhat from the perpendicular direction, yields the above described effect even slightly, theoretically. Practically, when it is in a range of about ±30° of the horizontal plane, the evident effect is confirmed. Therefore, the expression "substantially vertical to perpendicular direction" or "almost horizontal" is defined as includes the above described inclination in the present specification.

The structure of the fibrous absorber 2 is as described above. In addition, the fibrous absorber 2 has been entirely hydrophilically treated. Particularly in the present embodiment, hydrophilic treatment is not evenly carried out for whole of the fibrous absorber 2, but as shown in FIG. 39 diagrammatically, hydrophilic treatment is carried out to be adapted to that the density of the area hydrophilically treated is lowest around the supply opening 4 and becomes higher gradually according to increase of the distance from the supply opening 4.

Now, in FIG. 39, when according to the distance from the supply opening 4, the fibrous absorber 2 is divided in 5 regions of A to E, the region A shows the strongest hydrophilic property and regions B to E and a region more distant from the supply opening 4 show the gradually decreased hydrophilic property. Particularly in the region A, for substantially all the parts of fibers, hydrophilic treatment is conducted. In other words, in the present embodiment, the region A is the first hydrophilic treatment region in the present invention and the regions B to E are the second hydrophilic treatment region in the present invention.

The ink flow resistance in these respective regions A to E will be discussed below.

Figure 40A:
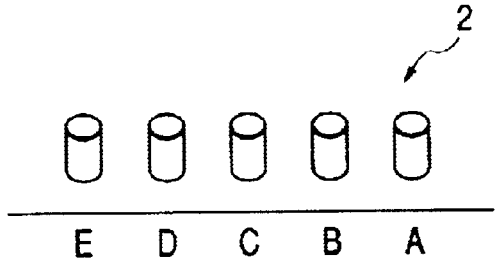
FIGS. 40A and 40B are diagrammatic figures showing an ink path, from respective region A to E to a supply opening, as a tube in order to explain a flow resistance of ink in the fiber absorber in the ink tank shown in the FIG. 39 show a static view and a dynamic view, respectively.

If hydrophilicity of the fibrous absorber 2 is equal among respective regions A to E, smoothness of ink flowing in respective regions A to E is same and thus, as diagrammatically shown in FIG. 40A, in the case where the ink low resistance is analyzed dynamically, the ink path corresponds to a pipe, having an equal diameter, in proportion to a length from respective regions A to E to the supply opening 4. In other words, when hydrophilicity of the fibrous absorber 2 is equal among respective regions A to E, according to the distance from the supply opening 4, the ink low resistance increases to make ink supply to the supply opening 4 difficult.

Figure 40B:
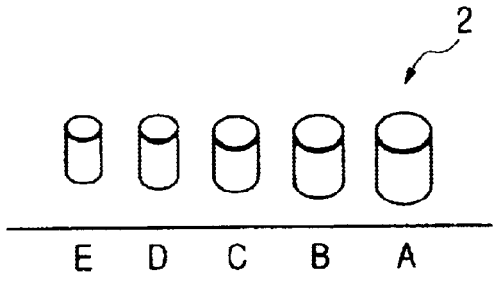

Then, similar to the present embodiment, when hydrophilicity of the fibrous absorber 2 is decreased around the supply opening 4 and increased according to the distance from the supply opening 4, as diagrammatically shown in FIG. 40B, the ink path from respective regions A to E to the supply opening 4 becomes easy to flow ink in accordance with the distance from the supply opening 4 and therefore, corresponds to the pipe increasing diameter thereof in accordance with the distance from the supply opening 4. As the result, difficulty of movement of ink in a far position from the supply opening 4 is eased and even ink in a far position from the supply opening 4 can be flow easily to the supply opening 4.

By this, it is realized that ink in a far position from the supply opening 4 does not move and does not leave in place and hence, ink contained in the ink tank 1 can be efficiently used. As described above, in the ink tank 1 according to the present embodiment, ink movability in the fibrous absorber 2 is improved and therefore, such ink having a high viscosity as pigment ink can be used and can be preferably applied to the recording apparatus necessary of high speed ink supply from the supply opening 4, similar to the recording apparatus of a high recording speed.

In the present embodiment, the atmosphere communication orifice 3 is formed on the opposite face to the face, in which the supply opening 4 of the tank case 6 is opened and thus, the part with the highest hydrophilic property of the fibrous absorber 2 is located in the atmosphere communication orifice 3 side. Therefore, in injection of ink into the tank case 6 in manufacture of the ink tank 1, when ink is injected from the atmosphere communication orifice 3, ink is actively absorbed by the fibrous absorber 2 and hence, without reduction of the pressure of inside of the tank, ink can be constantly injected in.

(Eighth Embodiment)

Figure 47:
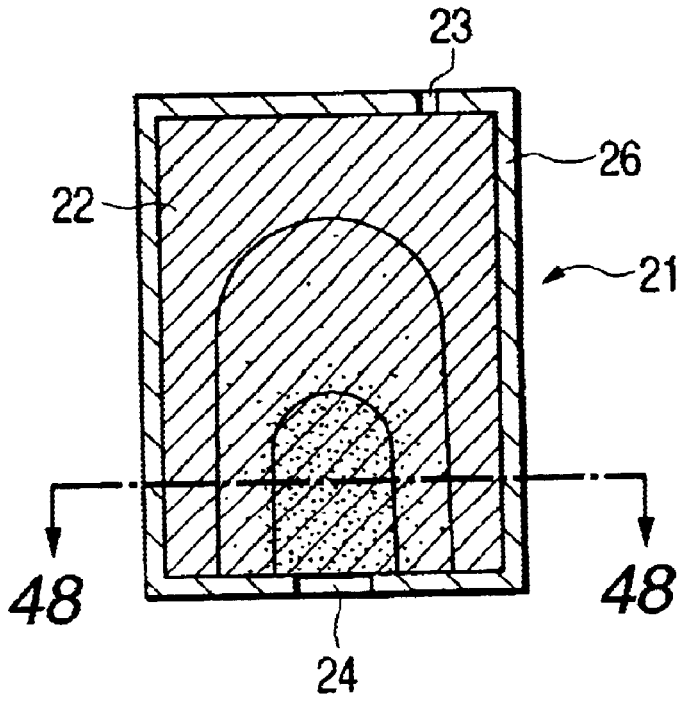
FIG. 47 is a longitudinal section view of the ink tank according to a eighth embodiment of the present invention.
Figure 48:
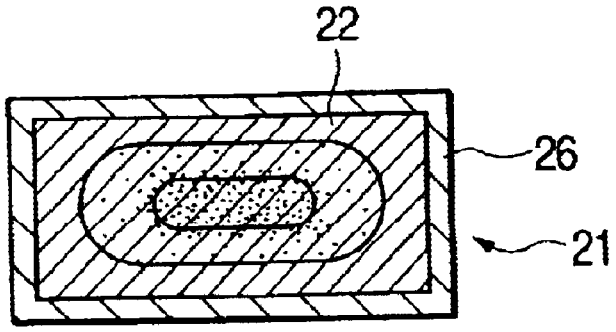
FIG. 48 is a transverse section view (sectional view along with a 48—48 line of FIG. 47) of the ink tank according to a eighth embodiment of the present invention.

FIG. 47 is the longitudinal section view of the ink tank according to the eighth embodiment of the present invention and FIG. 48 is the sectional view (the transverse section view) along with the 48—48 line of the ink tank shown in FIG. 47.

The ink tank 21 of the present embodiment also, similar to the seventh embodiment, has the tank case 26 having the atmosphere communication orifice 23 and the supply opening 24 and the fibrous absorber 22 housed in the tank case 26. The fibrous absorber 22, similar to the seventh embodiment, is constituted by the fiber bundle of which status has the direction of almost arranged fibers of blended PP and PE fibers. The surface of fibers constituting the fibrous absorber 22 has been hydrophilically treated.

Difference between the seventh embodiment and the present embodiment is as follows. In the present embodiment, in order to realize that hydrophilic property of the fibrous absorber 22 becomes strong in the position around the supply opening 24 and become weak in the position far from there, the hydrophilically treated part prepared by the hydrophilic treatment for the fibrous absorber 22 is located at least around the supply opening 24. The hydrophilic treatment need not to apply to the entire fibrous absorber 22 and the hydrophilic treatment may not be applied to the position far from the supply opening 24. In FIGS. 49 and 50A to 50C, approximate boundary between the first region and the second region and boundary between the second region and the region not hydrophilically treated are indicated with solid lines. However, these are diagrammatically shown and have not clear boundaries like these.

As a rule, around the supply opening 24, in order to prevent exhaust of ink for a recording head (not illustrated), the constitution is adapted to hold ink always. For this purpose, conventionally, the following constitution was employed: the pressure contacting body of which the capillary force has been increased is installed in the supply opening 24 and the negative pressure creating member is compressed around the supply opening 24 to increase the capillary force. However, the constitution to increase the capillary force by such manner causes increase in the ink flow resistance and thus, may cause a disturbance for high speed recording in the future requiring a large flow ink supply. Then, as the present embodiment, by increasing the hydrophilic property around the supply opening 24 than other parts, the ink flow resistance around the supply opening 24 is not increased, but ink is actively held.

On the other hand, preventing ink leak from the recording head, in order to realize a good supply of ink from the ink tank 21 to the recording head, the internal pressure of the ink tank 21 requires to keep a suitable negative pressure. Here, with reference to FIG. 49, a relation of the internal pressure of the ink tank 21 with the leading amount of ink from the supply opening 24 will be discussed below. The negative pressure mentioned herewith means a total negative pressure summed from the static negative pressure and the dynamic negative pressure.

Figure 49:
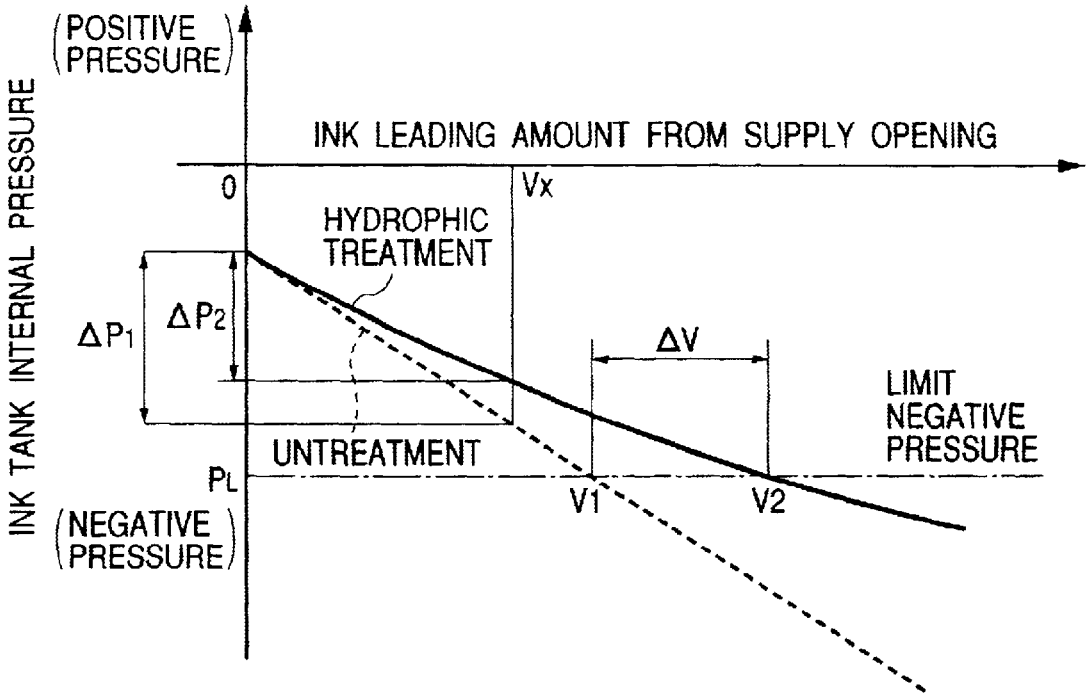
FIG. 49 is a graph showing a relation between an internal pressure of the ink tank with an ink leading amount from the supply opening of the ink tank according to a eighth embodiment of the present invention, in comparison with the case where the hydrophilic treatment is not carried out.

FIG. 49 is the graph showing a relation between the internal pressure of the ink tank with an ink leading amount for the ink tank, in which the fibrous absorber hydrophilically treated to make the hydrophilic property highest around the supply opening and also to decrease gradually the hydrophilic property according to the distance from the supply opening, is housed and the ink tank, in which the fibrous absorber is not hydrophilically treated, is housed As shown in FIG. 49, that not hydrophilically treated, as shown with the broken line, the internal pressure of the ink tank reduces in approximately linearly according to leading of ink. However, that hydrophilically treated, as shown with the solid line, in comparison with that untreated, the rate of change, namely, the rate of reduction, of the internal pressure decreases according to increase in the ink leading volume. This is because that hydrophilically treated allows easy movement of ink according to the distance of an ink level in the ink tank from the supply opening in accordance with leading of ink to cause decrease in the dynamic negative pressure in comparison with that untreated.

On the basis of the above description, by carrying out the hydrophilic treatment for the fibrous absorber to increase in the hydrophilic property in the position around the supply opening and decrease according to the distance from the supply opening, change of the negative pressure in the ink tank according to leading of ink from the supply opening can be suppressed. This has the following advantages. As shown in FIG. 49, a limit negative pressure under which ink is not supplied from the ink tank to the recording head is assumed as $P_L$, the ink leading volume to reach the limit negative pressure $P_L$ is V1 in untreated case and V2 in treated case. Therefore, that hydrophilically treated can use ink contained in the ink tank for a volume of the difference expressed by $V2-V1=\Delta V$. In other words, by the hydrophilic treatment conducted in the present embodiment, efficiency of use of ink in the ink tank is improved and furthermore, a running cost can be reduced. In addition, an arbitrary ink leading volume is assumed as Vx, the volume of the negative pressure changed from the initial value of the negative pressure to the value, when ink of Vx is led, is $\Delta P_1$ for the untreated case and $P_2$ for the treated case. As described herewith, the volume of the negative pressure changed by leading ink from beginning of ink use to exhaust of ink can be suppressed and hence, stable printing not depending on the ink leading volume can be realized.

In the present embodiment, the hydrophilic property is highest around the supply opening 24. Therefore, in injecting ink in manufacture of the ink tank 30, injection of ink from the supply opening 24 allows active absorption of ink to the fibrous absorber 22 and hence, no reduction of inside of the ink tank 30 allows stable ink injection.

Next, steps of the hydrophilic treatment of the fibrous absorber 22 in the present embodiment will be explained wither reference to FIGS. 50A to 50C.

Figure 50A:
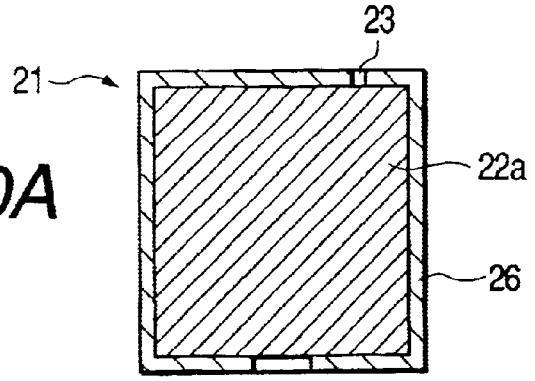
FIGS. 50A, 50B and 50C are figures explaining an example of the hydrophilic treatment method for the fiber absorber of the ink tank shown in FIG. 47.

First, as shown in FIG. 50A, the ink tank 21, in which the untreated fibrous absorber 22*a* is housed in the tank case 26, is prepared.

Figure 50B:
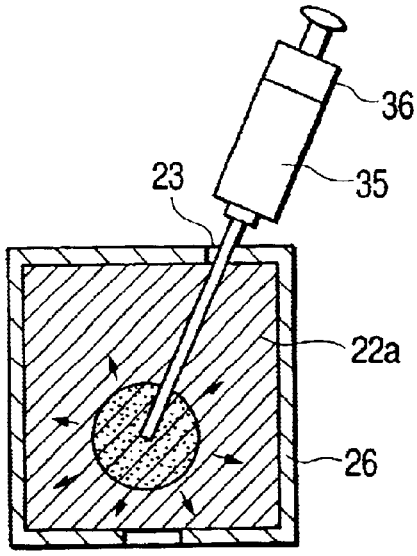

Next, as shown in FIG. 50B, the syringe 36 holding the hydrophilic treatment liquid 25 described in the eighth embodiment is inserted from the atmosphere communication orifice 23 of the ink tank 21 and, by the syringe 36, the hydrophilic treatment liquid 25 is injected in the untreated fibrous absorber 22*a*. By this operation, the hydrophilic treatment liquid 25 extends radially to inside of the fibrous absorber 22*a*.

Figure 50C:
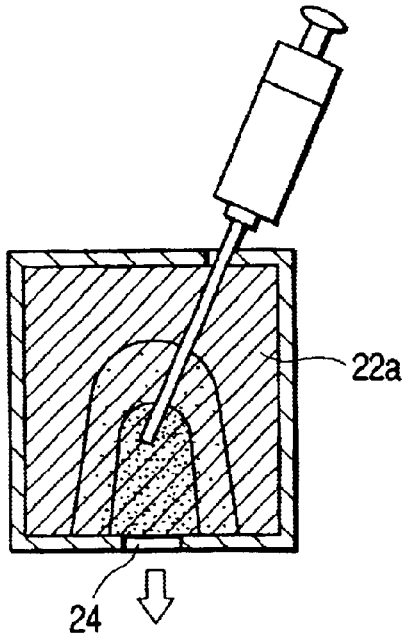

Simultaneously to injection of the hydrophilic treatment liquid 25 or in the point in which the hydrophilic treatment liquid 25 has extended in a certain area, as shown in FIG. 50C, the hydrophilic treatment liquid 25 is forcedly drawn from the supply opening 24 of the tank case 26. By this operation, the hydrophilic treatment liquid 25 is drawn in the supply opening 24 side to make content of the hydrophilic treatment liquid 25 in the fibrous absorber 22 highest in the region between the tip of the syringe 36 and the supply opening 24 and also make it small in accordance with the distance from the region.

Finally, similar to the eighth embodiment, through the drying step after application of hydrophilic treatment liquid, the ink tank 21 shown in FIGS. 47 and 48 is obtained for the fibrous absorber 22 in which hydrophilic treatment liquid 25 is impregnated.

(Ninth Embodiment)

Figure 51:
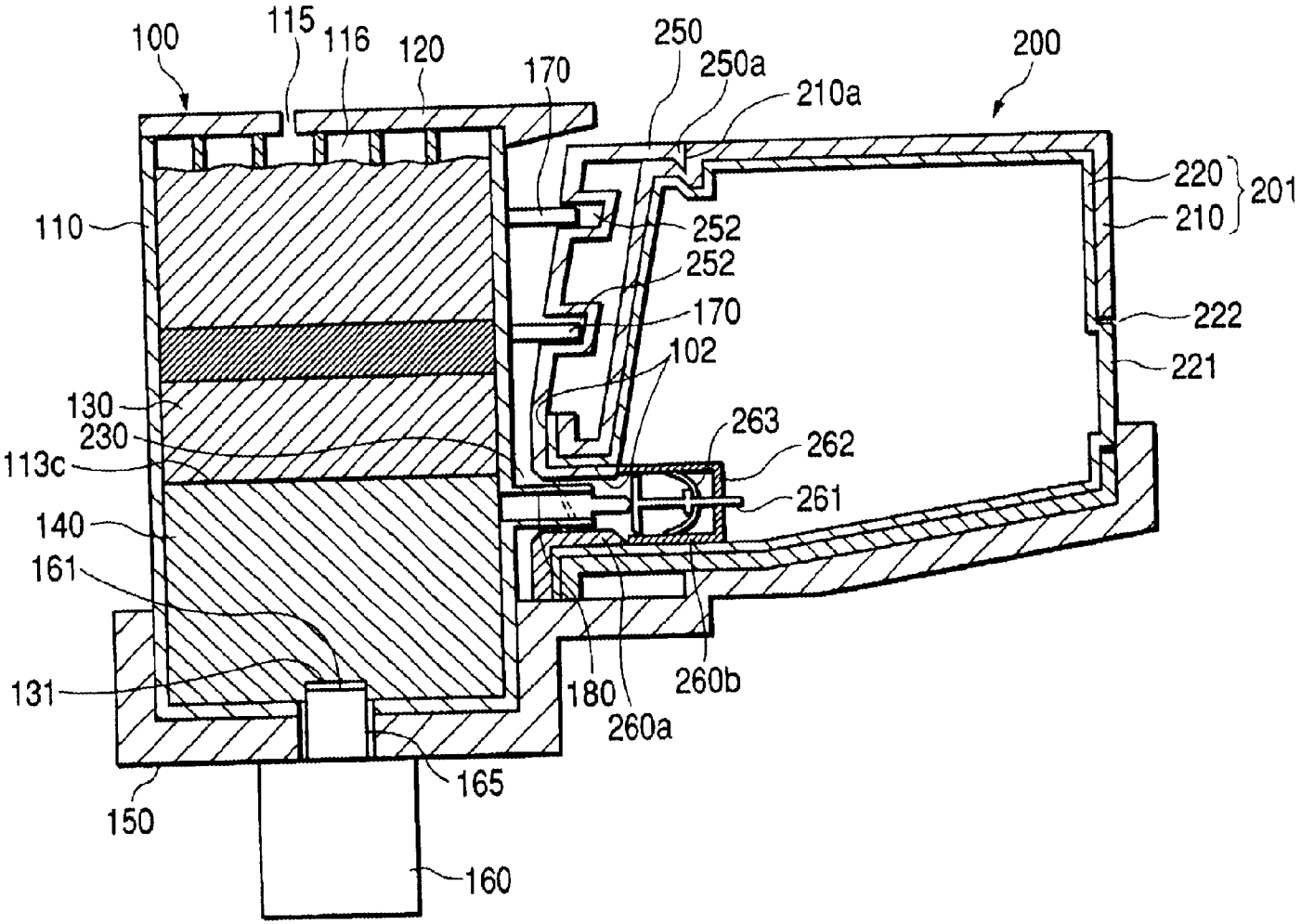
FIG. 51 is a diagrammatic sectional figure showing the ink jet head cartridge, which is the liquid containing container, according to a ninth embodiment of the present invention.
Figure 52:
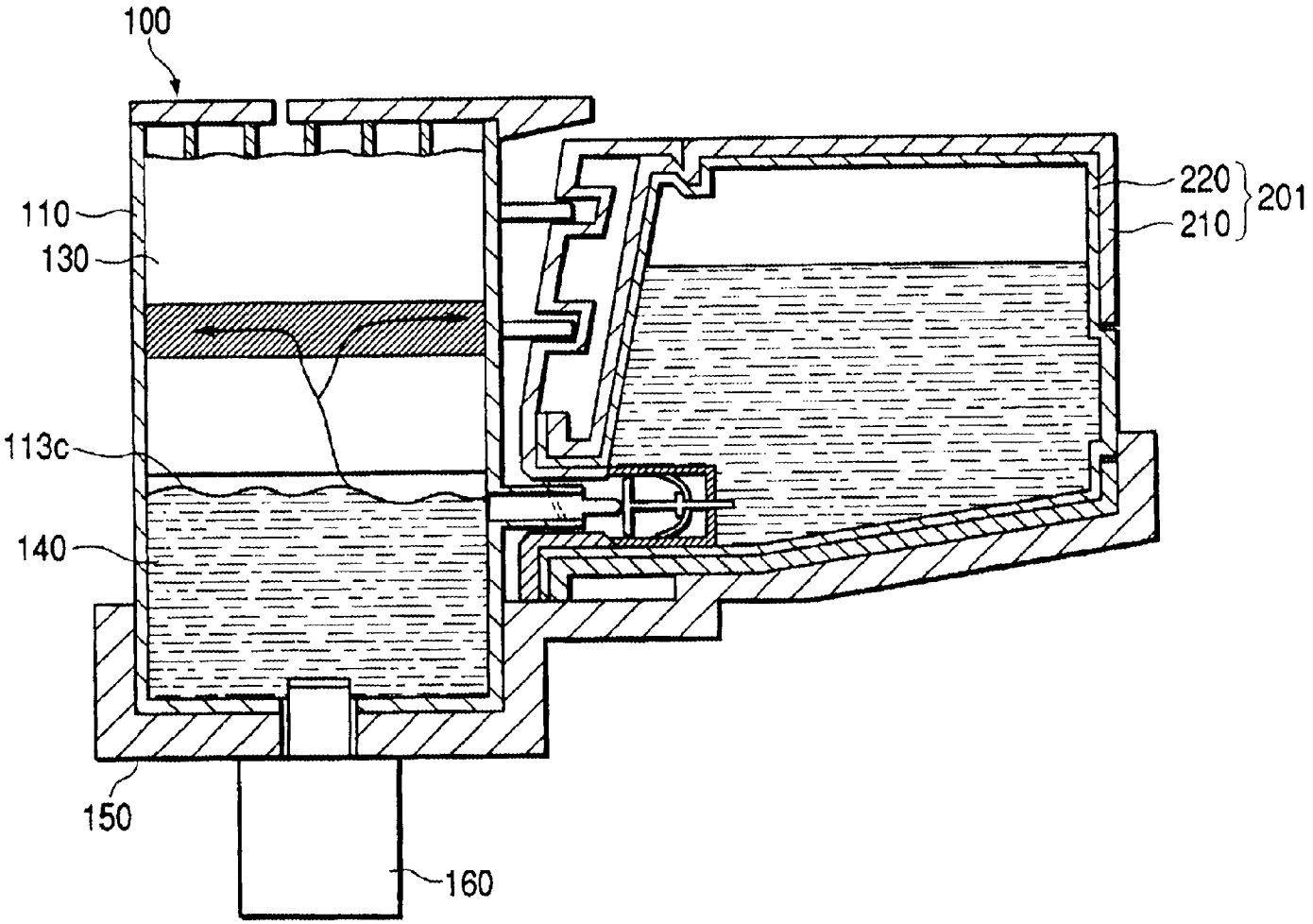
FIG. 52 is a figure explaining a flow of ink in the absorber, when ink flows in a negative pressure regulating chamber container according to an abrupt pressure change of the ink jet head cartridge shown in FIG. 51.

FIG. 51 is the diagrammatic sectional figure showing the ink jet head cartridge, which is the liquid containing container, according to a ninth embodiment of the present invention.

The ink jet head cartridge according to the present embodiment, as shown in FIG. 51, comprises the ink jet head unit 160, the holder 150, the negative pressure regulating chamber unit 100, the ink tank unit 200, and the like. The negative pressure regulating chamber unit 100 is fixed to inside of the holder 150 and to the bottom of the negative pressure regulating chamber unit 100, the ink jet head unit 160 is fixed through the holder. The negative pressure regulating chamber unit 100 comprises the negative pressure regulating chamber container 110 of which top has an opening part, the negative pressure regulating chamber lid 120 attached to the top face of the negative pressure regulating chamber container 110, two absorbers 130 and 140, installed in the negative pressure regulating chamber container 110, for impregnation to hold ink. The absorbers 130 and 140 is, in the status of use of the ink jet head cartridge, stacked to make top and bottom two layers for contacting closely each other resulting in filling in the negative pressure regulating chamber container 110. A capillary force created by the absorber 140 located in the lower step is higher than the capillary force created by the absorber 130 located in the higher step and thus, the absorber 140 located in the lower step shows a higher ink holding performance. Toward the ink jet head unit 160, ink in the negative pressure regulating chamber unit 100 is supplied through an ink supply tube 165.

The absorber 130 communicates with the atmosphere communication orifice 115 and the absorber 140 contacts closely with the absorber 130 on the top face thereof and also contacts closely with a filter 161 on the bottom face thereof. An boundary 113*c* between the absorbers 130 and 140 is located upward than the top end of a joint pipe 180 as the communicating part in the attitude in use.

The absorbers 130 and 140 comprise those made by entangling polyolefin resin (for example, the biaxial fiber in which PE is formed on the superficial layer of PP). The absorber 130 being the top one of each absorber 130 and 140 is hydrophilically treated to locate as a layer crossing to the gravity direction in the attitude in use. In FIG. 51, the region, of the absorber 130, hydrophilically treated is evenly indicated by shadowing. In the present embodiment, hydrophilic treatment is carried out to make the density of the part hydrophilically treated for fibers in the region gradually small from the bottom part to the top part.

By locating the boundary 113*c* between the absorbers 130 and 140 in the top part, preferably around the joint pipe 180 similar to the present embodiment, of the joint pipe 180 in the attitude in use, in gas-liquid exchange action mentioned later, the interface between ink and gas in the absorbers 130 and 140 in gas-liquid exchange action can be assigned to the boundary 113*c*. As the result, the static negative pressure in the head part can be stabilized in ink supplying action. In addition, by making strength of the capillary force of the absorber 140 relatively higher than the capillary force of the absorber 130, in the case where ink exists in both the absorbers 130 and 140, after ink in the upper absorber 130 is consumed, ink in the bottom absorber 140 can be consumed. Further, in the case where gas-liquid interface changes according to the environmental change, after first the absorber 140 and area around the boundary 113*c* between the absorbers 130 and 140 are filled, ink goes to the absorber 130.

The ink tank unit 200 is adapted to have constitution removable from the holder 150. The joint pipe 180 which is the connecting part installed on the surface of the ink tank unit 200 side of the negative pressure regulating chamber container 110 is connected to the joint orifice 230 of the ink tank unit 200 by inserting in the inside thereof. Through the connecting part of the joint pipe 180 and the joint orifice 230, the negative pressure regulating chamber unit 100 and the ink tank unit 200 are constituted to supply ink contained in the ink tank unit 200 to inside of the negative pressure regulating chamber unit 100. In the part in the position upper than the joint pipe 180 in the face of the ink tank unit 200 side of the negative pressure regulating chamber unit 100, the ID member 170, projected from the face thereof, for prevention of wrong installation of the ink tank unit 200 is installed integrally.

On the negative pressure regulating chamber lid 120, the atmosphere communication orifice 115 to communicate inside the negative pressure regulating chamber container 110 with external atmosphere, in other words, the absorber 130 housed in the negative pressure regulating chamber container 110 with external atmosphere, is formed and the space, which is formed by a rib projected from the face of the absorber 130 of the negative pressure regulating chamber lid 120, and a buffer space 116 composed of the area without ink (liquid) in the absorber, are prepared around the atmosphere communication orifice 115 in the negative pressure regulating chamber container 110.

In the joint orifice 230, the valve mechanism is installed. The valve mechanism comprises the first valve frame 260*a*, the second valve body 260*b*, the valve body 261, the valve lid 262, and the energizing member 263. The valve body 261 is supported in the second valve frame 260*b* slidably and energized toward the first valve frame 260*a* side by the energizing member 263. In the status in which the joint pipe 180 is not inserted in the joint orifice 230, an edge part of the part of the first valve frame 260*a* side of the valve body 261 is pressed to the first valve frame 260*a* by an energizing force of the energizing member 263 and hence, air tightness inside the ink tank unit 200 is maintained.

The joint pipe 180 is inserted in the inside part of the joint orifice 230 and the valve body 261 is pressed by the joint pipe 180 to move it from the first valve frame 260*a* and thus, through the opening formed on the side face of the second valve frame 260*b*, inside of the joint pipe 180 communicates with inside part of the ink tank unit 200. According to this, air tightness of the ink tank unit 200 is released to supply ink in the ink tank unit 200 to inside of the negative pressure regulating chamber unit 100 through the joint orifice 230 and the joint pipe 180. In other words, by opening of the valve in the joint orifice 230, inside of the ink containing part of the ink tank unit 200 in the closed status becomes a communicating status though only the above described opening.

The ink tank unit 200 comprises the ink containing container 201 and the ID member 250. The ID member 250 is for prevention of wrong installation in installation of the ink tank unit 200 and the negative pressure regulating chamber unit 100. In the ID member 250, the above described first valve frame 260*a* is formed. By using the first valve frame 260*a*, the valve mechanism is constituted to regulate flow of ink in the joint orifice 230. The valve mechanism performs opening and closing actions by engaging with the joint pipe 180 of the negative pressure regulating chamber unit 100. On the front face, which becomes the negative pressure regulating chamber unit 100 side, of the ID member 250, the recessed part 252 for the ID is formed to prevent wrong insertion of the ink tank unit 200.

The ink containing container 201 is a hollow container having an almost polygonal pier shape and a negative pressure creating function. The ink containing container 201 is constituted from the case 210 and an internal bag 220. The case 210 and the internal bag 220 are adapted to be removable, respectively. The internal bag 220 has flexibility and the internal bag 220 is deformable according to leading of ink contained in inside. The internal bag 220 has the pinch-off part (fused part) 221 and is supported by the pinch-off part 221 in the status of engaging the internal bag 220 with the case 220. In the part, around the pinch-off part 221, of the case 210, the external atmosphere communicating orifice 222 is formed to allow leading atmosphere to the space between the internal bag 220 and the case 210 through the external atmosphere communicating orifice 222.

The ID member 250 is connected to each of the case 210 and the internal bag 220 of the ink containing container 201. The ID member 250 is connected by fusion of the seal face 102 of the internal bag 220, which corresponds to the ink leading part, for the internal bag 220, of the ink containing container 201, with a corresponding face of the part of the joint orifice 230 in the ID member 250. According to this, the supply opening part of the ink containing container 201 is completely sealed to prevent leak of ink from the seal part of the ID member 250 and the ink containing container 201 in attaching and detaching of the ink tank unit 200.

Concerning the case 210 and the ID member 250, when an engaging part 210*a* formed on the top face of the case 210 and a click part 250*a* formed in the top part of the ID member 250 are at least engaged, the ID member 250 is almost fixed to the ink containing container 201.

Next, movement of ink between the ink tank unit 200 and the negative pressure regulating chamber unit 100 will be explained below.

When the ink tank unit 200 is connected to the negative pressure regulating chamber unit 100, ink in the ink containing container 201 moves to inside of the negative pressure regulating chamber unit 100 until pressures of inside of the negative pressure regulating chamber unit 100 and inside of the ink containing container 201 become equal (this status is named starting status for use).

When ink consumption is started by the ink jet head unit 160, balancing in a direction in which values of the static negative pressure created by both inside of the internal bag 220 and the absorber 140 increases, ink held by both the internal bag 220 and the absorber 140 is consumed. Here, if ink is held by the absorber 130, ink in the absorber 130 is also consumed.

When the joint pipe is communicated with atmosphere by reduction of ink amount in the negative pressure regulating chamber unit 100 caused by ink consumption, gas is immediately led to inside of the internal bag 220 and replacing to this, ink in the internal bag 220 moves to inside of the negative pressure regulating chamber unit 100. By this step, the absorbers 130 and 140 keep almost constant negative pressures against leading out of ink keeping the gas-liquid interface. Through such gas-liquid exchange status, when the total volume of ink in the internal bag 220 moves to inside of the negative pressure regulating chamber unit 100, ink remained in the negative pressure regulating chamber unit 100 is consumed.

In the ink jet head cartridge, as described above, having the negative pressure regulating chamber unit 100 and the ink tank unit 200, when ink and gas in the ink containing container 201 abruptly expand according to the environmental change, ink flows in the negative pressure regulating chamber container 110 to raise the level of ink in the negative pressure regulating chamber container 110. Here, ink flows to a place, having the low flow resistance and coarse density of fibers, of the absorbers 130 and 140. By this, the abrupt pressure rise in the container is eased. However, in order to express satisfactorily such pressure easing function (also buffer function), the conventional liquid containing container requires excessively large volume of the upper part of the negative pressure regulating chamber container. However, if the hydrophilically treated area like the present embodiment is prepared in the absorber 130, the flow toward the upper part of the ink absorber according to the abrupt pressure rise can be captured in the hydrophilically treated area to disperse it in the direction of crossing to the gravity direction as shown in the arrow in FIG. 53. By this, the above described buffer function can be fully expressed without the excessively large volume of the upper part of the negative pressure regulating chamber container. In addition, particularly, by conducting hydrophilic treatment for the absorber 130 to make not even but to decrease in treatment density toward the upper part, ink is captured in the hydrophilically treated area sequentially from the bottom side and thus, in the status in which ink capturing is insufficient in the hydrophilically treated area, it does not occur that ink rises over the hydrophilically treated area.

Figure 53:
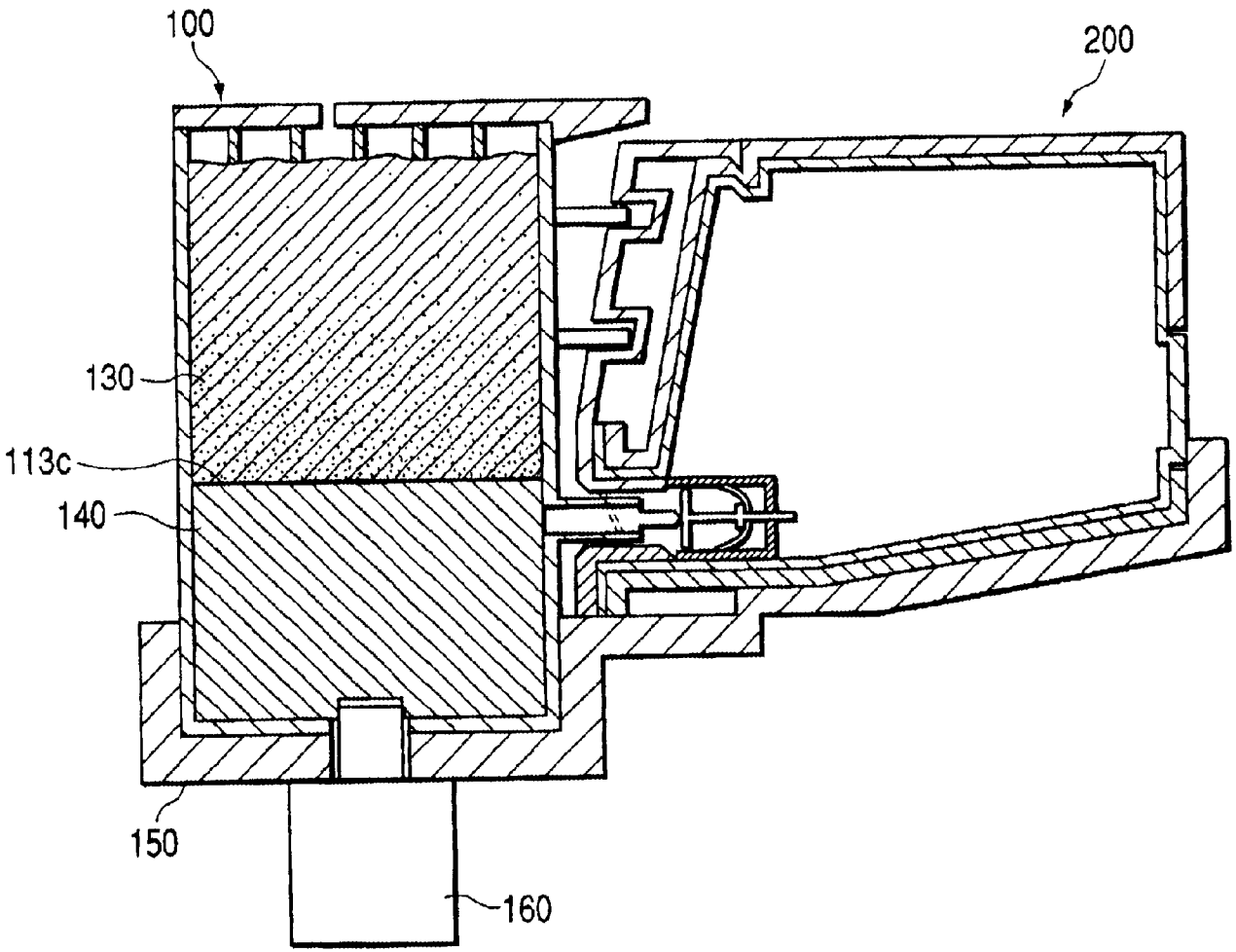
FIG. 53 is a diagrammatic section view of the example of modification of the ink jet head cartridge according to a ninth embodiment of the present invention.

In the example shown in FIG. 51, the example, in which the hydrophilically treated area is put in the part of the upper absorber 130, has been presented. Particularly, in the present embodiment, the interface 130*c* between two absorbers 130 and 140 is located in the position upper than the joint pipe 180 and thus, as shown in FIG. 53, when for whole of the upper absorber 130, hydrophilic treatment is carried out to make the hydrophilic property weak from the bottom to the upper directions, the effect similar to the above description is also yielded.

In the present embodiment, the ink jet cartridge, in which the negative pressure regulating chamber unit 100 and the ink tank unit 200 can be separated, has been shown. However, these may be a form inseparable. In addition, the ink containing container 201 of the ink tank unit 200 has the structure having the deformable inner bag 220, however, may the structure comprising the case 210 only. In the case where the ink containing container 201 is constituted of the case 210, in occurrence of abrupt pressure rise in the ink containing container 201 caused by the environmental change and the like, the buffering function of the ink containing container 201 itself is lost, and hence, the constitution expressing the enough buffering function of the negative pressure regulating chamber unit 100 is more preferable.

(Tenth Embodiment)

Figure 54A:
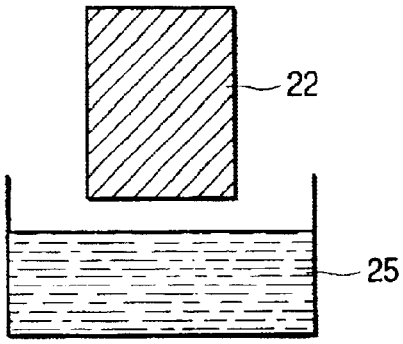
FIGS. 54A, 54B, 54C, 54D and 54E are figures explaining the ink tank which is a tenth embodiment of the present invention.
Figure 54B:
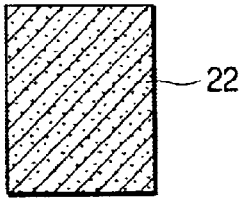
Figure 54D:
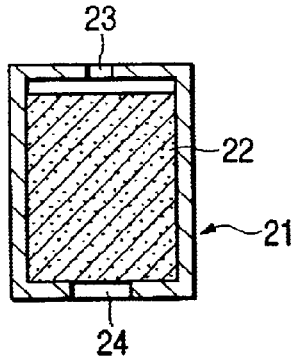
Figure 54C:
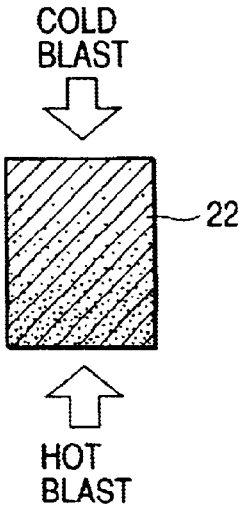
Figure 54E:
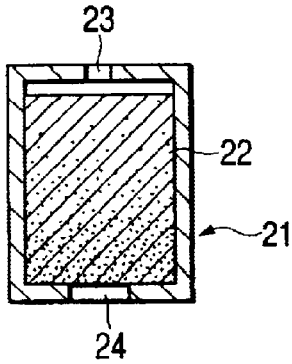

FIG. 54E is the longitudinal sectional view of the ink tank, which is the tenth embodiment of the present invention.

The ink tank 21 of the present embodiment comprises the tank case 26 having the supply opening 24 to supply ink (including liquid such as waterproof reinforced liquid to apply waterproof treatment to a recording medium before ink ejection) to the recording head to record by ejecting ink from the ejecting orifice and the fibrous absorber 22 housed in the tank case 26 to hold ink under the negative pressure condition. The tank case 26 is equipped with the atmosphere communication orifice 23 to communicate the fibrous absorber 22 housed in inside part and with external atmosphere.

The fibrous absorber 22 is totally hydrophilically treated. In the present embodiment, hydrophilic treatment is performed to whole of the fibrous absorber 22. Hydrophilic treatment is carried out to realize that an adsorbing performance of the hydrophilic treatment agent becomes strongest around the supply opening 24 and becomes weak according to the distance from the supply opening 24.

A method for yielding the region relatively superior in relative continuity of hydrophilic effect of the hydrophilically treated part in the above described fibrous absorber 22 and the region relatively inferior in continuity will be described with reference to FIGS. 54A to 54E.

As shown in FIG. 54A, the untreated fibrous absorber 22 is soaked in the hydrophilic treatment agent 25, as shown in FIG. 54B, to attach the hydrophilic treatment agent 25 to the part necessary of an initial hydrophilic property. Subsequently, the operation transferred to the drying step for the hydrophilic treatment agent 15. Here, as shown in FIG. 54C, for the place unnecessary of continuity of hydrophilic effect is subjected to the drying step lacking heating process.

Then, the place heated normally, even after hydrophilic treatment, a treatment film, of which effect is sustained, is formed on the surface of fibers. In contrast, on the place subjected to the drying step lacking heating, cleavage and condensation of the polymer contained in the hydrophilic treatment agent do not take place and hence, the hydrophilic treatment agent leaves as a lump on the surface of fibers and has not bound to the surface of fibers. The part, in which the hydrophilic treatment agent makes a lump, contributes to wettability for initial ink, however, is easy to fall down in comparison with the place subjected to heating process. Therefore, in accordance with a time sequence, the hydrophilic treatment effect is sustained around the supply opening 12 to become the region relatively strong in hydrophilic property. However, the part distant from the supply opening 12 has no sustainability of the hydrophilic treatment effect and thus, becomes the region with relatively weak hydrophilic property.

The fibrous absorber 22 is, as shown in FIG. 54D, inserted in the tank case 26 to make the ink tank 21. In injecting ink in the ink tank 21, the region, of which initial hydrophilic effect has been increased, has been extended to a peripheral region of the atmosphere communication orifice 23 and therefore, injecting ink from other atmosphere communication orifice 23 become easy. And, as shown in FIG. 54E, after ink is injected, the part, hydrophilically treated, around the atmosphere communication orifice 23 falls down to reduce the hydrophilic treatment effect and hence, the fibrous absorber 22, of which hydrophilic treatment effect increases toward the supply opening 24, is completed. Consequently, by adopting the constitution according to the present embodiment, as mentioned in the ninth embodiment with reference to FIG. 47 and the like, in addition to an advantage caused by increase in the hydrophilic treatment effect according to the distance toward the supply opening, initial ink injection can be made easy.

Next, with reference to FIG. 16, a liquid ejecting recording apparatus, which performs recording by mounting the liquid containing container according to the present respective embodiments, will be described below.

Figure 16:
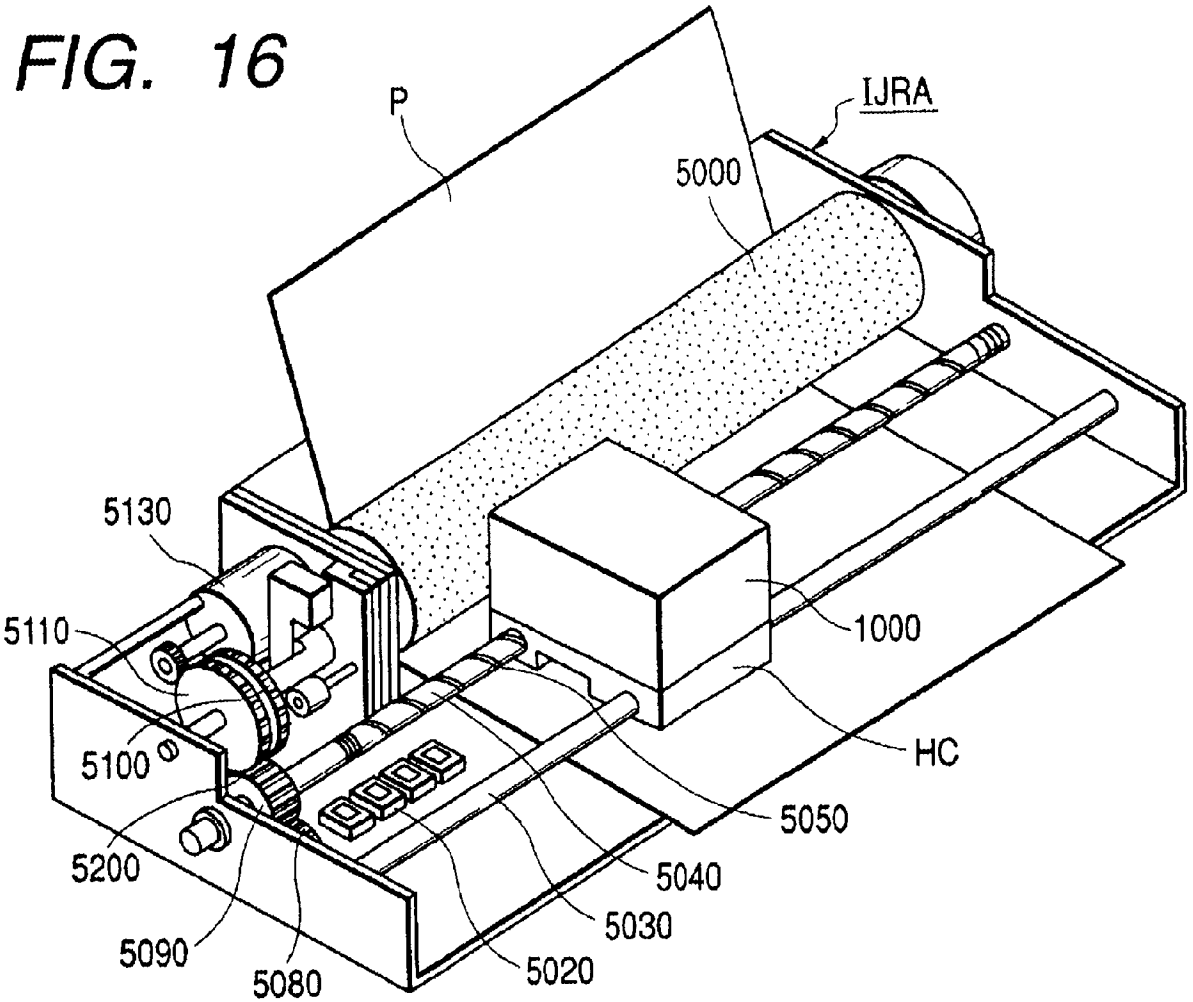
FIG. 16 is a diagrammatic perspective view showing a liquid discharge recording apparatus.

In FIG. 16, the liquid containing container 1000 is fixed to support by positioning means not illustrated on the carriage HC to the main body of the liquid ejecting recording apparatus IJRA and installed in attachably detachable form in the carriage HC. The recording head (not illustrated) to ejecting a recording drop may be previously installed in the carriage HC or may be previously installed in the ink supply opening of the liquid containing container 1000.

A normal and reverse rotation of a driving motor 5130 is transmitted to a lead screw 5040 through driving transmission gears 5110, 5100, and 5090. By rotating these gears or engaging the carriage HC with a screwed groove 5050 of the lead screw 5040, a reciprocating movement along with a guide shaft 5030 becomes possible.

A numeral 5020 represents a cap covering a front face of the recording head and the cap 5020 is used for operating drawing to recovery of the recording head through the opening of the cap by drawing means not illustrated. The cap 5020 can cover the face of an ejecting orifice of respective recording head by moving by a driving force transmitted through gears 5080, 5090 and the like. Around the cap 5020, a cleaning blade not illustrated is installed and the blade is supported movably in the top and bottom directions of the figure. The blade is not restricted to this embodiment, but a known cleaning blade can be naturally applied to the present embodiment.

These capping, cleaning, and drawing recovery are constituted to allow a desired treatment in those corresponding position by the action of the lead screw 5040 when the carriage HC moves to home position thereof. However, if the desired action is adapted to do in a known timing, any of them can be applied to the present embodiment.

As described above, according to the present invention, in the fibrous body as the negative pressure creating member housed in the liquid containing container to hold the recording liquid for the liquid ejecting head, by that the surface of the fiber has polyolefin resin and the polyolefin resin has hydrophilic group orienting to the surface of the resin, wettability of the surface of the resin increases and therefore, even if the liquid used is ink with the high surface tension, a special step and facility, conventionally necessary for injection thereof, can be simplified. In addition, the flow resistance, when the recording liquid moves, decreases and hence, high flow rate supply can be realized for the liquid ejecting head for high speed printing.

Hydrophilic treatment for the pressure contacting body of fibers arranged in the supply opening part of the liquid containing container can reduce the ink flow resistance and increase fluidity of ink and therefore, ink supply of high low rate become possible. In addition, staying of bubbles can be prevented the case fibrous body is made to the pressure contacting body and therefore, rise of the flow resistance can be suppressed.

The part corresponding to the supply opening and peripheral part thereof, of the fibrous body as the negative pressure creating member housed in the liquid containing container, is hydrophilically treated and therefore, the recording liquid exists always in the supply opening and peripheral part thereof and discontinuity of liquid supply to the head is prevented.

In addition, in the liquid containing chamber of integrally formed or attachably detachable constitution through mutual communicating part between the negative pressure creating member-housing chamber and the liquid containing chamber, a plane layer, which is located in the upper part than the communicating part between the above described negative pressure creating member-housing part and the above described liquid containing part and crosses to the gravity direction, of the fibrous body as the negative pressure creating member housed is hydrophilically treated and thus, even if liquid and gas in the liquid containing part is expanded by the environmental change, liquid flowing between fibers can be diffused in the above described hydrophilic treatment part. Therefore, without increasing a volume of the negative pressure creating member-housing chamber, abrupt pressure rise can be fully eased.

Further, in the liquid containing chamber of integrally formed or attachably detachable constitution through mutual communicating part between the negative pressure creating member-housing chamber and the liquid containing chamber, the liquid supply region from the communicating part between the above described negative pressure creating member-housing part and the above described liquid containing part of the fibrous body as the negative pressure creating member housed to the liquid supply opening for the liquid ejecting head is hydrophilically treated and hence, even if the liquid surface in gas-liquid exchange is disturbed and lowered by microscopic difference of density of the fibrous body, the projected lowered liquid surface is stopped in the hydrophilically treated area. According to this process, liquid movement from the liquid containing part to the negative pressure creating member-housing part is not discontinued by air and therefore, stable gas-liquid exchange action is carried out. The part around the supply opening is hydrophilically treated and thus, the recording liquid exists always around there and hardly discontinued in the supply opening. Further, when a new liquid containing part is replaced to, the hydrophilically treated area of fibers draws liquid actively and therefore, the liquid ejecting head can be smoothly recovered. Liquid quantity necessary for recovery of the liquid ejecting head can be controlled according to the magnitude of the hydrophilically treated area.

In the liquid containing chamber of integrally formed or attachably detachable constitution through mutual communicating part between the negative pressure creating member-housing chamber and the liquid containing chamber, regions, corresponding to the communicating part between the above described negative pressure creating member-housing part and the above described liquid containing part or the atmosphere leading groove and the near area thereof, of the fibrous body as the negative pressure creating member housed is hydrophilically treated and hence, this hydrophilically treated part stably holds liquid and thus, before the gas-liquid exchange status is reached, it can be prevented that the gas-liquid exchange action is carried out by careless air pass. When consumption of the recording liquid stops in the gas-liquid exchange status, the part corresponding to the atmosphere leading groove the above described fibrous body and peripheral part thereof can be filled with liquid to close rapidly the atmosphere communicating groove or communicating part. According to the above described functions, stable gas-liquid exchange action becomes possible. In addition, when the above described liquid containing container is removed for replacement, liquid hardly drops than the communicating part of the above described negative pressure-creating member housing part side.

Besides, according to the surface reform method applied to the present invention, for the surface of entire inside part of the negative pressure-creating member, such as the porous body and a finely processed element, having a complicated shape, desired lyophilic can be applied. And, for the olefin resin, which is regarded as difficult to subject to the surface reform, lyophilic nature can be maintained for a longer period than conventional one. Further, there is hardly the negative pressure-creating member structure and an increase in a weight and the surface itself reformed can be formed as a thin layer of a molecular level, preferably the monomolecular level. Furthermore, desired reform can be freely practiced and also a manufacturing method excellent in simple and mass production performance can be provided.

As explained above, according to the fibrous absorber of the present invention, by giving distribution to the strength of lyophilic nature and by applying lyophilic treatment, in accordance with behavior of liquid necessary in the liquid container, liquid can be held in the optimal condition and can be supplied to the liquid ejecting head.

According to the liquid container of the present invention, by housing the fibrous absorber for liquid ejection of the above described present invention, according to behavior of liquid necessary in the liquid container, if the first liquid affinity treated region of the fibrous absorber for liquid ejection is arranged in a predetermined position in the liquid container, liquid can be held in the optimal condition and can be supplied to the liquid ejecting head.

More specifically, when lyophilic is applied to the fibrous absorber to make lyophilic nature higher as distance as far from the supply opening, even liquid located in the position far from the supply opening can flow easily toward the supply opening and thus, efficiency of liquid use can be improved. In addition, when lyophilic is applied to the fibrous absorber around the supply opening to make lyophilic nature lower as distance as far from the supply opening, preventing increase in the flow resistance of liquid around the supply opening, continuity of liquid low toward the liquid ejecting head can be kept. In addition, the liquid container of the structure in which the negative pressure creating member-housing chamber housed the fibrous absorber communicates with the liquid containing chamber contained liquid through the communicating part, in the position upper than the communicating part of the fibrous absorber, has the liquid affinity treated part which exists as there layer crossing to the gravity direction and subjected to hydrophilic treatment to make lyophilic nature weak from the bottom to top directions and thus, the buffer function, when liquid in the liquid containing chamber flows in the negative pressure creating member-housing chamber according to the environmental change, can be realized using the volume of the small negative pressure creating member-housing chamber. Furthermore, in the liquid container according to the above described present invention, by injecting liquid from the region in which lyophilic nature is higher, liquid can be conveniently injected in the liquid container unnecessary of reduction of pressure in the liquid container.

Furthermore, according to the manufacturing method, of the present invention, for the fibrous absorber for liquid ejection, the fibrous absorber, of which lyophilic nature has distribution, for liquid ejection, of the present invention, can be easily manufactured. On the other hand, the surface treatment for the fibrous absorber gives liquid containing a liquid affinity group to the predetermined position of the surface of the fiber and allows the liquid affinity group to bind to the surface of the fiber through cleaving and condensing steps and hence, reform can be better carried out for the surface with a complex shape such as the surface of the fiber and lyophilic nature can be kept for a long period. In addition, the film formed on the surface is the film of monomolecular level and thus, a weight of the fibrous absorber hardly increases.

What is claimed is:

1. A negative pressure producing fiber body for use in a container for containing a liquid, which is to be supplied to a liquid ejecting head for ejecting the liquid for recording, in a manner that allows the liquid to be supplied, comprising:

a first portion having an olefin resin at least on a fiber surface thereof, said olefin resin having a hydrophilic group; and a second portion having a group of which interfacial energy is lower than that of said hydrophilic group and almost the same as the surface energy of said fiber surface;

wherein said second portion is oriented toward said fiber surface and said first portion is oriented in a direction different from said fiber surface.

2. A fiber body for use in a container for containing a water-based liquid, which is to be supplied to a liquid ejecting head for ejecting the water-based liquid for recording, in a manner that allows the water-based liquid to be supplied, consisting of a fiber provided with a polymer at least part of its surface, said polymer including a first portion having a hydrophilic group and a second portion having a group of which interfacial energy is lower than that of said hydrophilic group and almost the same as the surface energy of said part of the surface, said second portion being oriented toward said part of the surface, said first portion being oriented in the direction different from said part of the surface.

3. The fiber body according to claim 2, wherein the surface of said fiber consists of an olefin resin and said polymer is polyalkylsiloxane including a hydrophilic group.

4. The fiber body according to claim 3, wherein said hydrophilic group has a polyalkylene oxide chain.

5. The fiber body according to claim 3, wherein said olefin resin is polypropylene or polyethylene and said polyalkylsiloxane is polyoxyalkylene-dimethylpolysiloxane.

6. A liquid container containing the fiber body according to any one of claims 2 to 5 as a negative pressure generating member.

7. A liquid container comprising a negative pressure generating member containing portion for containing the fiber body according to any one of claims 2 to 5 as a negative pressure generating member and a liquid containing portion for supplying liquid to said negative pressure generating member containing portion, said liquid containing portion and said negative pressure generating member containing portion constituting an integrally or removably formed unit.

8. The liquid container according to claim 7, comprising an inner bag for containing liquid, which becomes deformed as the liquid contained therein becomes led out and thereby can produce a negative pressure, a casing for covering said inner bag, and an atmosphere communication port which can introduce atmosphere between said casing and said inner bag.

9. A liquid container comprising a supply opening for supplying liquid to a liquid ejecting head and an atmosphere communication port for allowing the interior thereof to communicate with the atmosphere and containing a negative pressure generating member, wherein the fiber body according to claim 2 is arranged in the interior portion of said supply opening.

10. A fiber body having an olefin resin at least on its surface, said surface having a reformed portion having been subjected to surface treatment of giving hydrophilic nature thereto, and applied to a negative pressure producing portion for use in an ink jet apparatus, comprising a wettable surface structure obtained in the following steps of: attaching on the surface of said fiber a treatment agent containing a polymer, which has a hydrophilic group and a group having an interfacial energy almost the same as the surface energy of said olefin-based fiber surface thereon, a dilute acid as a catalyst for said polymer cleavage and alcohol; subjecting said polymer to cleavage by evaporating the treatment agent attached on the surface of said fiber and allowing said dilute acid to be a concentrated acid; and condensing the product of the polymer cleavage.

11. A fiber, which constitutes an ink absorber applied to a negative pressure producing portion for use in an ink jet apparatus, having a reformed surface with a functional group introduced thereon, wherein the surface of said fiber has a condensate of a polymer fragmented product attached thereon, said condensate being obtained by condensing the polymer fragmented product comprising a second portion having a group of which interfacial energy is almost the same as the surface energy of said fiber surface and a first portion having said functional group in a state where said polymer fragmented product is oriented based on the affinity to said fiber surface of the group of which interfacial energy is almost the same as the surface energy of said surface, said polymer fragmented product being obtained by subjecting a polymer compound comprising said first portion and said second portion to cleavage.

12. A fiber, which constitutes an ink absorber applied to a negative pressure producing portion for use in an ink jet apparatus, having a periphery portion consisting of a curved surface of which cross section has a periphery in the form of a closed ring, having on said periphery portion at least a portion coated with a film which contains a polymer and surrounds the periphery of said periphery portion in the form of a closed ring, and having been subjected to surface reforming on the surface portion coated with the film containing said polymer, wherein said polymer is a material which is soluble in a solvent or of which main skeleton is different from said fiber surface and comprises a first portion having a functional group used for reforming said surface and a second portion having a group of which interfacial energy is different from that of said functional group but almost the same as the surface energy of said surface, said second portion being oriented toward said surface, said first portion being oriented in the direction different from said surface, said polymer being obtained by binding polymer fragments obtained by fragmenting a polymer compound with a catalyst for polymer cleavage.

13. A fiber having a hydrophobic surface part of which has been subjected to surface reforming into a hydrophilic surface and constituting an ink absorber which is applied to a negative pressure producing portion for use in an ink jet method, wherein a polymer fragmented product having a hydrophilic group and a hydrophobic group is attached on said hydrophobic surface in such a manner as that said hydrophobic group is oriented toward the surface of said hydrophobic group and said hydrophilic group is oriented in the direction different from said hydrophobic group, said polymer fragmented product being obtained by subjecting a polymer compound comprising said hydrophilic group and said hydrophobic group to cleavage.

14. The fiber according to claim 13, comprising a core portion and a surface layer covering said core portion, each of said core portion and said surface layer consisting of an olefin resin, the melting point of the resin constituting said core portion being higher than that of the resin constituting said surface layer.

15. The fiber according to claim 14, wherein the resin constituting said core portion is polypropylene and the resin constituting said surface layer is polyethylene.

16. The fiber according to claim 15, wherein said core portion is partially exposed to the outer wall surface and said polymer fragmented products are attached both on the surface of the exposed portion of said core portion and on the surface of said surface layer.

17. The fiber according to any one of claims 13 to 16, wherein said polymer compound is polyalkylsiloxane having a hydrophilic group.

18. The fiber according to claim 17, wherein said polymer compound has a polyalkylene oxide group as said hydrophilic group.

19. The fiber according to any one of claims 13 to 16, wherein polyalkylsiloxane having said hydrophilic group is (polyoxyalkylene)-poly(dimethylsiloxane).

20. A fiber body which has an olefin resin at least on its surface, has part of its surface reformed to be hydrophilic, and is applied to a negative pressure producing portion for use in an ink jet apparatus, comprising a wettable surface structure having relatively long chain hydrophilic groups and relatively short chain hydrophobic groups alternately on said fiber surface, the wettable surface structure being obtained by the following steps of: forming a fiber surface having a treatment liquid attached thereon, the treatment liquid comprising a polymer having a hydrophilic group and a group of which interfacial energy is almost the same as the surface energy of the fiber surface comprising said olefin resin as a constituent, a dilute acid as a catalyst for said polymer cleavage and alcohol; subjecting said polymer to cleavage by evaporating the treatment liquid attached on said fiber surface and allowing said dilute acid to be changed to a concentrated acid; and condensing the polymer cleavage products.

21. A fiber absorber, as an assembly of numbers of fibers, for use in liquid ejection which has a olefin resin at least on its surface and a reformed surface obtained by subjecting at least part of said surface to surface reforming of giving lyophilic nature thereto and is used for holding a liquid supplied to a liquid ejecting head under a negative pressure, comprising a wettable surface structure having relatively long chain hydrophilic groups and relatively short chain hydrophobic groups alternately on said fiber surface, the wettable surface structure being obtained by the following steps of:

forming a fiber surface having a treatment liquid attached thereon, the treatment liquid comprising a polymer having a hydrophilic group and a group of which interfacial energy is almost the same as the surface energy of the fiber surface comprising said olefin resin as a constituent, a dilute acid as a catalyst for said polymer cleavage and alcohol; subjecting said polymer to cleavage by evaporating the treatment liquid attached on said fiber surface and allowing said dilute acid to be changed to a concentrated acid; and condensing the polymer cleavage products, said wettable surface structure having a first lyophilic area relatively superior in lyophilic nature and a second lyophilic area relatively inferior to the above first lyophilic area in lyophilic nature.

* * * * *